US010244880B2

(12) United States Patent
Mumford

(10) Patent No.: US 10,244,880 B2
(45) Date of Patent: Apr. 2, 2019

(54) BEVERAGE CONTAINERS, HEAT TRANSFER PAD, AND RELATED SYSTEM AND METHODS

(71) Applicant: John Robert Mumford, Oakville (CA)

(72) Inventor: John Robert Mumford, Oakville (CA)

( * ) Notice: Subject to any disclaimer, the term of this patent is extended or adjusted under 35 U.S.C. 154(b) by 4 days.

(21) Appl. No.: 15/626,700

(22) Filed: Jun. 19, 2017

(65) Prior Publication Data

US 2017/0360227 A1 Dec. 21, 2017

Related U.S. Application Data

(60) Provisional application No. 62/375,757, filed on Aug. 16, 2016, provisional application No. 62/352,856, filed on Jun. 21, 2016.

(51) Int. Cl.

| | |
|---|---|
| ***A47G 19/22*** | (2006.01) |
| ***F25D 3/06*** | (2006.01) |
| ***F25D 31/00*** | (2006.01) |
| ***F25D 3/08*** | (2006.01) |
| *F25D 11/02* | (2006.01) |

(52) U.S. Cl.

CPC ..... *A47G 19/2288* (2013.01); *A47G 19/2255* (2013.01); *F25D 3/06* (2013.01); *F25D 3/08* (2013.01); *F25D 31/008* (2013.01); *F25D 11/025* (2013.01); *F25D 2303/0841* (2013.01); *F25D 2303/0845* (2013.01)

(58) Field of Classification Search

CPC ..... A47G 19/2288; A47G 19/2255; A47G 19/2227; A47G 19/2205; F25D 31/008

USPC ..... 220/592.16; 215/372, 374, 377

See application file for complete search history.

(56) References Cited

U.S. PATENT DOCUMENTS

| | | | | |
|---|---|---|---|---|
| 818,167 A | | 4/1906 | Hatfield | |
| 3,393,819 A | * | 7/1968 | Van De Walle | A47G 19/2255 156/275.5 |
| 4,555,040 A | * | 11/1985 | Butenschon | A47G 19/2227 215/365 |

(Continued)

FOREIGN PATENT DOCUMENTS

| | | |
|---|---|---|
| CN | 203163418 U | 8/2013 |
| CN | 104490201 A | 4/2015 |

(Continued)

OTHER PUBLICATIONS

Documents relating to International Application No. PCT/CA2017/050747, Publication No. 2017/219129. dated Sep. 14, 2017 (International Search Report and Written Opinion).

*Primary Examiner* — Anthony D Stashick
*Assistant Examiner* — Raven Collins
(74) *Attorney, Agent, or Firm* — Bereskin & Parr LLP/S.E.N.C.R.L., s.r.l.

(57) ABSTRACT

A beverage container includes a base, a stem, and a bowl. The base has a base lateral dimension parallel to the horizontal supporting plane. The stem extends upwardly from a stem lower end coupled to the base to a stem upper end. The stem has a heat pipe extending between the stem lower end and the stem upper end. The stem has a stem lateral dimension smaller than the base lateral dimension. The bowl is coupled to the stem upper end and extends upwardly of the stem. The bowl defines a liquid chamber having an upper opening. Other beverage containers, systems, methods, and heat transfer pads are also disclosed.

22 Claims, 51 Drawing Sheets

(56) References Cited

U.S. PATENT DOCUMENTS

| | | | | |
|---|---|---|---|---|
| 4,765,393 | A | 8/1988 | Baxter | |
| 4,982,722 | A | 1/1991 | Wyatt | |
| 6,213,336 | B1 * | 4/2001 | Lin | A47G 19/027 220/592.16 |
| 6,305,272 | B1 | 10/2001 | Lin | |
| 6,431,124 | B2 | 8/2002 | Kwon | |
| 6,758,058 | B1 | 7/2004 | Citrynell et al. | |
| 7,644,592 | B2 | 1/2010 | Kent | |
| 7,744,982 | B2 | 6/2010 | Best | |
| 9,035,222 | B2 | 5/2015 | Alexander | |
| 9,107,533 | B2 | 8/2015 | Volz et al. | |
| 2004/0144791 | A1 | 7/2004 | Gluck | |
| 2006/0219724 | A1 * | 10/2006 | Melnik | A47J 27/00 220/592.27 |
| 2009/0056368 | A1 | 3/2009 | Rey | |
| 2011/0146301 | A1 | 6/2011 | Chapman et al. | |
| 2014/0117029 | A1 * | 5/2014 | Harvey | A47G 19/2288 220/660 |
| 2015/0289692 | A1 | 10/2015 | Bell | |
| 2016/0007783 | A1 | 1/2016 | Melton et al. | |
| 2016/0031630 | A1 | 2/2016 | Malaspino et al. | |
| 2016/0051070 | A1 | 2/2016 | Booska | |
| 2017/0013983 | A1 * | 1/2017 | Barry | A47G 19/2255 |
| 2017/0317819 | A1 * | 11/2017 | Hu | H04L 9/0643 |

FOREIGN PATENT DOCUMENTS

| | | | |
|---|---|---|---|
| CN | 104634144 | A | 5/2015 |
| DE | 19857566 | A1 | 6/2000 |
| EP | 1053708 | A1 | 11/2000 |
| EP | 3001126 | A1 | 3/2016 |
| GB | 2515514 | B | 1/2016 |
| WO | 2017/219129 | A1 | 12/2017 |

* cited by examiner

BEVERAGE CONTAINERS, HEAT TRANSFER PAD, AND RELATED SYSTEM AND METHODS

FIELD

This application relates to beverage containers, heat transfer pads, and related systems and methods.

INTRODUCTION

Beverage containers provide storage and transportation of beverages such as water, juice, wine, beer, and others. Stemmed beverage containers have a stem that connects a base and a bowl. Some beverage containers are designed to maintain the temperature of the beverage contained within.

SUMMARY

In one aspect, a beverage container is provided. The beverage container may comprise a base, a stem, and a bowl. The base has a base lateral dimension parallel to the horizontal supporting plane. The stem extends upwardly from a stem lower end coupled to the base to a stem upper end. The stem has a heat pipe extending between the stem lower end and the stem upper end. The stem has a stem lateral dimension smaller than the base lateral dimension. The bowl is coupled to the stem upper end and extends upwardly of the stem. The bowl defines a liquid chamber having an upper opening.

In another aspect, a method of manufacturing a beverage container is provided. The method may comprise: providing a base defining a lower horizontal supporting plane; providing a stem extending from a stem lower end to a stem upper end, the stem having a heat pipe extending between the stem lower end and the stem upper end; providing a bowl defining a liquid chamber having an upper opening; connecting the stem lower end to the base; and connecting the stem upper end to the bowl.

In another aspect, a glass beverage container is provided. The glass beverage container may comprise a transparent glass body and a conductive slug. The transparent glass body has a bottom and a sidewall extending upwardly from the bottom. The glass body has a body inner surface defining a liquid chamber with an upper opening. The bottom has a bottom lower surface defining a lower horizontal supporting plane. The conductive slug is connected to the bottom and thermally coupled to the body inner surface. The conductive slug includes an exposed slug lower contact surface. The conductive slug is made of a slug material having a thermal conductivity of at least 10 W/(m K) at 20° C.

In another aspect, a beverage heat transfer pad is provided. The beverage heat transfer pad may comprise a first beverage container support, one or more second beverage container supports, an insulated body, and one or more thermal bridges. The first beverage container support includes a first thermally conductive portion having an exposed upper contact surface. The first thermally conductive portion including a first conductive material having a thermal conductivity of at least 10 W/(m K). Each second beverage container support includes a second thermally conductive portion having an exposed upper contact surface. Each second thermally conductive portion includes a second conductive material having a thermal conductivity of at least 10 W/(m K). The insulated body connects the first beverage container support to each of the second beverage container supports. The insulated body spaces the first beverage container support from each of the second beverage container supports. The insulated body includes an insulative material having a thermal conductivity of less than 3 W/(m K). The one or more thermal bridges collectively thermally couples the first thermally conductive contact surface to each of the second thermally conductive contact surfaces.

In another aspect, a beverage heat transfer system is provided. The system may comprise a beverage heat transfer pad, and a first beverage container removably supportable on the first beverage container support whereby the first beverage container is thermally coupled to the upper contact surface of the first beverage container support and whereby the first beverage container is thermally coupled to each of the second beverage container supports by the one or more thermal bridges In another aspect, a method of transferring heat between beverage containers is provided. The method may comprise: placing a first beverage container on a first beverage container support thereby thermally coupling the first beverage container to the first beverage container support; placing a second beverage container on a second beverage container support thereby thermally coupling the second beverage container to the second beverage container support, wherein the first beverage container support is spaced apart from the second beverage container support by insulating material, and transmitting heat between the first beverage container and the second beverage container across a thermal bridge that thermally couples the first beverage container support to the second beverage container support.

In another aspect, a method of making a beverage container is provided. The method may include forming a stem comprising positioning a heat pipe shell in a stem sleeve to define a space between the heat pipe shell and the stem sleeve; hermetically sealing the space; and coupling a bowl to the stem.

In another aspect, a beverage container is provided. The container may comprise a conductive bottom, a sidewall, and a liquid chamber. The conductive bottom has a bottom inside surface and a bottom outside surface, and a thermal conductivity between the bottom inside surface and bottom outside surface of at least 10 W/(m K). The sidewall extends upwardly from the conductive bottom. The sidewall has a sidewall inside surface spaced apart from a sidewall outside surface by a gas space. The liquid chamber is defined by the bottom inside surface and the sidewall inside surface.

In another aspect, a beverage container is provided. The beverage container may comprise a conductive bottom, a glass sidewall, and a liquid chamber. The conductive bottom has a bottom inside surface and a bottom outside surface, and a thermal conductivity between the bottom inside surface and bottom outside surface of at least 10 W/(m K). The glass sidewall extends upwardly from the conductive bottom. The glass sidewall has a sidewall inside surface. The liquid chamber is defined by the bottom inside surface and the sidewall inside surface.

DRAWINGS

Figure 10A:
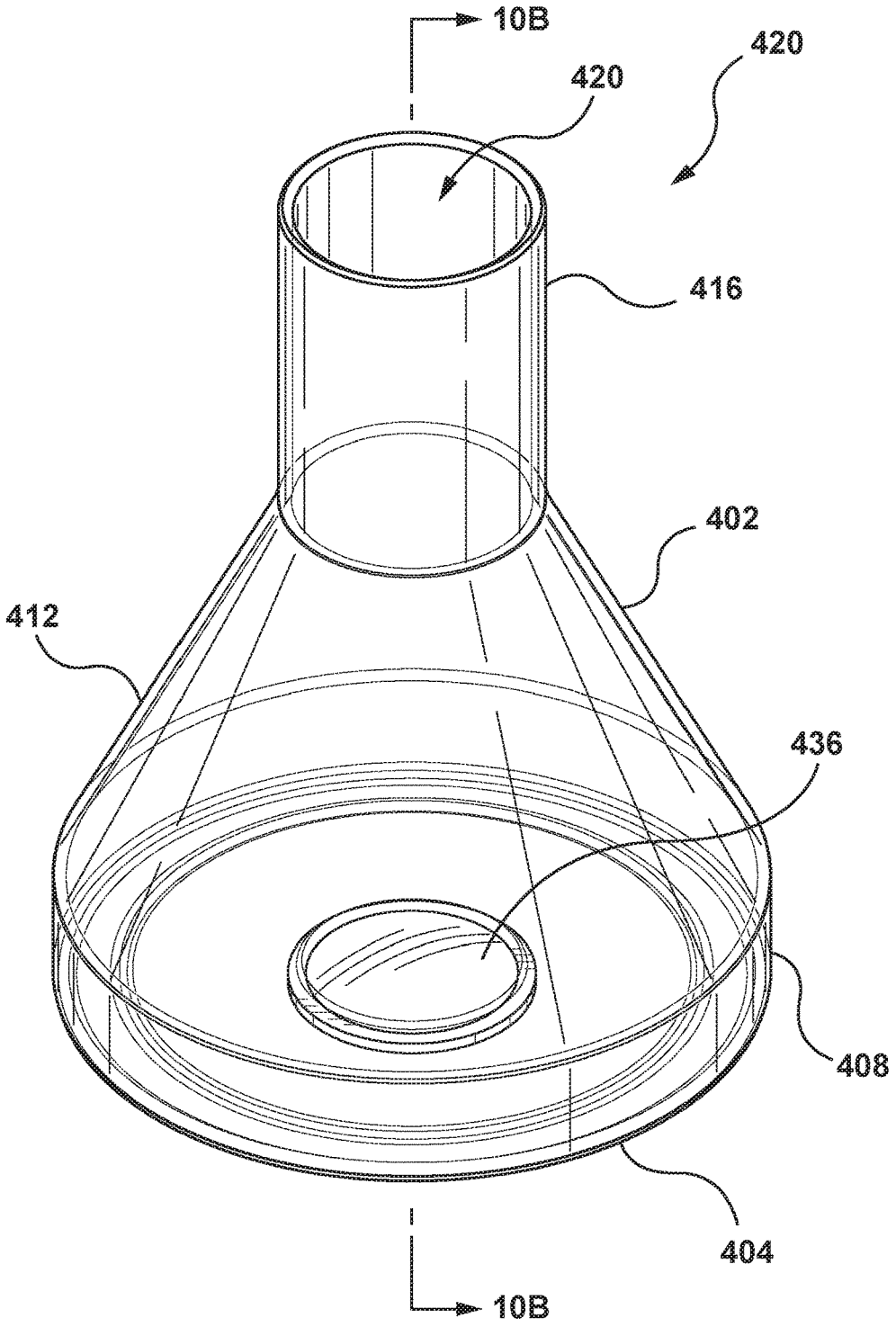
FIG. 10A is a perspective view of a beverage container in accordance with at least one embodiment.
Figure 10B:
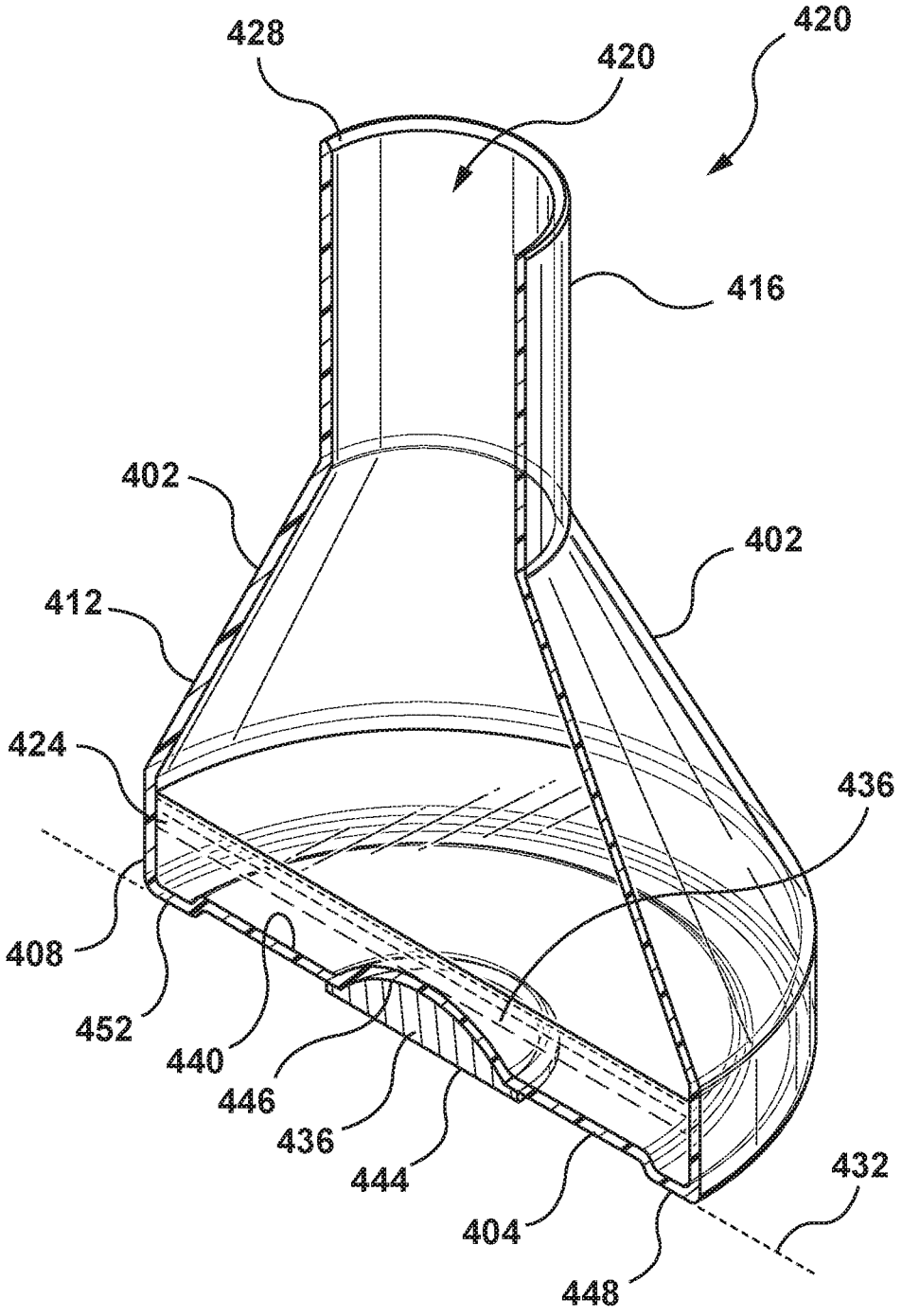
FIG. 10B is a perspective cross-sectional view taken along line 10B-10B in FIG. 10A.
Figure 10E:
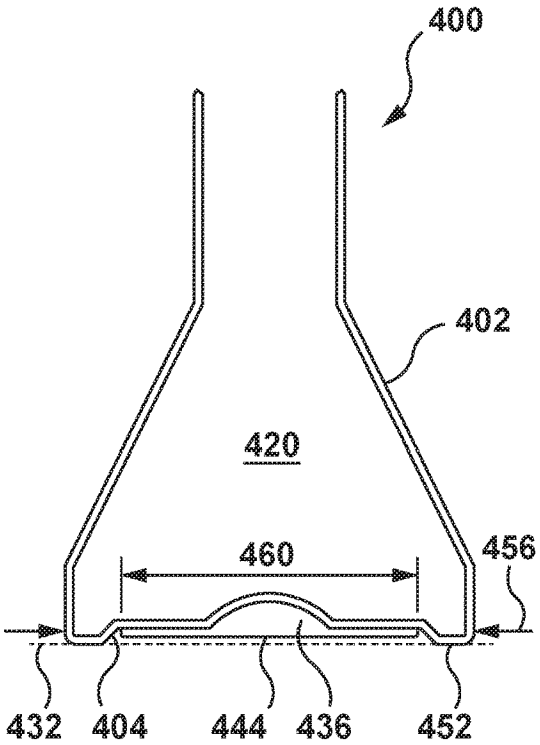
Figure 10D:
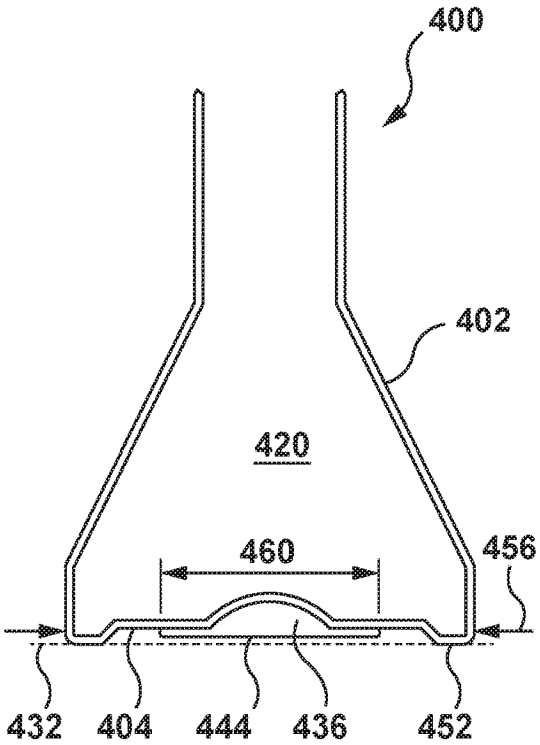
Figure 10C:
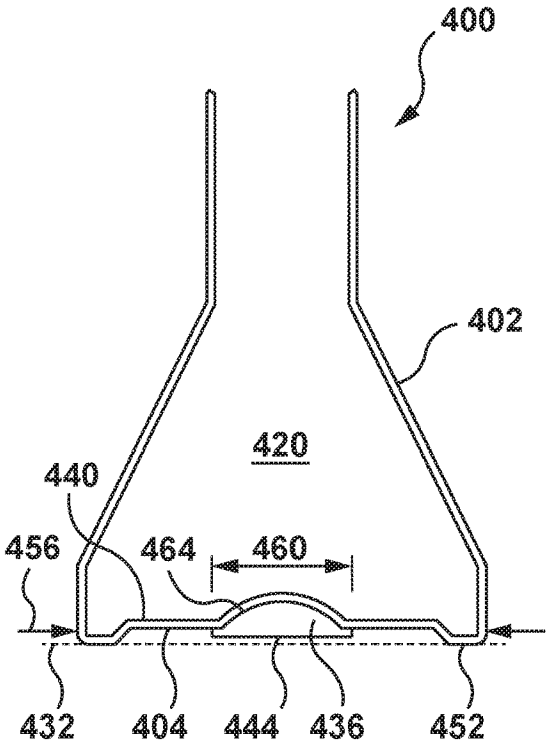
Figure 11:
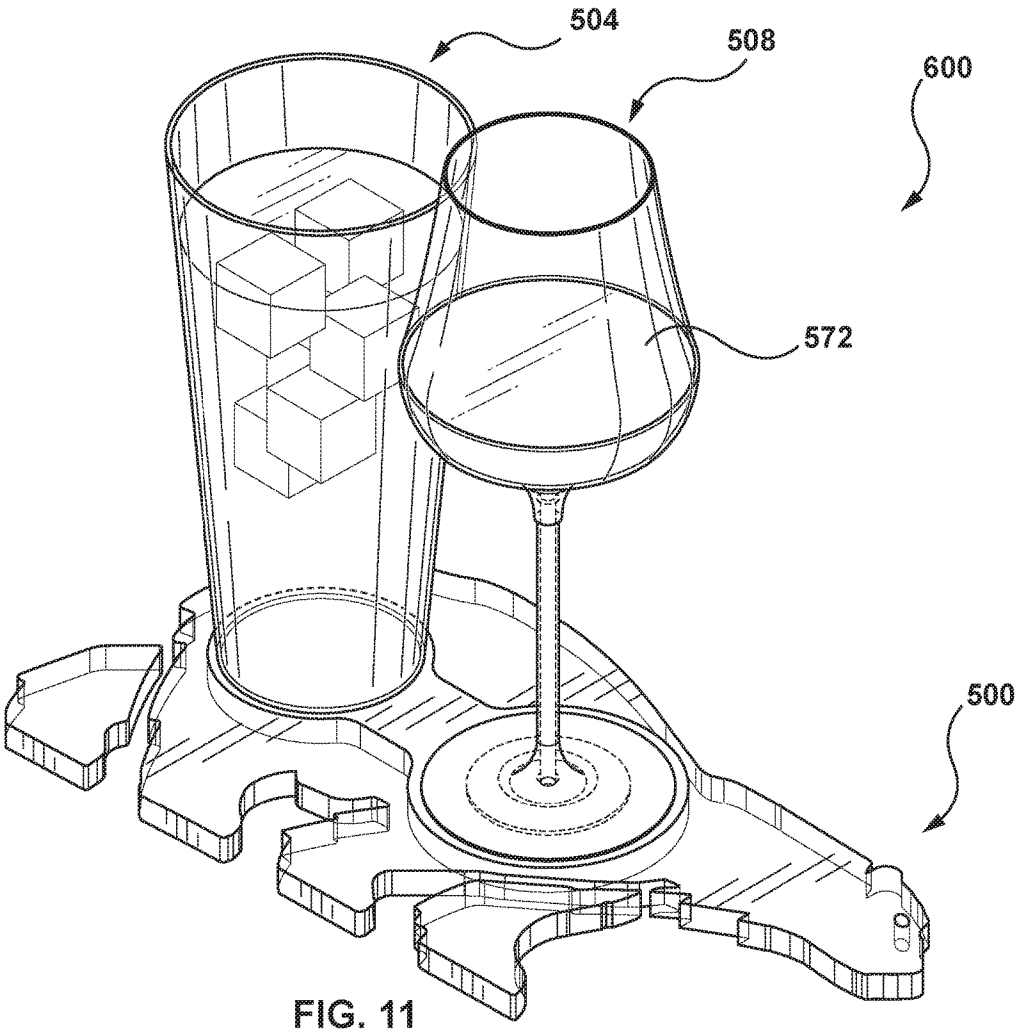
Figure 12:
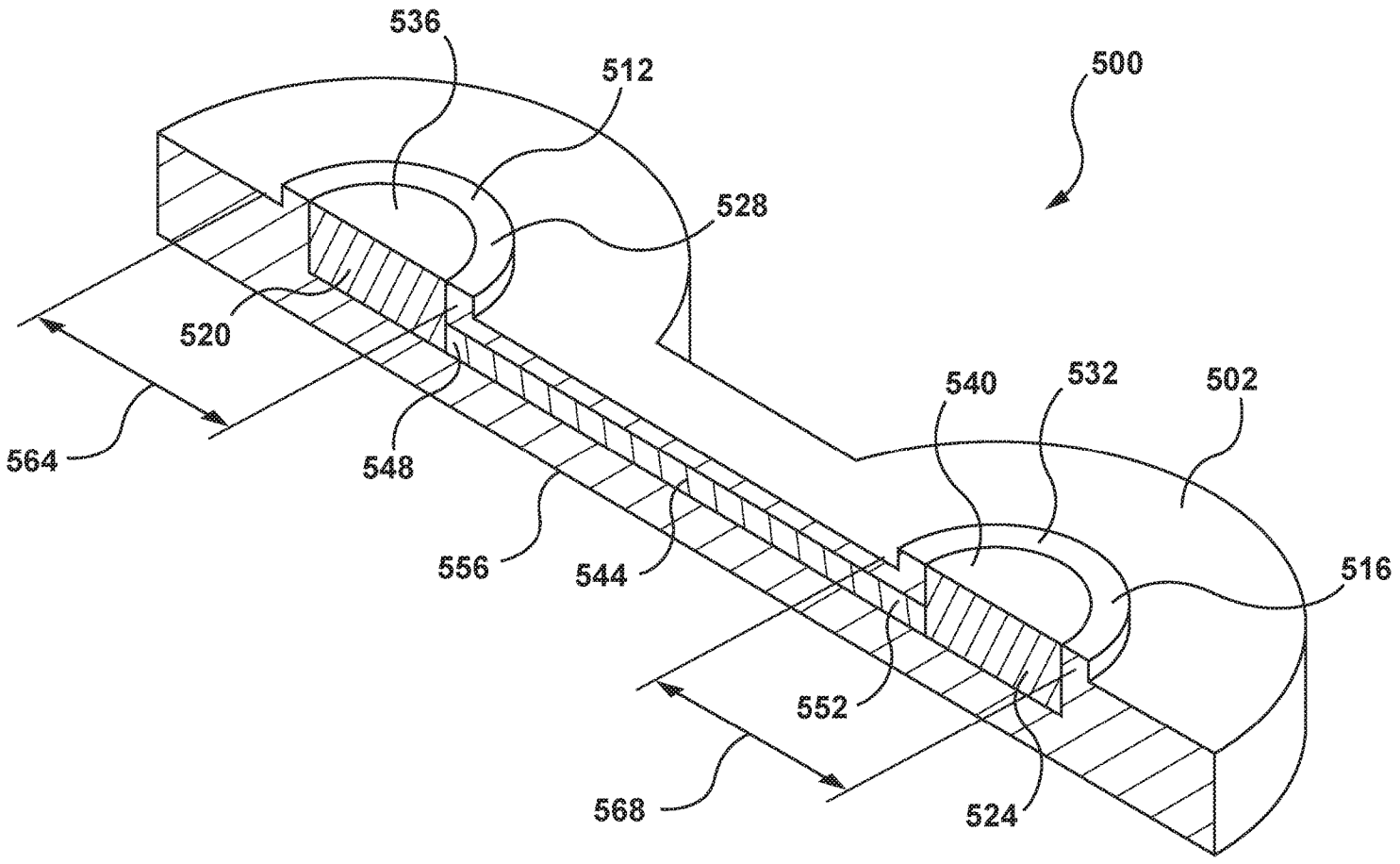
Figure 13:
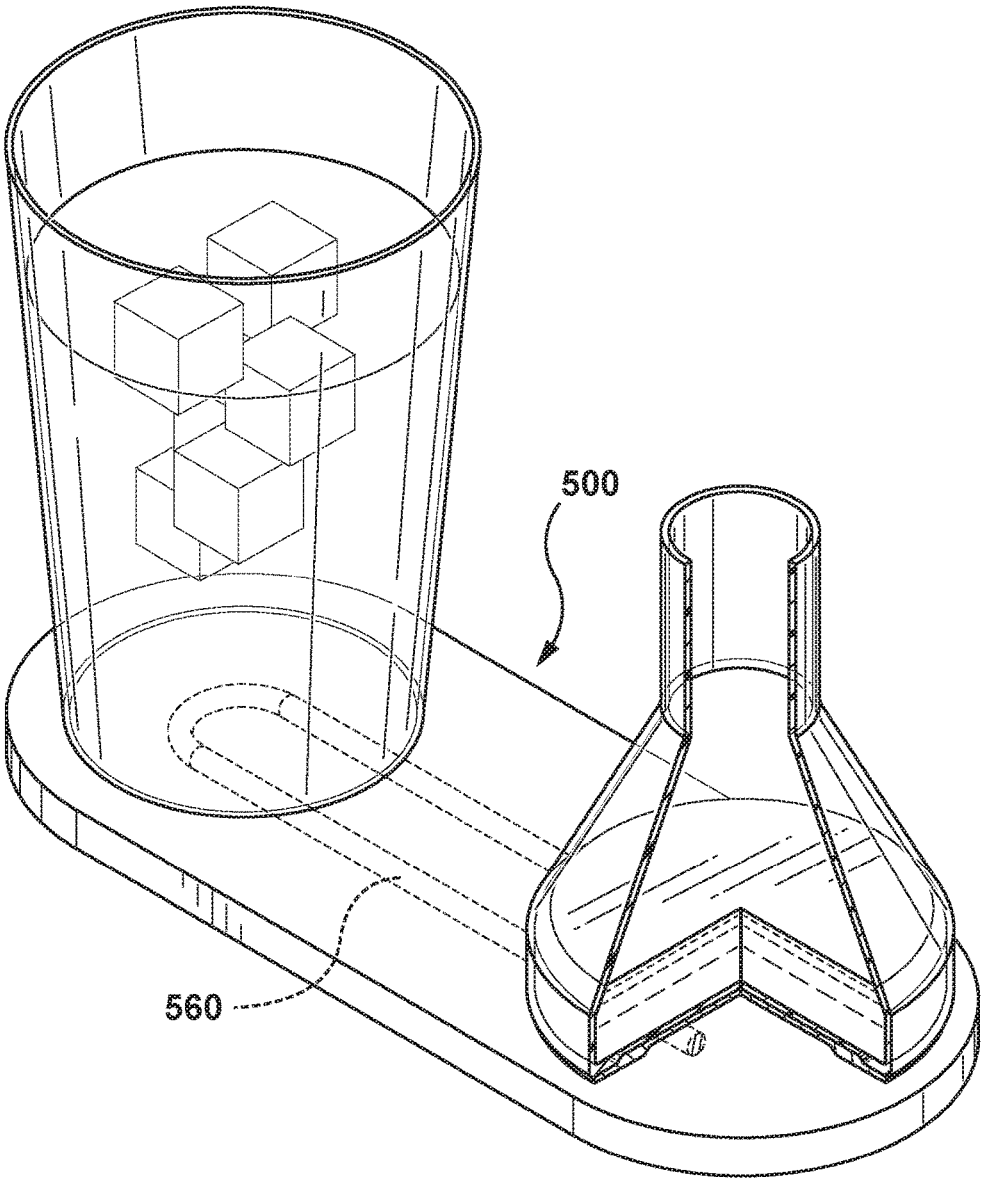
Figure 14:
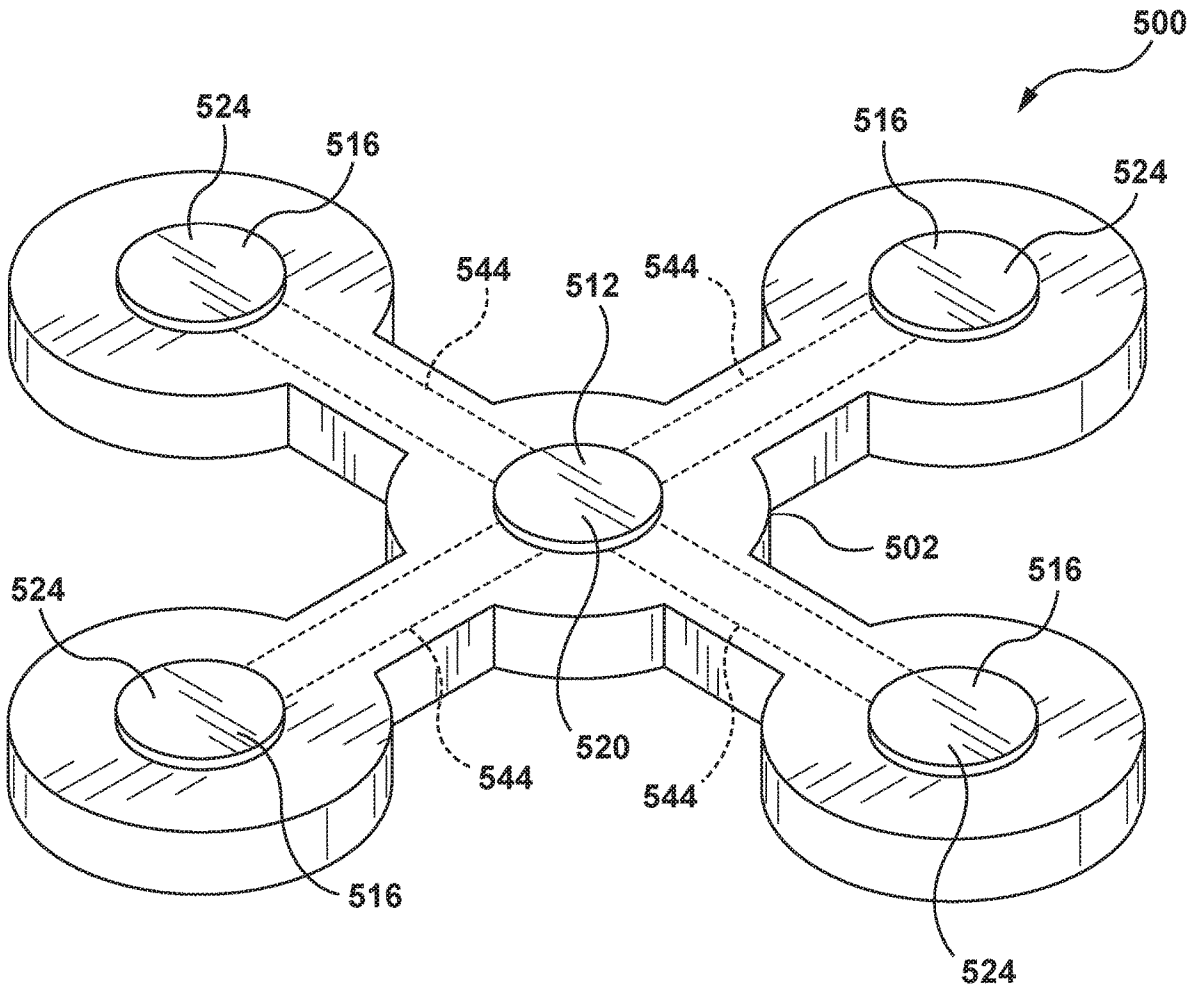
Figure 15:
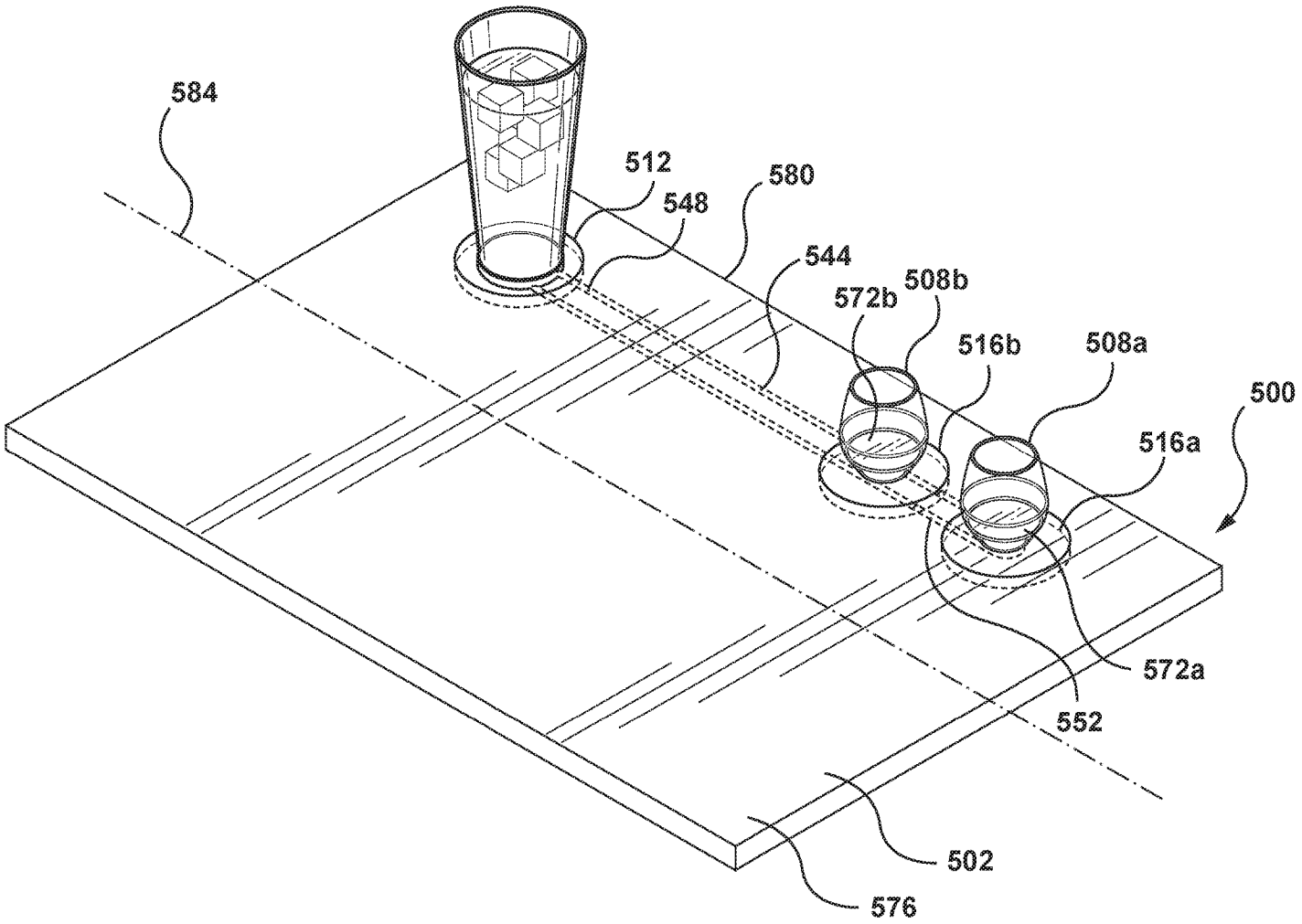
Figure 16:
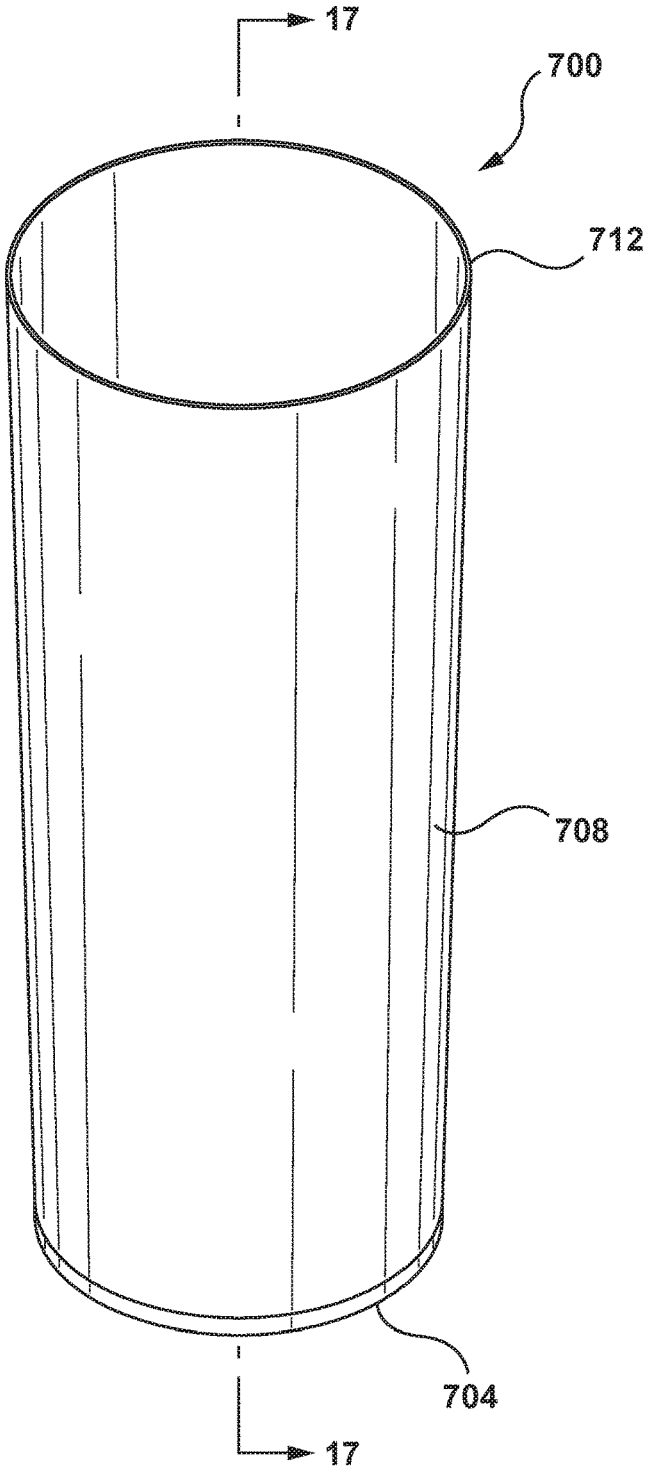
Figure 17:
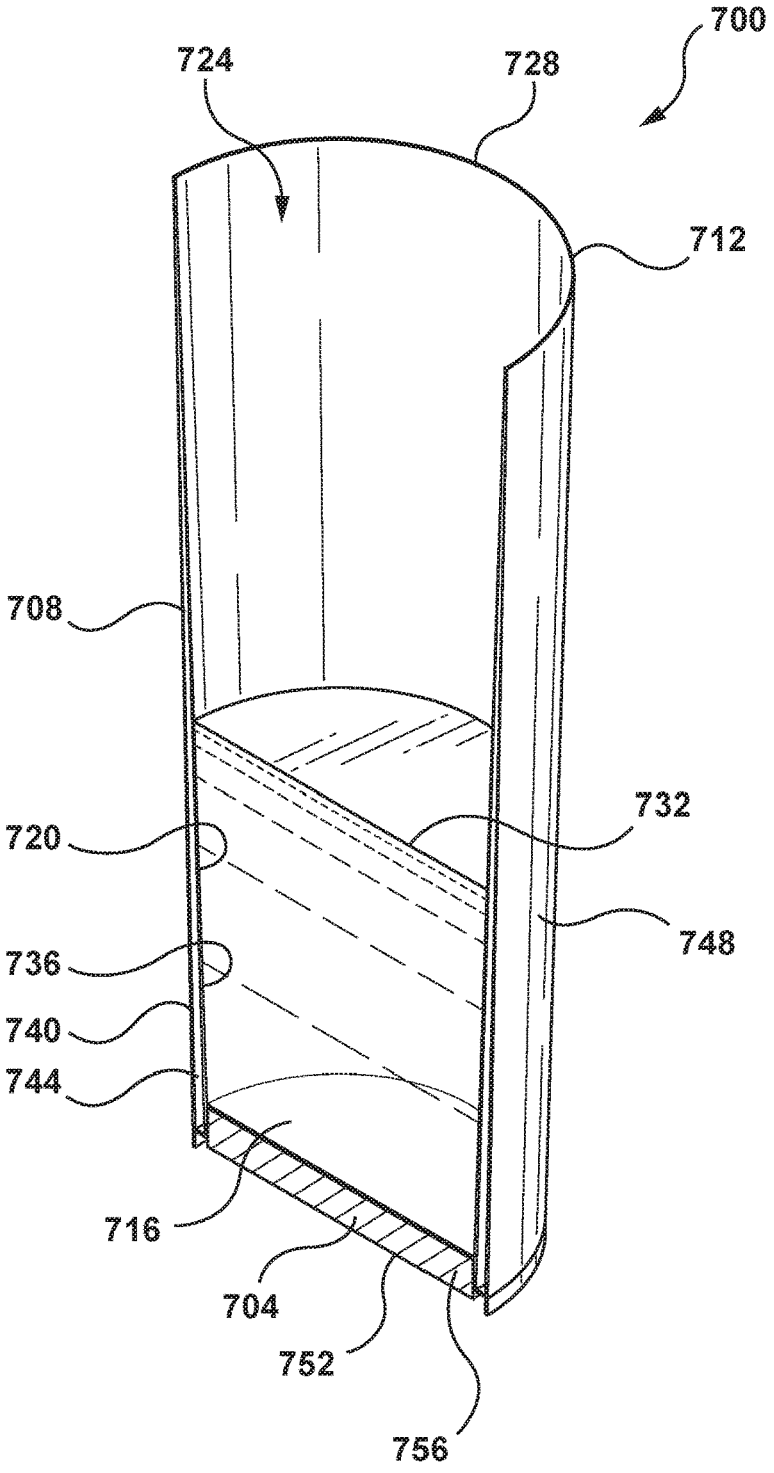
Figure 18:
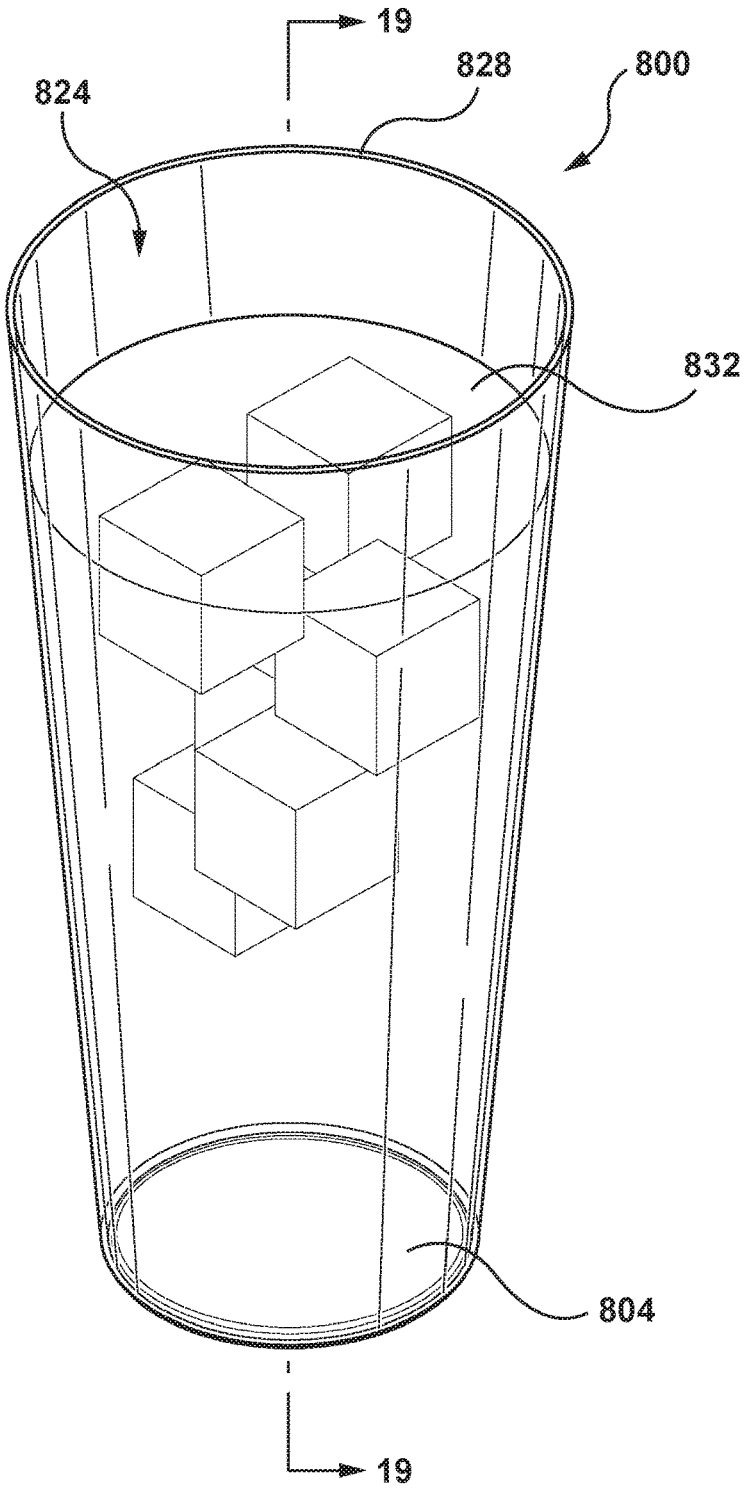
Figure 19:
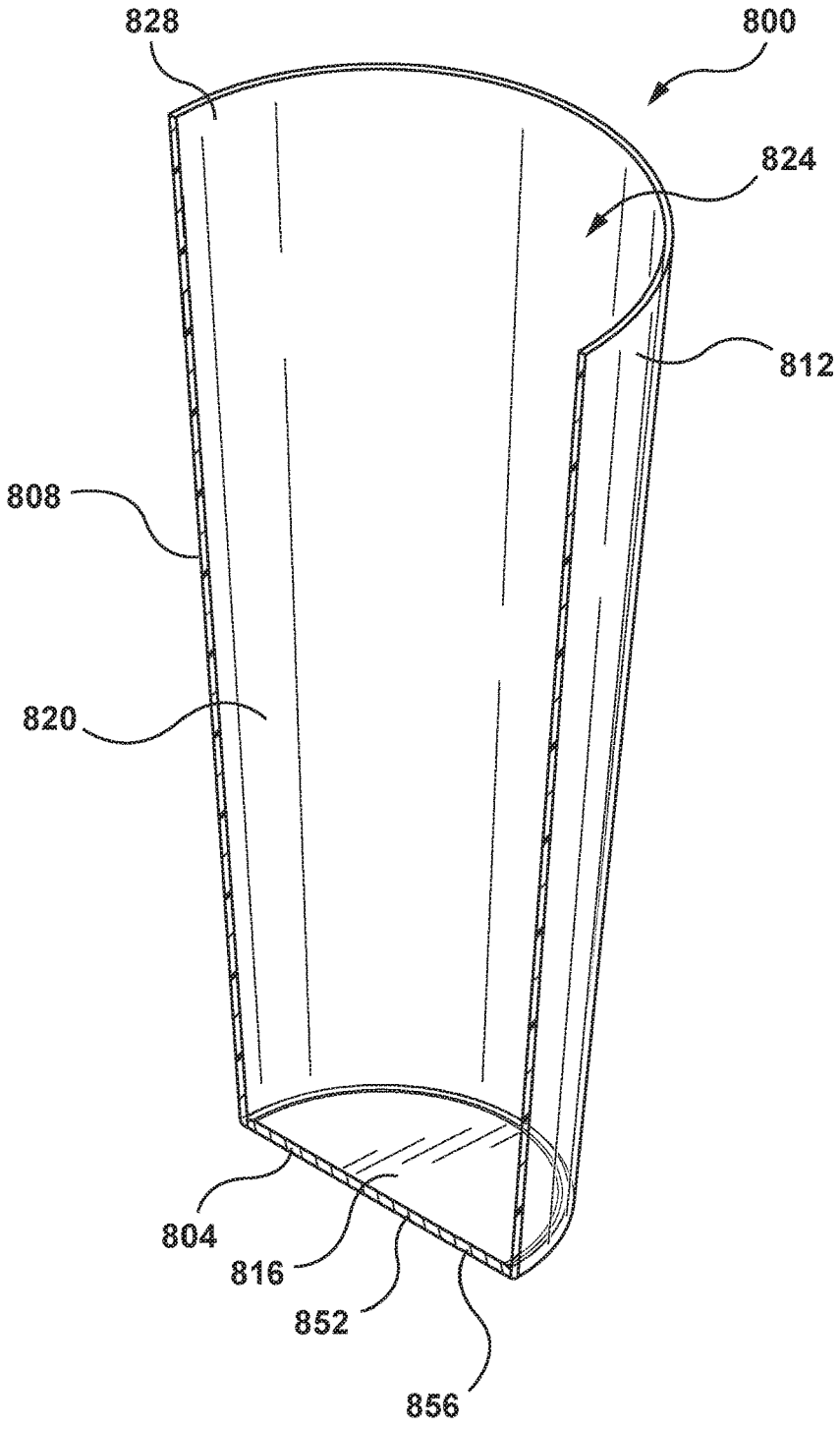
Figure 20:
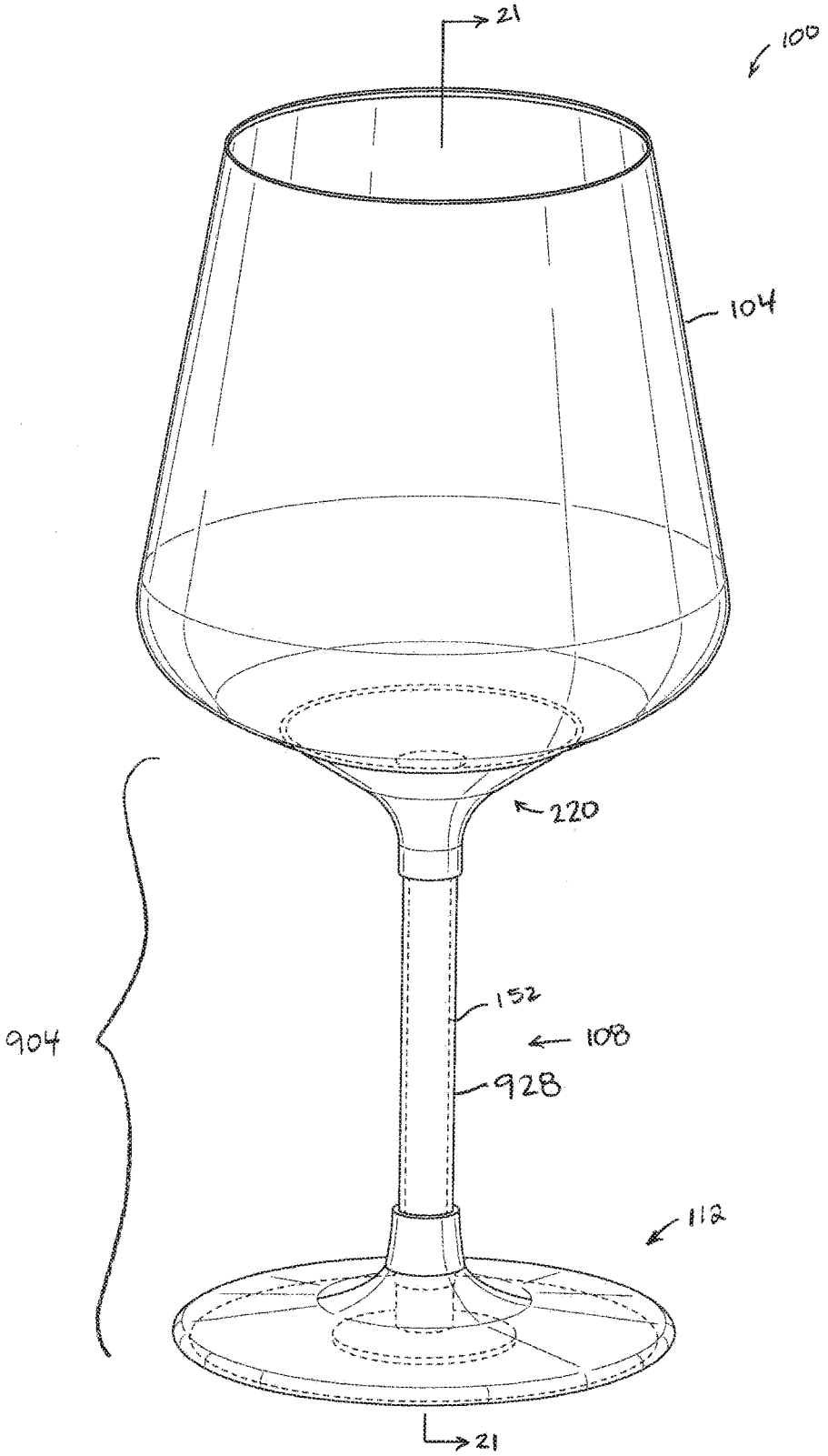
Figure 21:
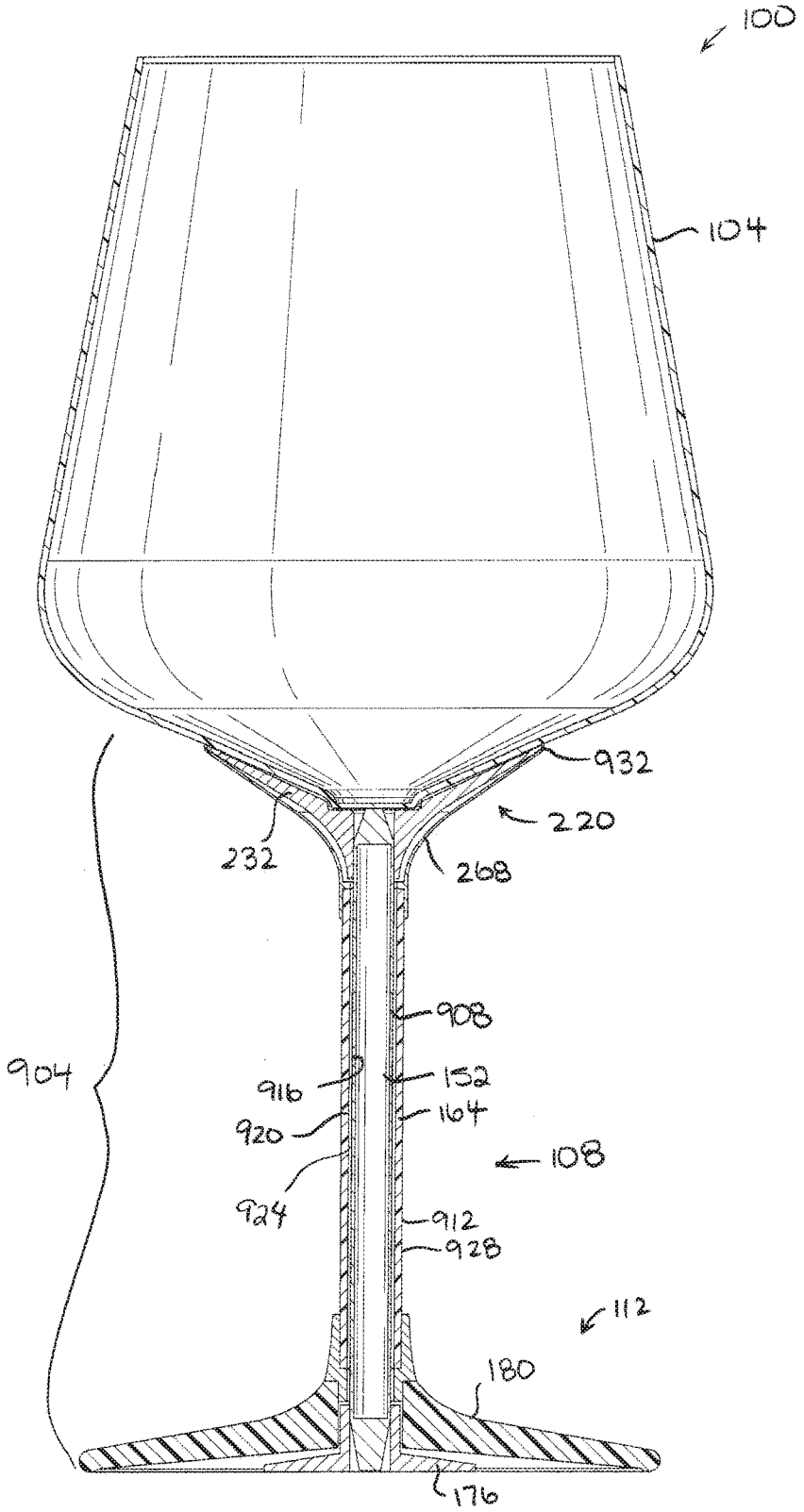
Figure 22A:
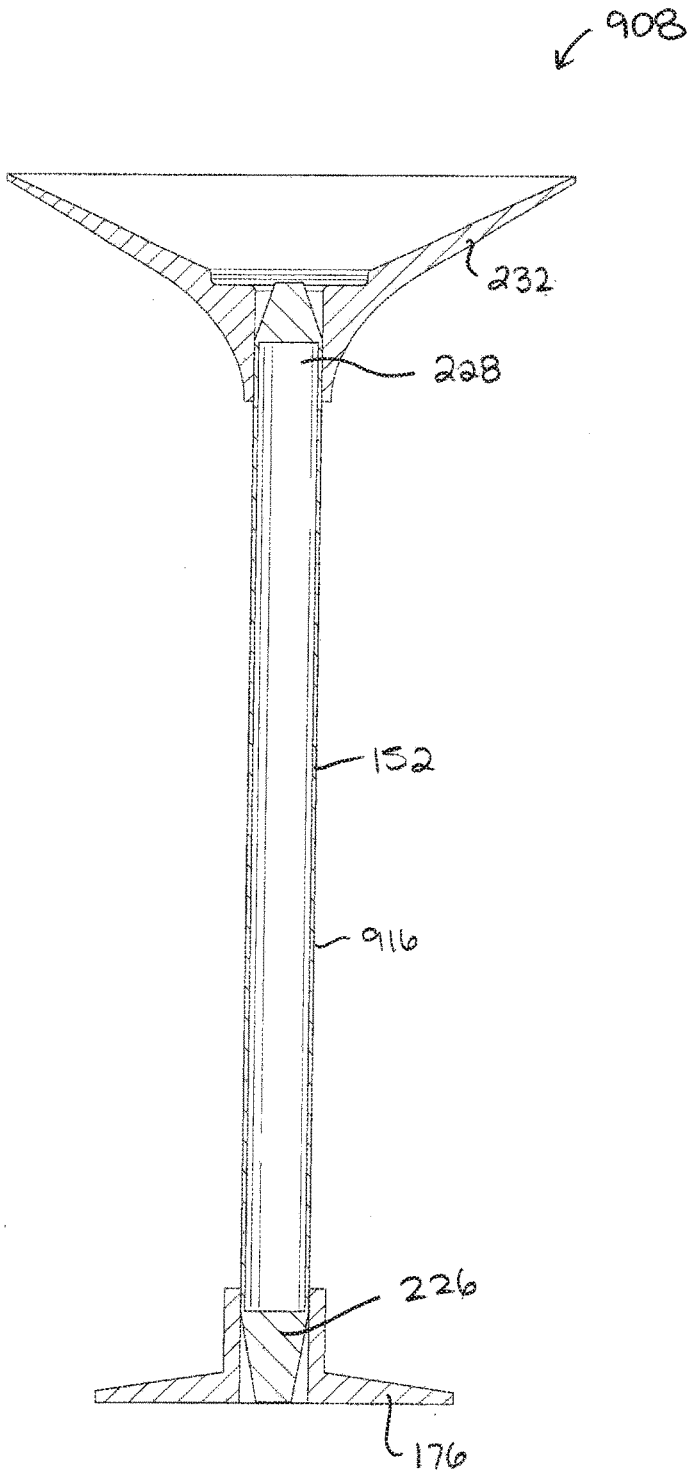
Figure 22B:
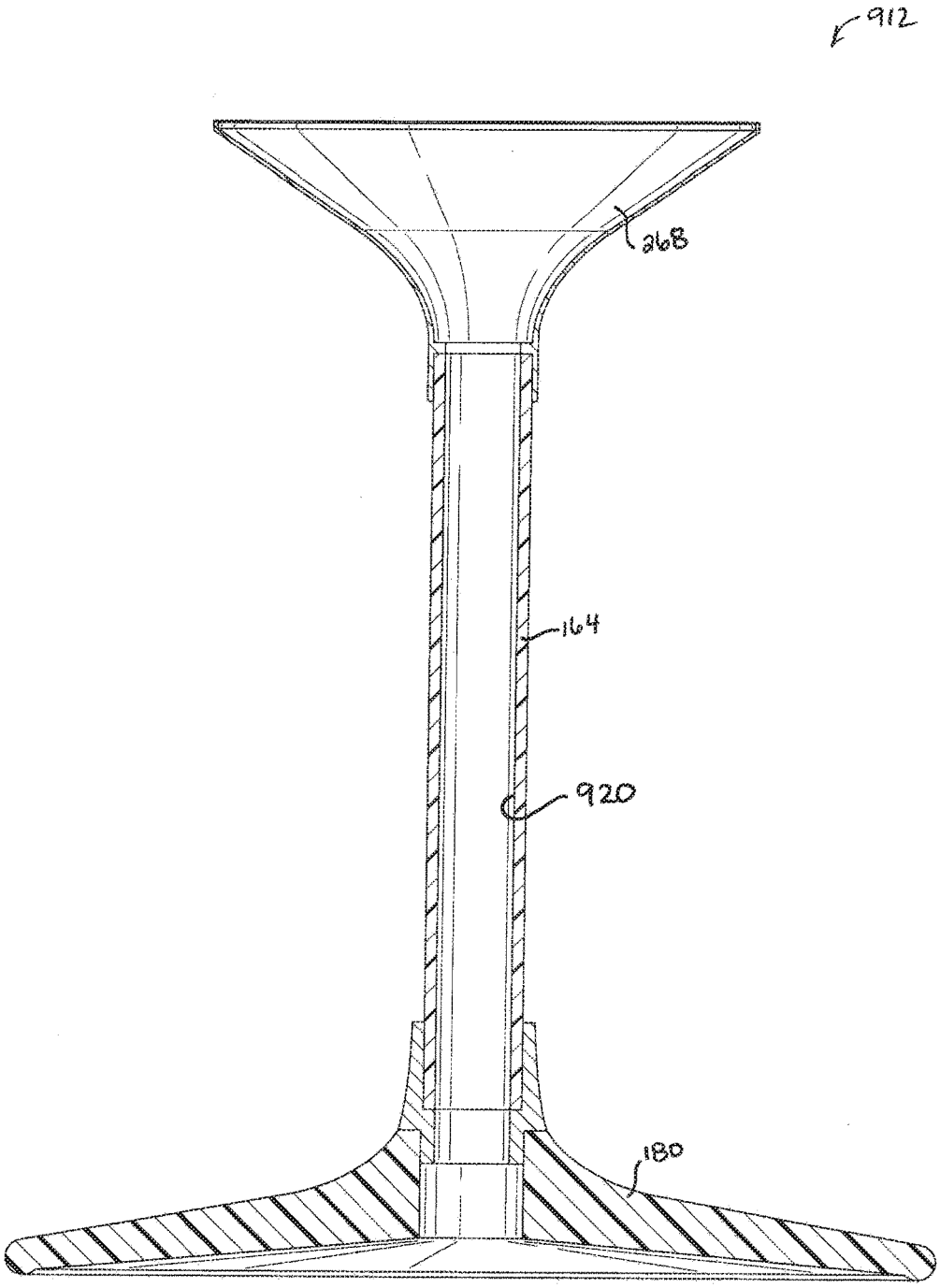
Figure 23:
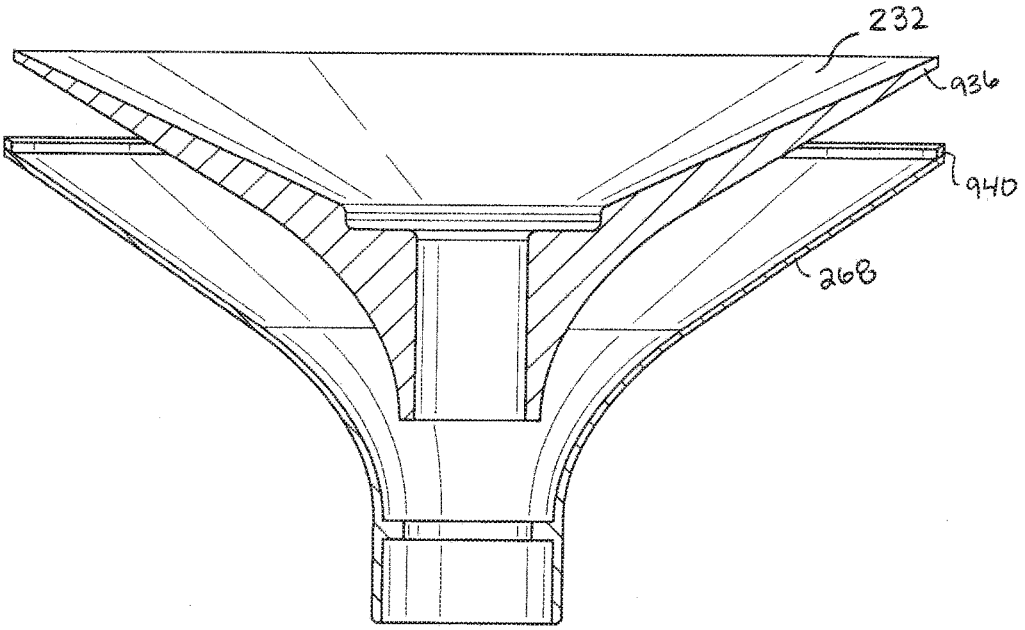
Figure 24:
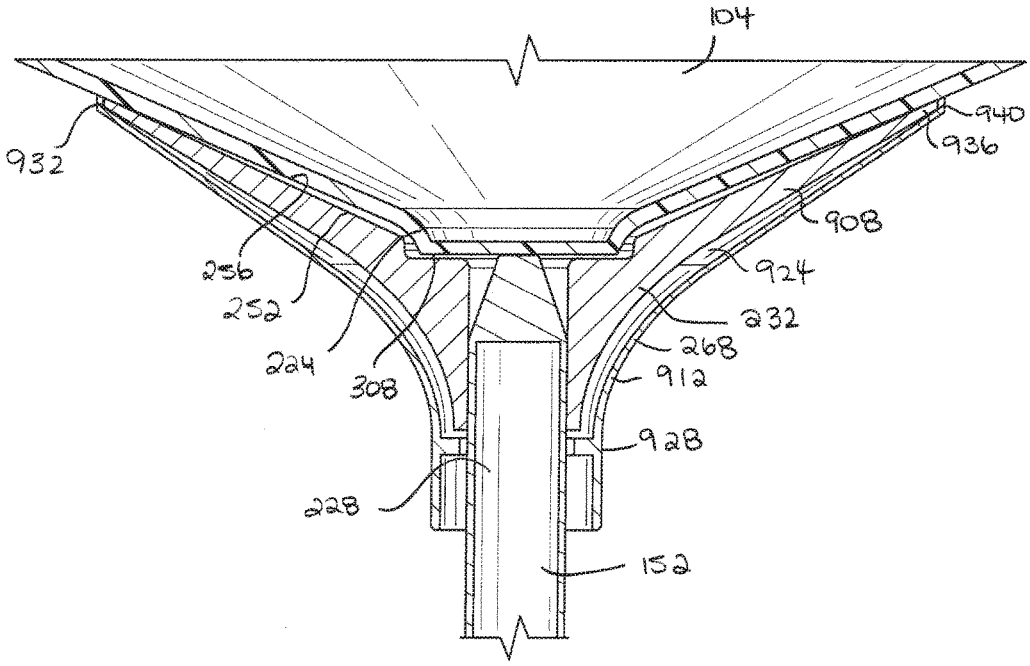
Figure 25:
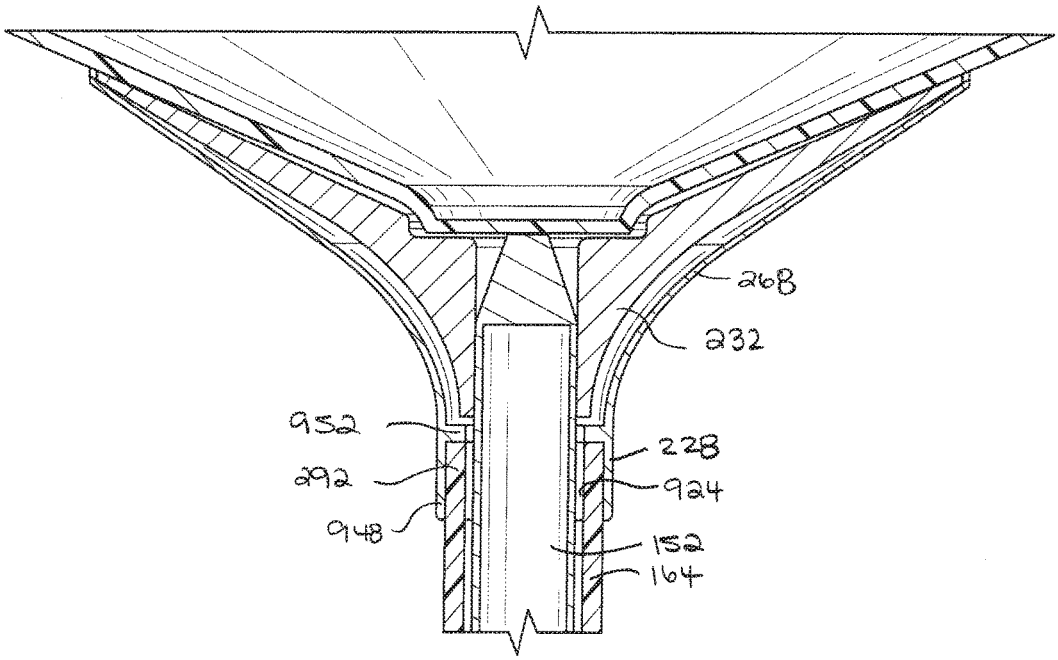
Figure 26:
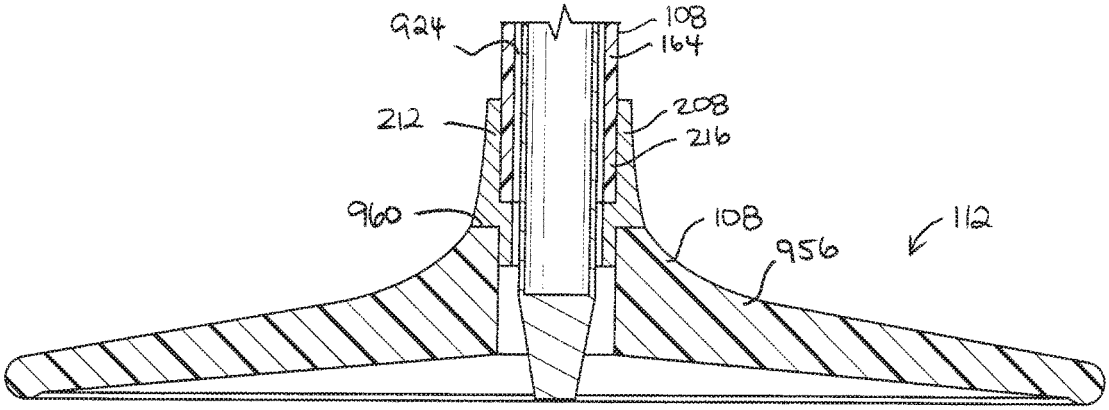
Figure 27:
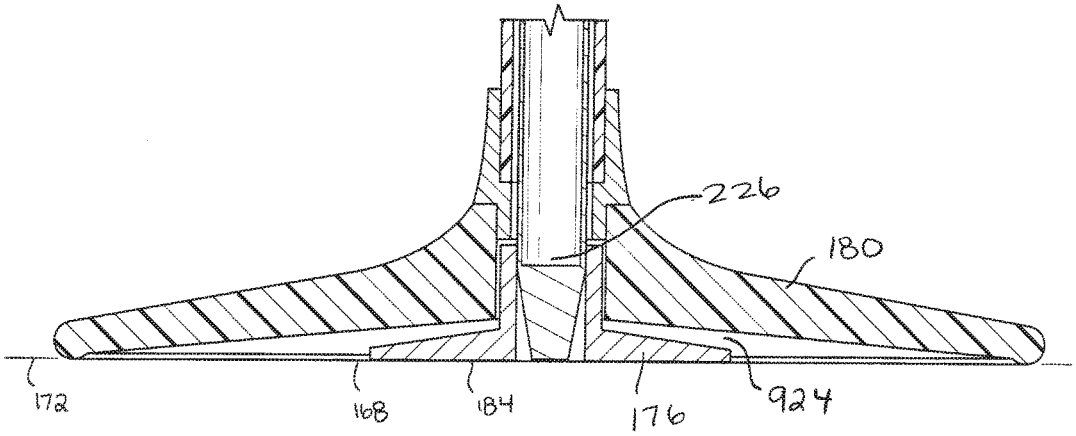
Figure 28:
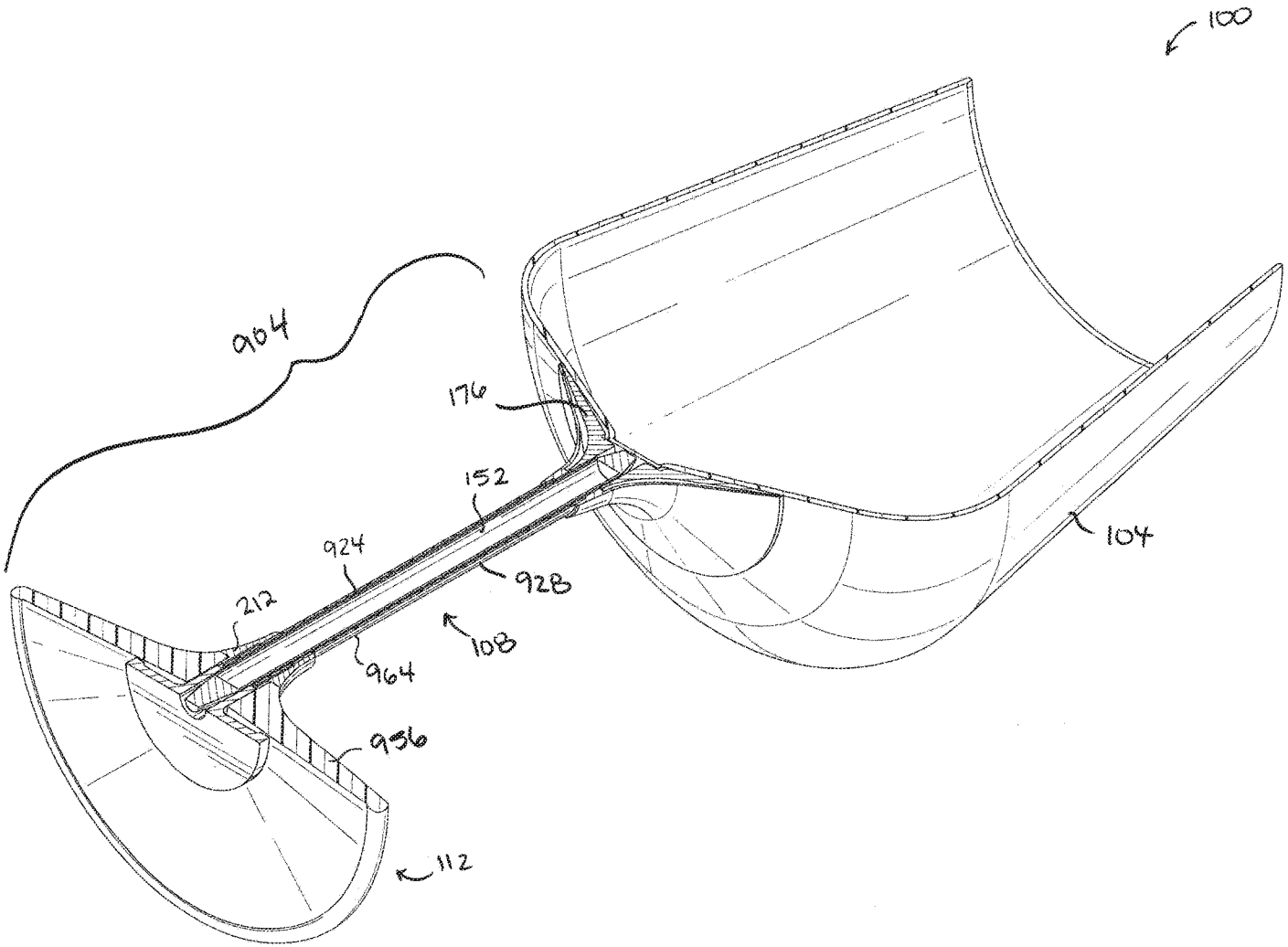
Figure 29:
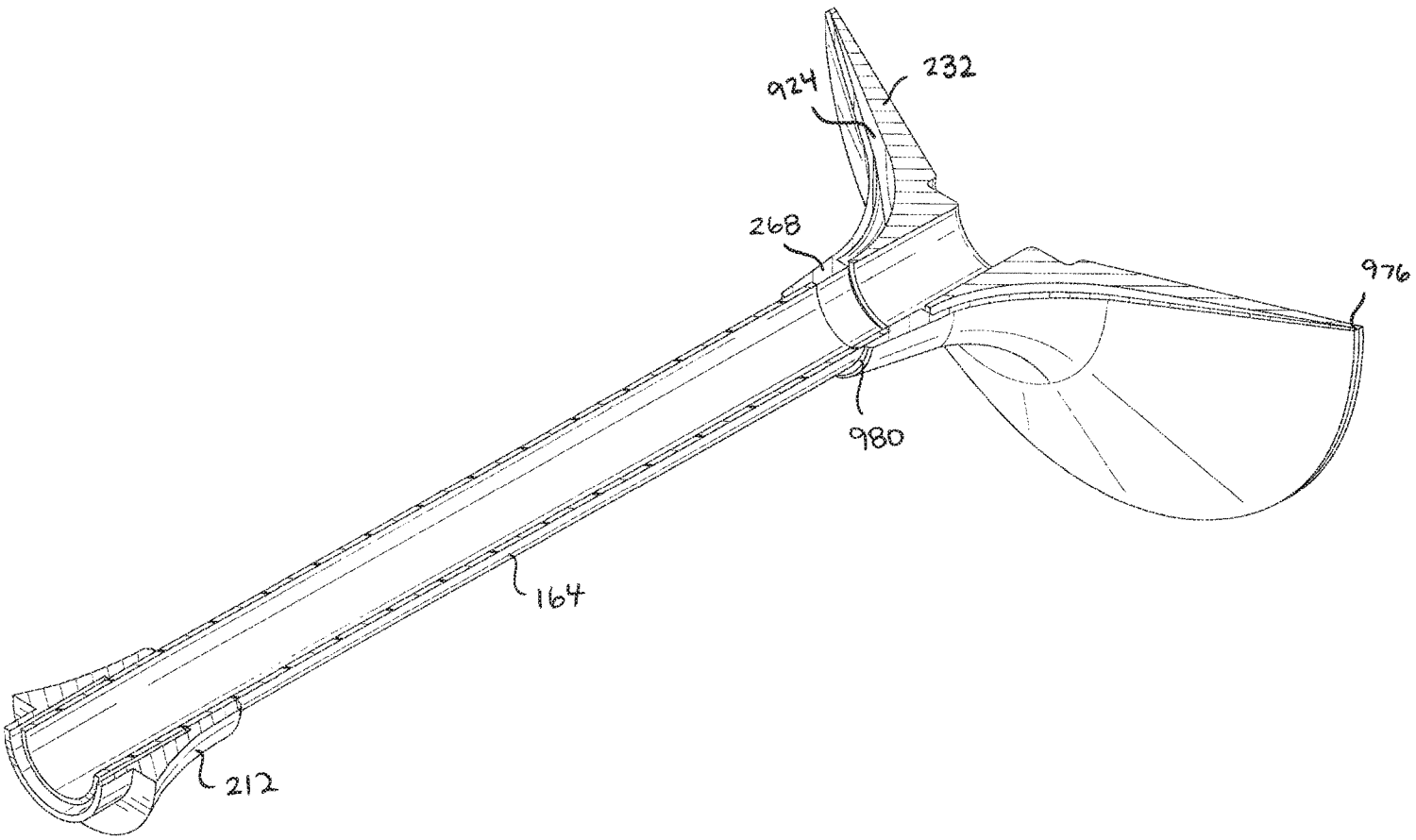
Figure 30:
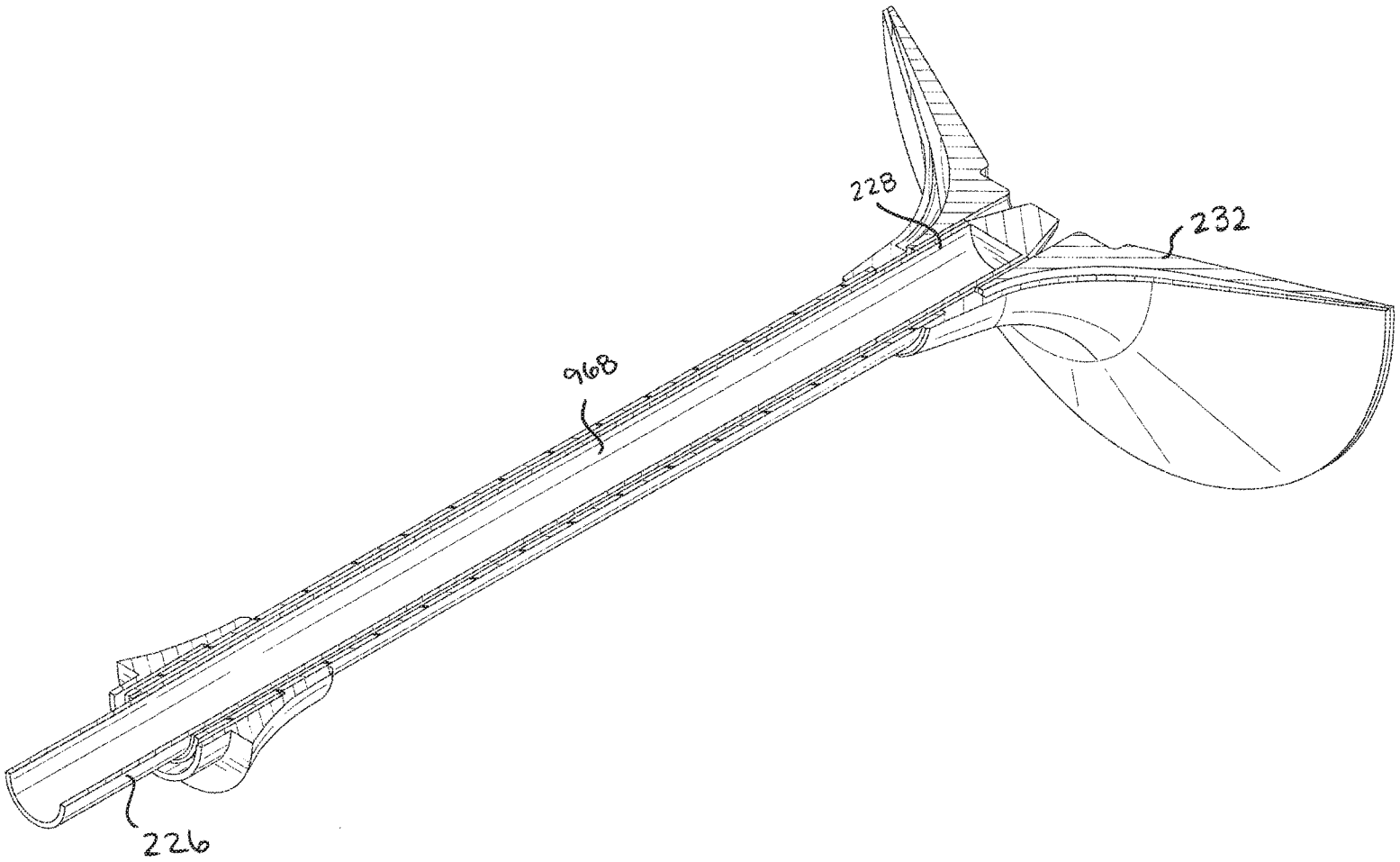
Figure 31:
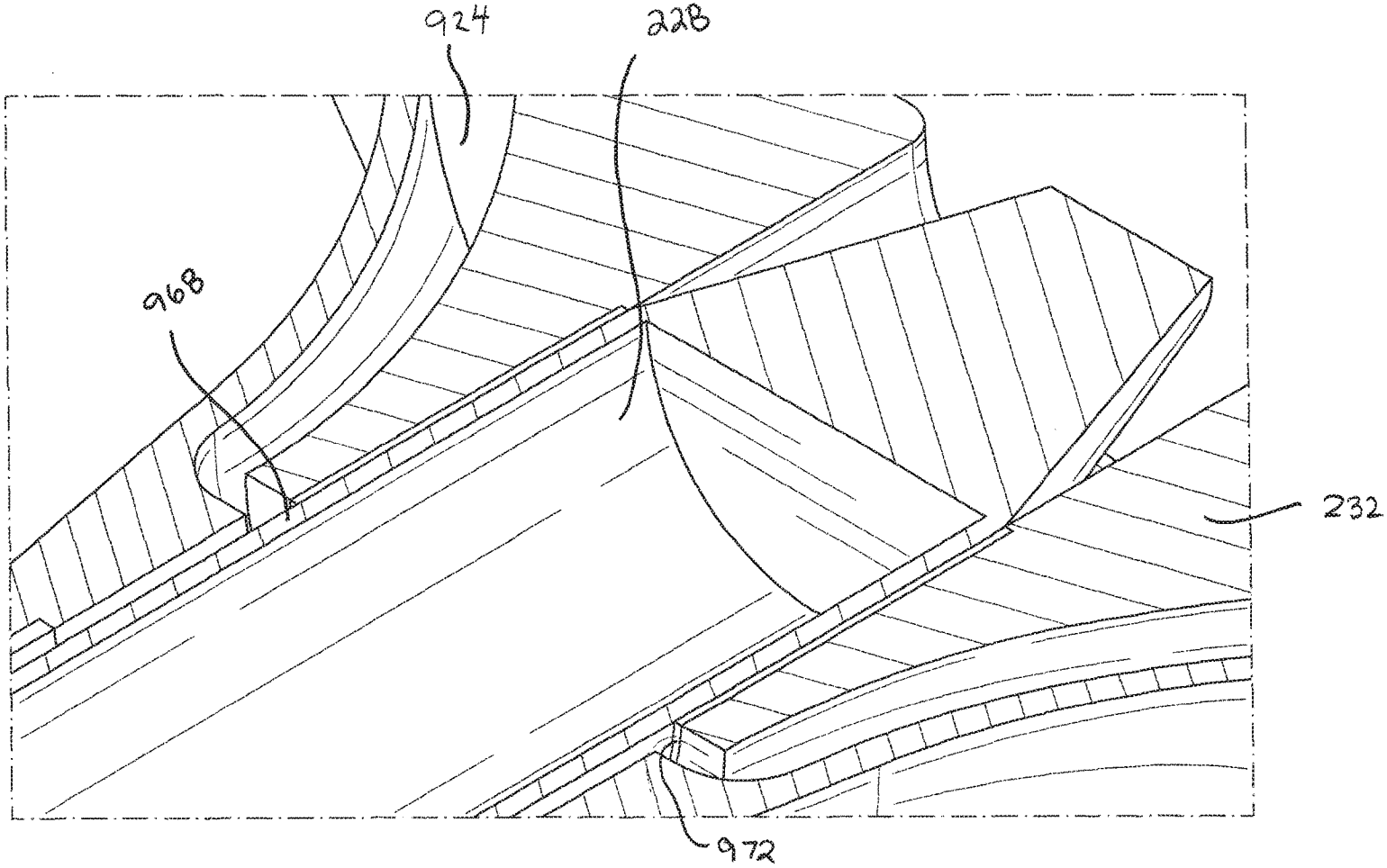
Figure 32:
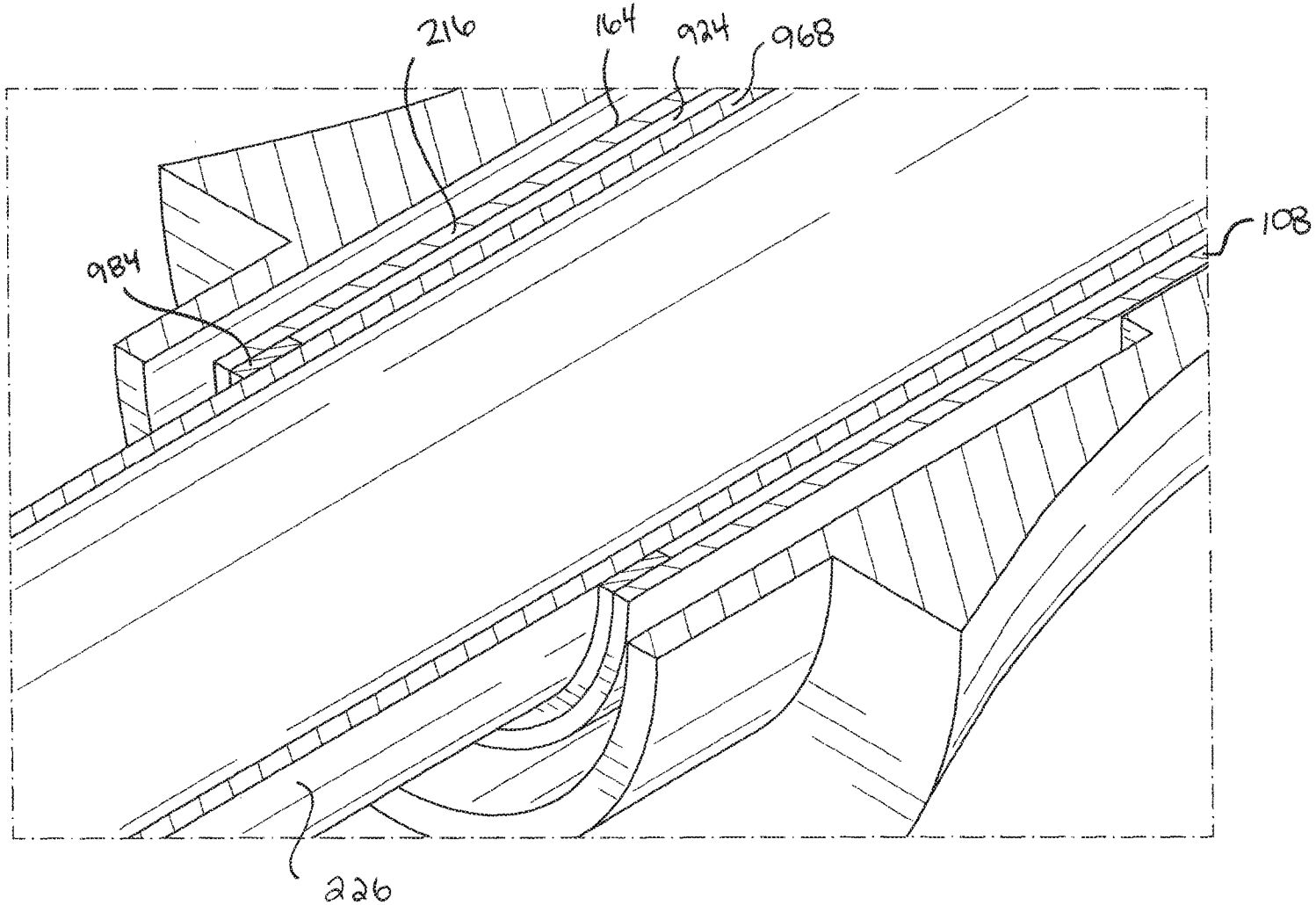
Figure 33:
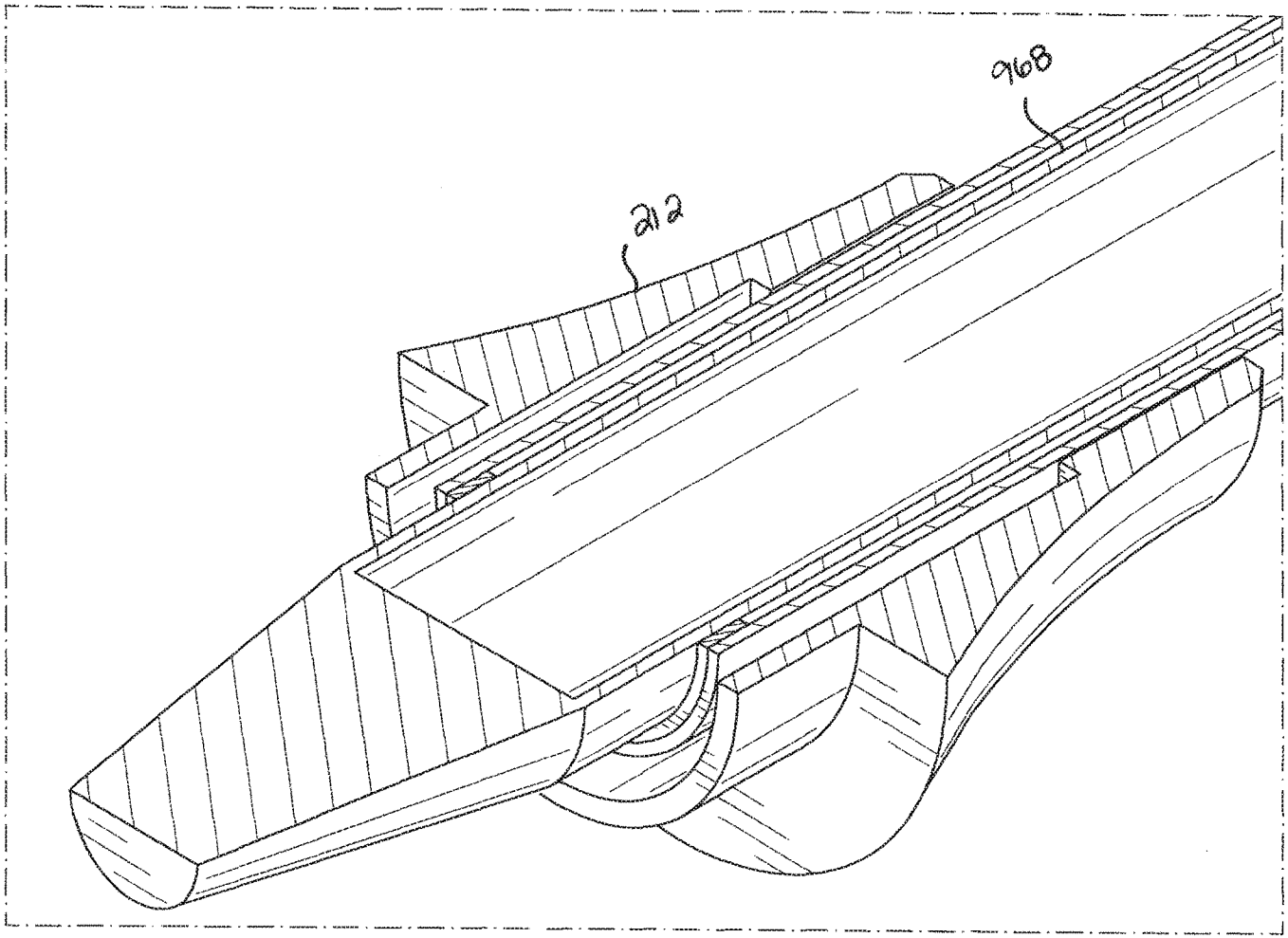
Figure 34:
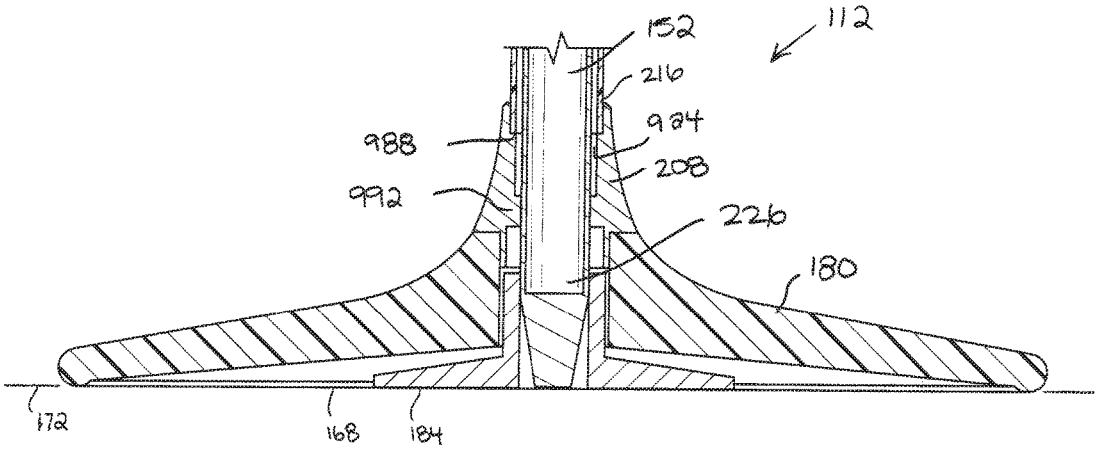
Figure 35:
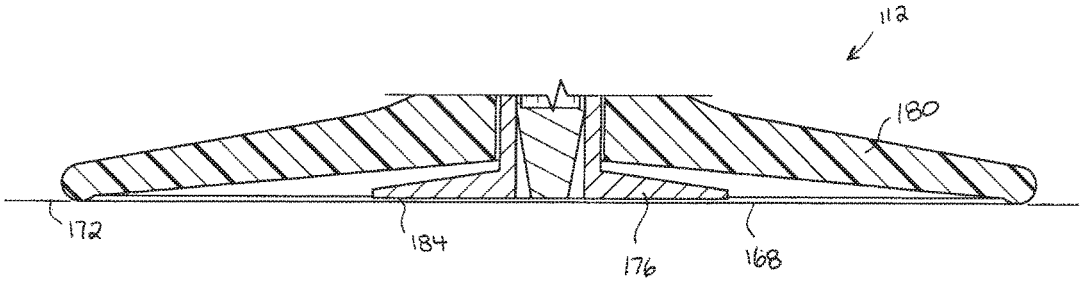
Figure 36:
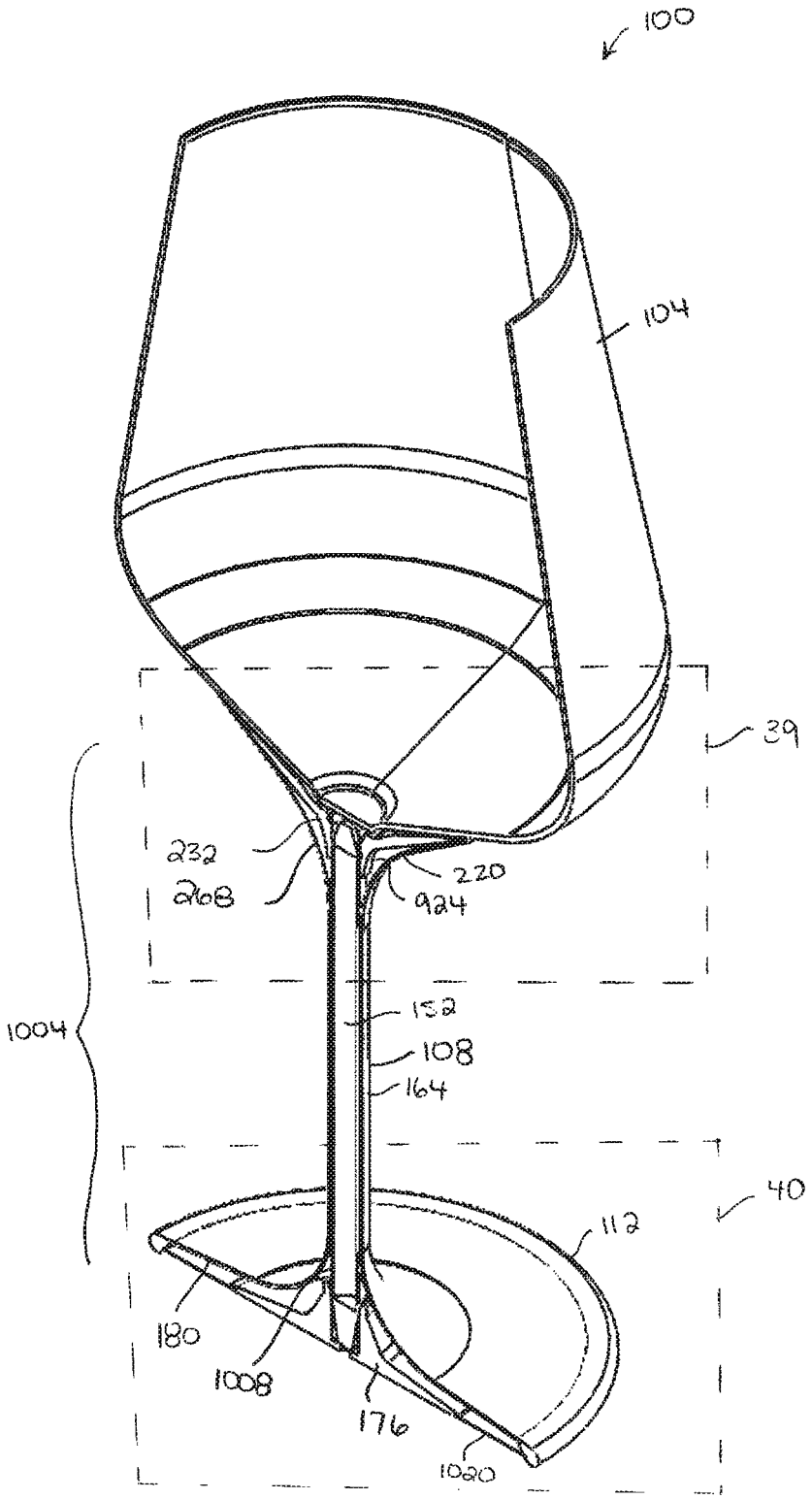
Figure 37:
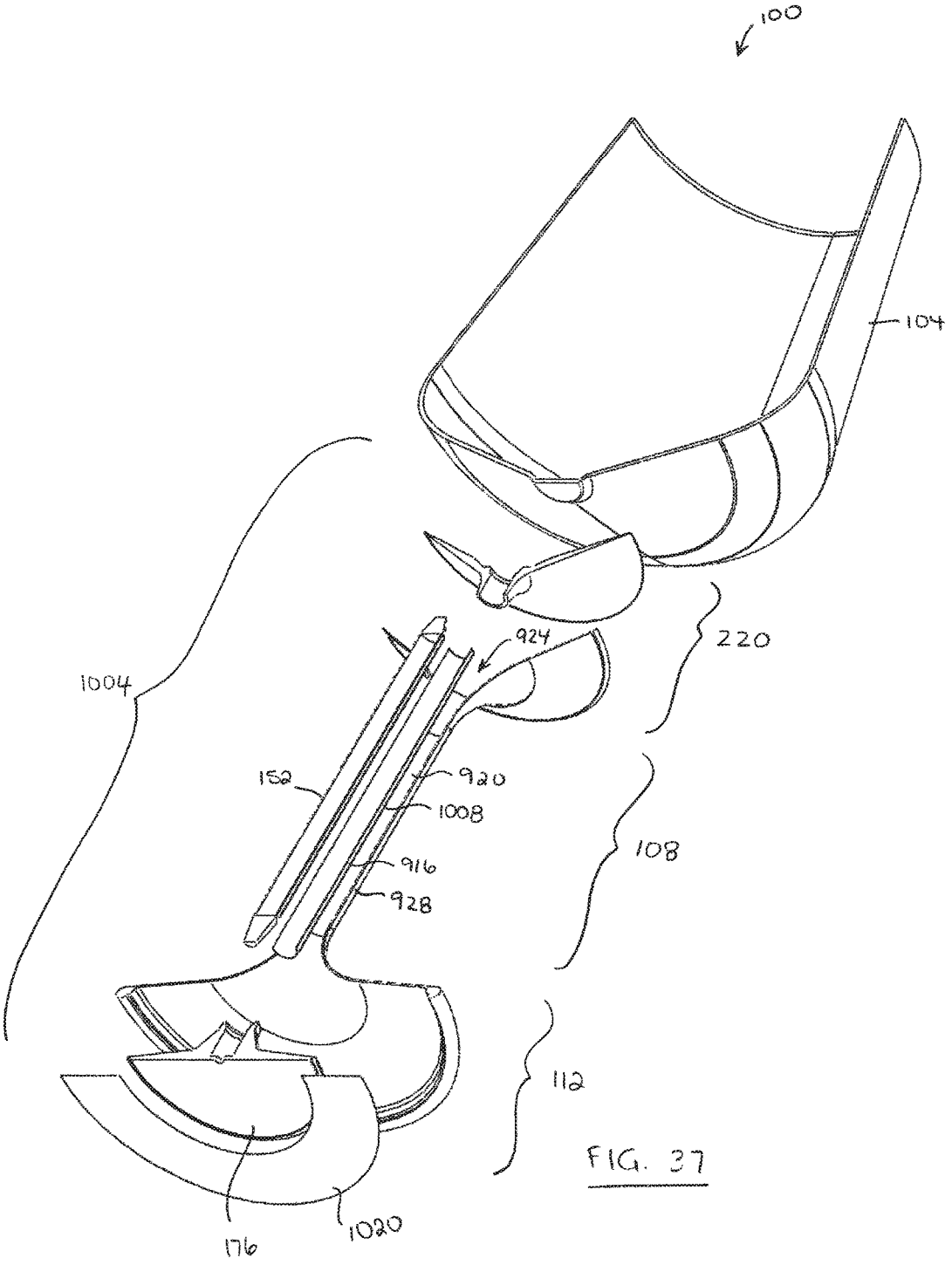
Figure 39:
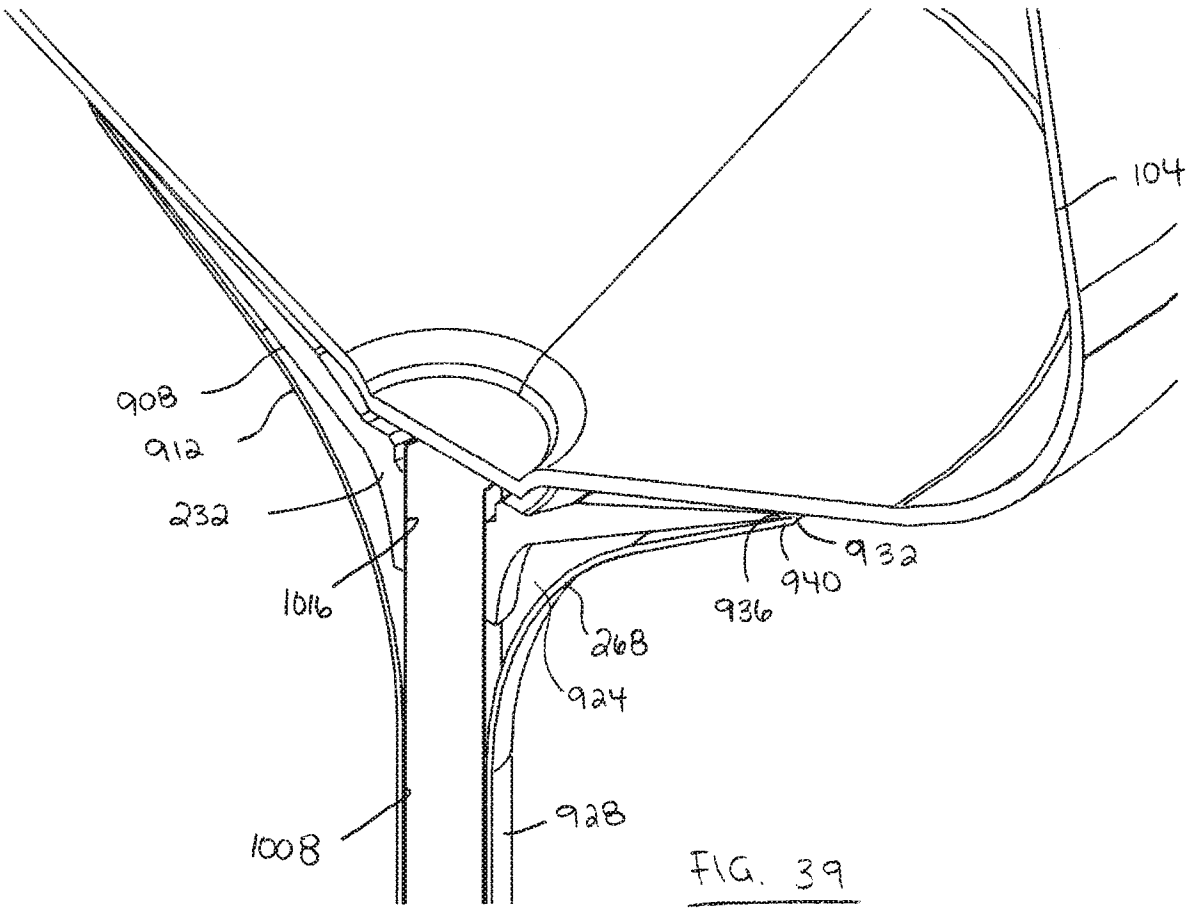
Figure 40:
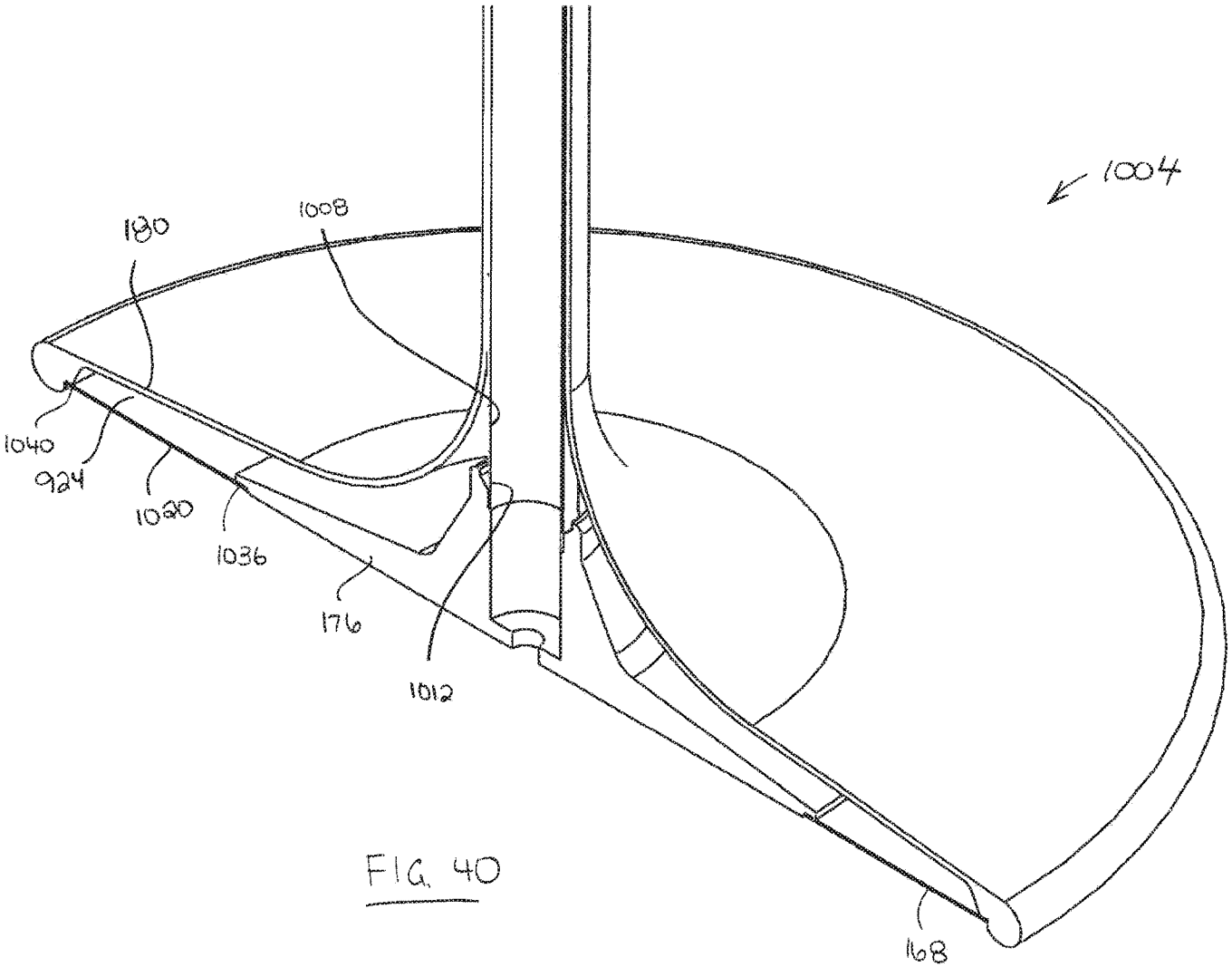
Figure 42:
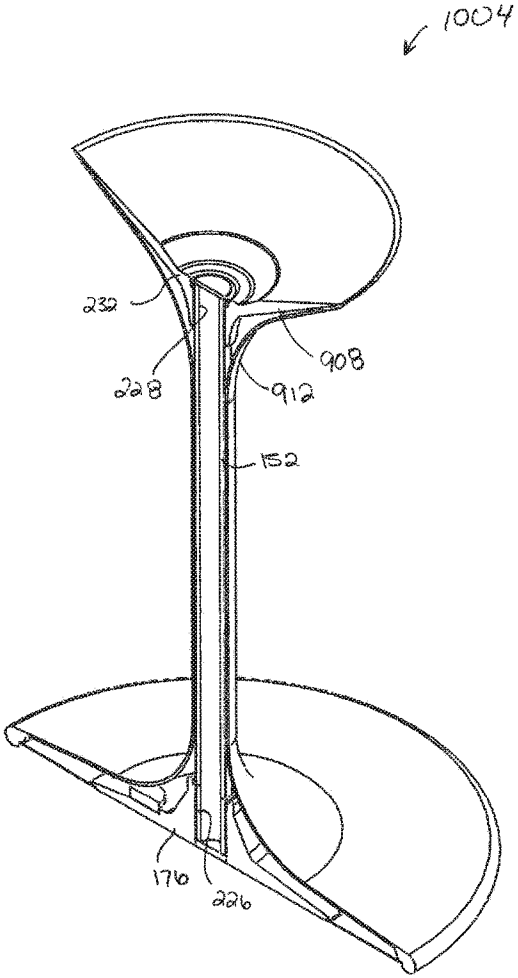
Figure 41:
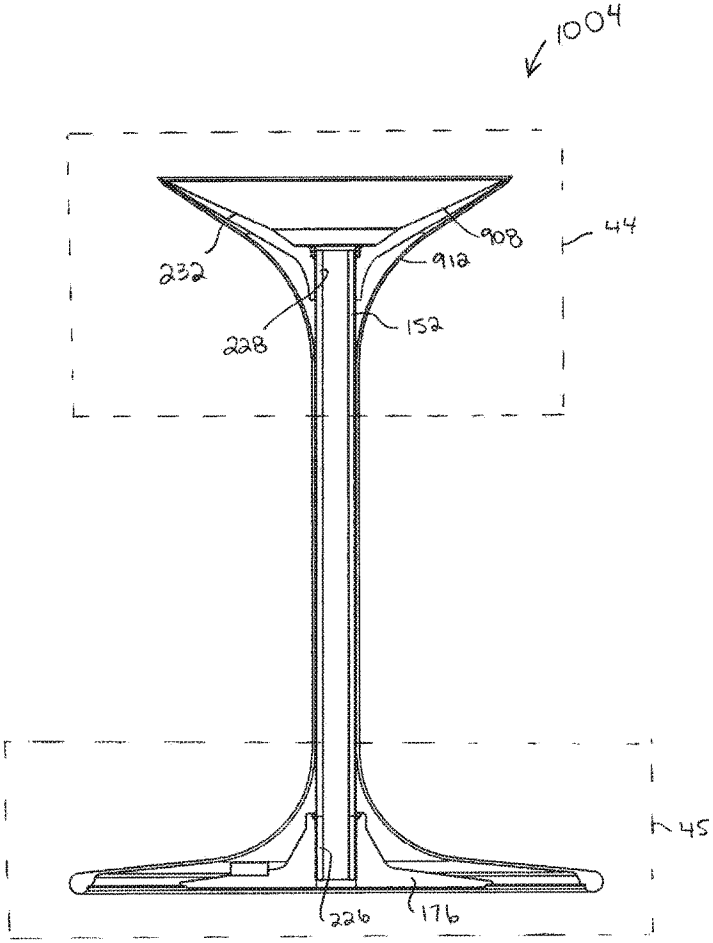
Figure 43:
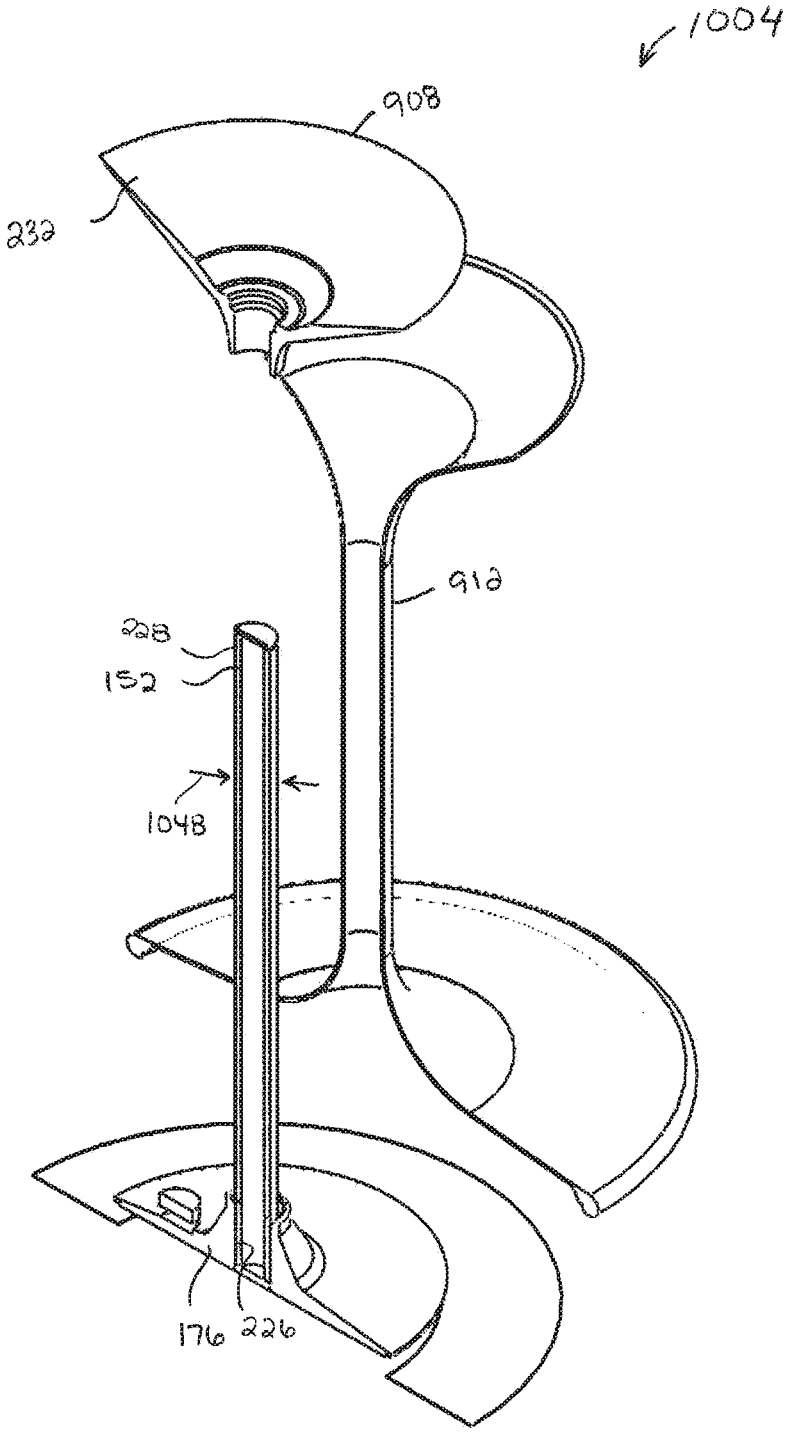
Figure 44:
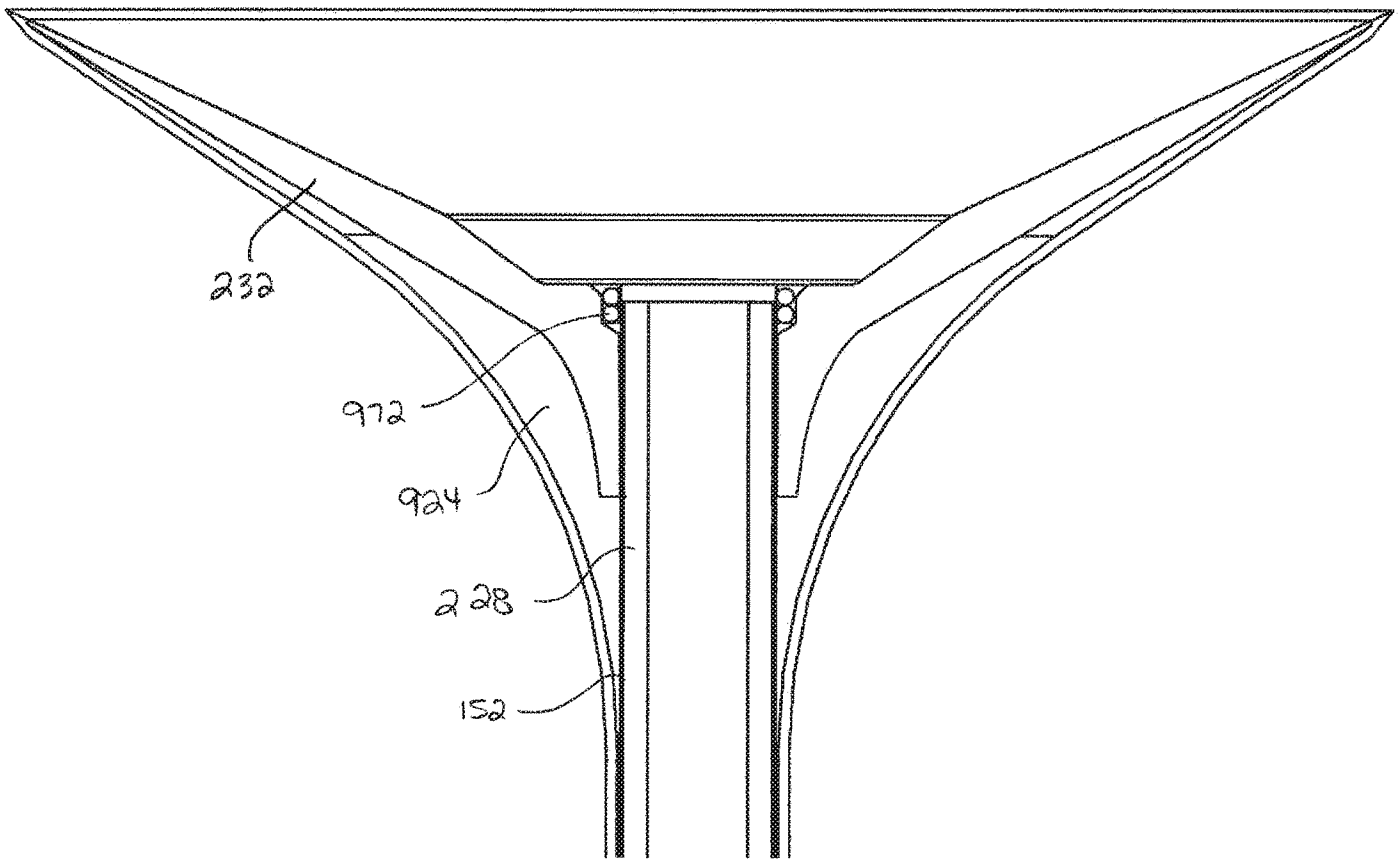

FIGS. 10C-E are cross-sectional views taken along line 10B-10B in FIG. 10A, in accordance with various embodiments;

FIG. 11 is a perspective view of a heat transfer system, in accordance with an embodiment;

FIG. 12 is a cross-sectional view of a heat transfer pad, in accordance with an embodiment;

FIG. 13 is a perspective view of a heat transfer pad including a heat pipe and two beverage containers in accordance with an embodiment;

FIG. 14 is a perspective view of a heat transfer pad including a plurality of second beverage container supports in accordance with an embodiment;

FIG. 15 is a perspective view of a heat transfer pad and three beverage containers in accordance with another embodiment;

FIG. 16 is a perspective view of a beverage container in accordance with another embodiment;

FIG. 17 is a perspective cross-sectional view taken along line 17-17 in FIG. 16;

FIG. 18 is a perspective view of a beverage container in accordance with another embodiment;

FIG. 19 is a perspective cross-sectional view taken along line 19-19 in FIG. 18;

FIG. 20 is a perspective view of a beverage container in accordance with another embodiment;

FIG. 21 is a cross-sectional view taken along line 21-21 in FIG. 20;

FIG. 22A is a cross-sectional view of an inner subassembly of the beverage container of FIG. 20;

FIG. 22B is a cross-sectional view of an outer subassembly of the beverage container of FIG. 20;

FIG. 23 is a cross-sectional view of a fastener inner portion and a fastener outer portion;

FIG. 24 is a partial cross-sectional view of a fastener connected to a bowl and a heat pipe;

FIG. 25 is a partial cross-sectional view of a fastener connected to a bowl, a heat pipe, and a stem sleeve;

FIG. 26 is a partial cross-sectional view of a base outer element connected to a stem;

FIG. 27 is a partial cross-sectional view of a base connected to a stem;

FIG. 28 is a cross-sectional view of a beverage container in accordance with another embodiment;

FIG. 29 is a cross-sectional view of a base collar, stem sleeve, and a fastener;

FIG. 30 is a cross-sectional view of a base collar, stem sleeve, heat pipe shell, and a fastener;

FIG. 31 is a partial cross-sectional view of a heat pipe shell connected to a fastener;

FIG. 32 is a partial cross-sectional view of a heat pipe shell connected to a stem sleeve lower end;

FIG. 33 is a partial cross-sectional view of a heat pipe connected to a stem sleeve lower end;

FIG. 34 is a partial cross-sectional view of a stem connected to a base; and FIG. 35 is a partial cross-sectional view of a stem connected to a base in accordance with another embodiment;

FIG. 36 is a cross-sectional view of a beverage container in accordance with another embodiment;

FIG. 37 is an exploded cross-sectional view of the beverage container of FIG. 36;

FIGS. 38A-38E illustrate steps in a method of making the beverage container of FIG. 36;

FIG. 39 is an enlarged view of region 39 in FIG. 36;

FIG. 40 is an enlarged view of region 40 in FIG. 36;

FIG. 41 is a cross-sectional side elevation view of a support assembly in accordance with another embodiment;

FIG. 42 is a cross-sectional perspective view of the support assembly of FIG. 41;

FIG. 43 is an exploded view of the cross-section of FIG. 42;

FIG. 44 is an enlarged view of region 44 in FIG. 41; and

Figure 45:
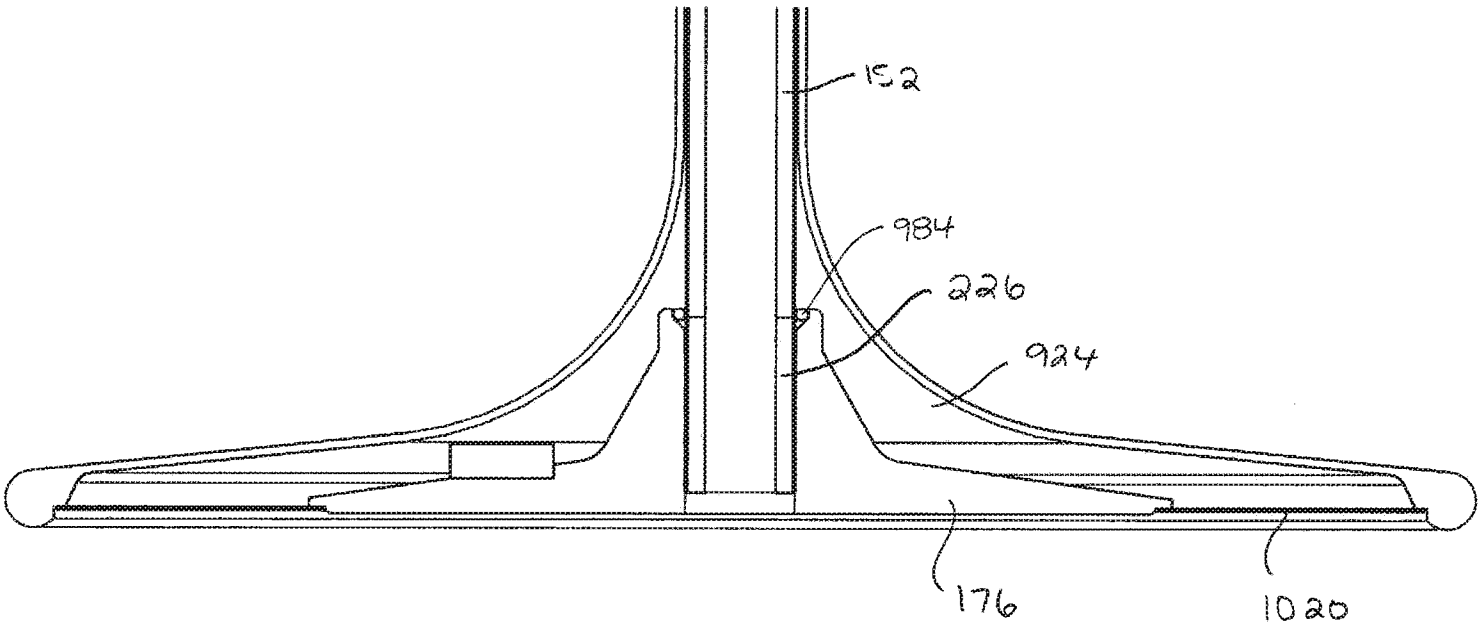

FIG. 45 is an enlarged view of region 45 in FIG. 41.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

As used herein and in the claims, a first element is said to be "received" in a second element where at least a portion of the first element is received in the second element unless specifically stated otherwise.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

Figure 1:
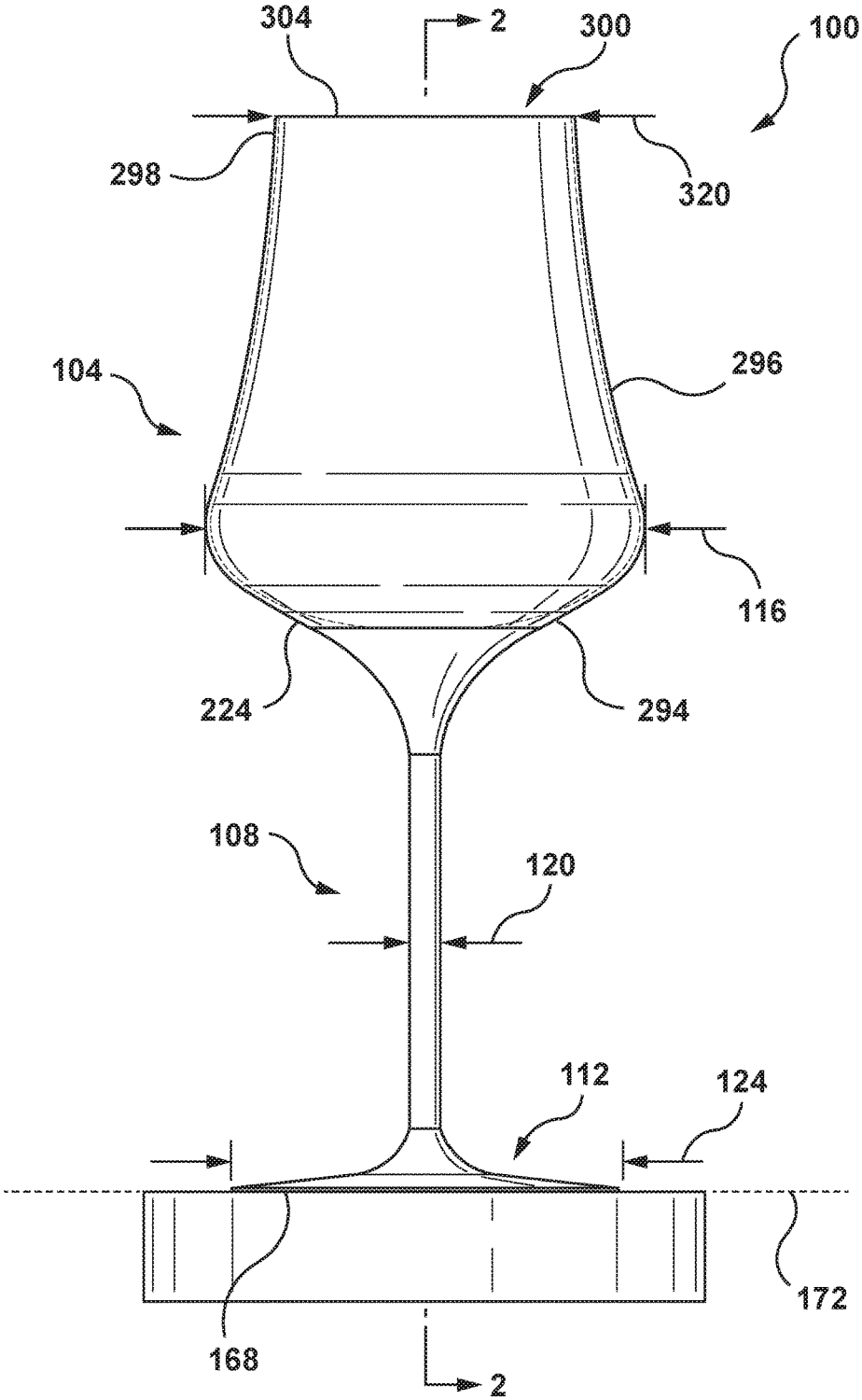
FIG. 1 is a side elevation view of a beverage container on a heat sink, in accordance with an embodiment.

Referring to FIG. 1, a beverage container 100 is shown in accordance with an embodiment. As shown, beverage container 100 includes a bowl 104, a stem 108, and a base 112. Bowl 104 is connected to base 112 by stem 108. Bowl 104 has a bowl diameter 116, stem 108 has a stem diameter 120, and base 112 has a base diameter 124. Stem diameter 120 is less than each of the bowl diameter 116 and base diameter 124. As used herein and in the claims, a "diameter" does not imply a circular shape. Instead, a "diameter" is a linear measurement of width. For example, each of diameters 116, 120, and 124 may be the greatest width of the bowl, stem, or base respectively measured in a horizontal plane. A diameter may be a horizontal or lateral dimension.

Most beverages have a suggested temperature (or temperature range) at which the qualities of the beverage are best for consumption. For example, it is widely accepted that different wine varieties are best served at different temperatures, and that no wine variety is best served at modern day room temperature (e.g. 20° C.). Table 1 below lists exemplary optimal drinking temperatures for a selection of wine varieties.

TABLE 1

| Color | Suggested Drinking Temperature ° C. | Varieties |
|---|---|---|
| RED | 19 | Vinage Port |
| | 18 | Bordeaux, Shiraz |
| | 17 | Red Burgundy, Cabernet |
| | 16 | Rioja, Pinot Noir |
| | 15 | Chianti, Zifandel |
| | 14 | Tawny/NV Port, Madeira |
| | 12 | Beaujolais, Rose |
| WHITE | 11 | Viognier, Sauternes |
| | 9 | Chardonnay |
| | 8 | Riesling |
| | 7 | Champagne, Sparkline Wine |
| | 6 | Ice Wines |
| | 5 | Asti Spumanti |

As shown in Table 1, the suggested drinking temperature of white wines is generally less than that of red wines, and within each color of wine there are several different suggested drinking temperatures for different wine varieties depending on acidity, sweetness, astringency, level of alcohol, and level of tannins among other factors. Similarly, beers and many other types of beverages have varietal-specific suggested drinking temperatures.

Maintaining beverages near their suggested drinking temperature before and during consumption is problematic. A glass of wine or beer is typically consumed over a period of 20 minutes or more, and during that period the beverage temperature can rise well above suggested drinking temperature. In this case, the later portions of the beverage consumed may have a less than optimal, or if the temperature is high enough, a displeasing or even offensive taste. A tragic fate for a beverage that was pleasurable to drink at the suggested drinking temperature. In the context of beverage service establishments (e.g. restaurants, lounges, and bars), the displeasing final portion of a beverage can overshadow the delicious flavor of that beverage experienced when first served. This can dissuade a customer from ordering additional beverages.

Modern glassware designs attempt to promote the consumption of beverages at their suggested drinking temperature. A stem may be provided between the base and bowl as a place to hold the glass without significantly warming the beverage. The small diameter of the stem slows the conduction of heat to the bowl. The stem also provides a balanced position to hold the glass when swirling to promote beverage aeration and release of aromas.

Although a thin stem is helpful for mitigating heat transfer from a user's hands to the beverage, heating from the ambient environment persists. The bowl receives convective heat from the ambient environment that conducts through the bowl to the beverage inside. Also, the exposed upper surface of the beverage is a liquid-air interface that receives convective heat directly from the ambient environment while simultaneously losing some heat from the liquid through evaporation. It can be observed that the wine in bowls of varietal specific glasses for white wines have smaller surface area to volume ratios than the bowls of varietal specific glasses for red wines. White wine glasses generally have smaller liquid-glass interfaces and smaller liquid-air interfaces which are intended to reduce heat transfer at these interfaces.

However, the bowl also facilitates beverage aeration, the release of beverage aromas, and the concentration of released beverage aromas. A wide diameter bowl provides the beverage inside with a large area liquid-air interface that promotes rapid beverage aeration, and the release of beverage aromas. The wide diameter bowl also allows for greater tapering to the bowl opening diameter, which promotes beverage aroma concentration. These features are typically available in wine glasses for red wine varieties. However, the narrow diameter bowl of white wine glasses (which are sized to promote the retention of a lower drinking temperatures) provides a smaller area liquid-air interface for a contained beverage, and allows limited tapering to the bowl opening diameter. This result in slower beverage aeration, the release of less beverage aroma, and less concentration of the released beverage aromas. The lower beverage temperature further reduces beverage aeration and release of beverage aromas. Consequently, consumers may swirl white wines more than red wines to promote faster aeration and release of beverage aromas. However, the swirling also greatly accelerates convective transfer at the liquid-air interface and conductive heat transfer at the liquid glass interface of the glass which is wetted by the swirling which undesirably accelerates the warming of the beverage.

Accordingly, the design of wine glasses for colder beverages is conflicted. The narrow stem and bowl help to reduce beverage heating. At the same time, the narrow bowl reduces aeration and aromas, limiting consumers' enjoyment.

The present application takes a new approach to beverage temperature maintenance. Instead of relying solely upon stem insulation and bowl size to slow heat transfer with the beverage, the glassware is configured to promote heat transfer through the bottom or base of the glassware to a heat sink or heat source. Hereafter, examples are provided of beverage cooling with a heat sink. However, it will be appreciated that in many cases, the same or similar features to those described may be employed to provide beverage heating with a heat source.

Figure 2:
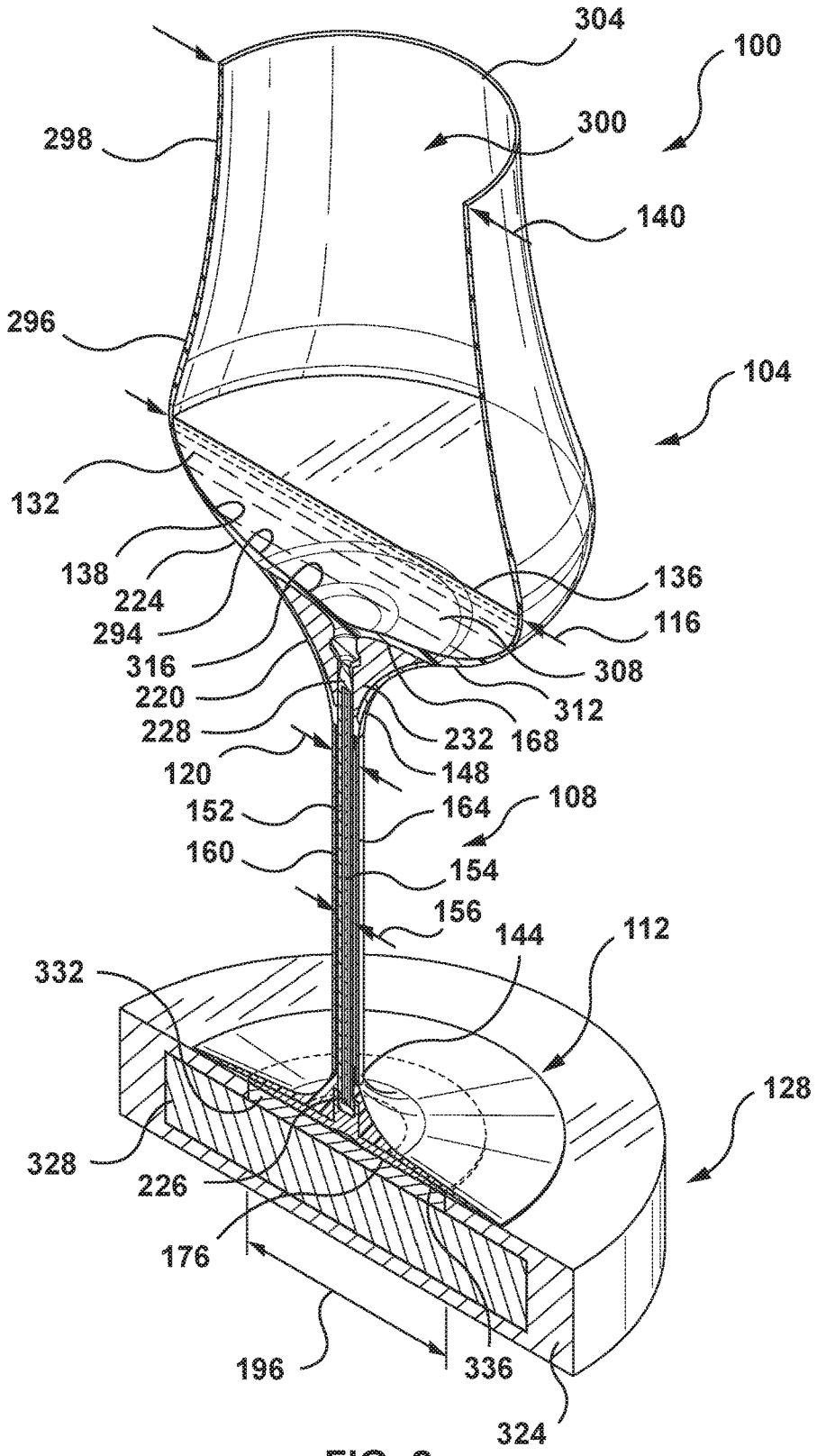
FIG. 2 is a perspective cross-sectional view taken along line 2-2 in FIG. 1.

Referring to FIG. 2, beverage container 100 includes a stem 108 that thermally couples the bowl 104 and the base 112. This allows a heat sink 128 thermally coupled to the base 112 to remove heat from the beverage 132 contained in the bowl 104 in order to mitigate heating of the beverage 132 by the ambient environment. In turn, this can allow beverage container 100 to have a large bowl diameter 116. The heat transfer from the beverage 132 to the heat sink 128 helps to offset the increase in ambient heating due to the enlarged area liquid-air and liquid-glass interfaces 136 and 138. As explained above, a larger bowl diameter 116 promotes beverage aeration and the release of beverage aromas, and allows a smaller ratio of bowl opening diameter 140 to bowl diameter 116 which promotes aroma concentration.

As used herein and in the claims, two elements are said to be "thermally coupled" where those two elements are in direct physical contact or where those two elements are spaced apart and connected by one or more intermediate elements (for example, solid or fluid elements) which provide a defined pathway for thermal transfer between the two elements. Preferably, the intermediate element(s) provide little resistance to heat transfer between the two elements they thermally connect. For example, the effective thermal conductivity of the intermediate element(s) within the range of intended operating conditions may be at least half that of at least one of the two elements, and preferably at least equal to at least one of the two elements.

Heat sink 128 can have any configuration suitable for withdrawing heat from beverage container 100. In the illustrated embodiment, heat sink 128 is formed as a coaster including a body 324 that houses phase change material 328, and a high thermal conductivity contact plate 332. The contact plate 332 includes an exposed upper support surface 336 that makes contact with base 112 to allow heat to transfer by conduction from beverage container 100 to heat sink 128. In other embodiments, heat sink 128 can be another passive device (e.g. cold rock or metal block without phase change material), or can be an actively powered device (e.g. a Peltier device or another refrigerating device).

As shown, stem 108 includes a stem lower end 144 connected to base 112, a stem upper end 148 connected to bowl 104, and a heat pipe 152 extending between stem lower end 144 and stem upper end 148. Heat pipe 152 is largely or solely responsible for the transfer of heat between bowl 104 and base 112. As used herein and in the claims, a "heat pipe" is any device that employs the latent heat of vaporization in combination with the latent heat of condensation of a contained fluid to transmit heat. Heat pipes 152 are reputed for having tremendous heat transfer capabilities that can far exceed the thermal conductivity of many solid metals. For example, some heat pipe designs can transfer heat up to 60 times more efficiently than a solid shaft of copper with equal diameter. This can allow a small diameter heat pipe to transfer heat as well as a much wider solid metal shaft. In turn, heat pipe 152 can allow stem 108 to effectively thermally couple bowl 104 to base 112, and yet maintain a small stem diameter 120 that substantially maintains the hand-feel and balance of traditional glass stemware. As shown, heat pipe 152 contains a wick 154 to transport condensed fluid from heat pipe lower end 226 against gravity to heat pipe upper end 228.

Heat pipe 152 can contain any working fluid, such as water for example. In some embodiments, the working fluid has a freezing temperature below that of heat sink 128 so that the working fluid does not freeze in use, which would halt the cycle of condensation and evaporation that is responsible for the rapid transfer of heat along heat pipe 152. For example, the working fluid may have a freezing point below −20° C., which corresponds to the temperature of many consumer freezers, or a freezing point below −30° C., which corresponds to the temperature of many commercial freezers. In some examples, the working fluid includes an alcohol (e.g. ethanol or methanol), a mixture of alcohols, or a mixture of alcohol(s) and water.

Still referring to FIG. 2, heat pipe 152 can have any diameter suitable for effectively transferring heat between bowl 104 and base 112. For example, heat pipe 152 may have a diameter 156 of between 3 mm and 20 mm. Generally, a larger diameter heat pipe 152 is able to transfer heat more efficiently than a smaller diameter heat pipe 152. The volume of beverage 132 to be contained in beverage container 100 affects the size of heat pipe 152 required to mitigate ambient heat transfer to the beverage 132. Accordingly, a smaller heat pipe diameter 156 (e.g. less than 10 mm) may be suitable for a stemmed wine glass, where a typical pour of wine is only about 150 mL. Also, the smaller heat pipe diameter 156 allows for a smaller stem diameter 120 as noted above. A larger heat pipe diameter 156 (e.g. greater than 10 mm) may be suitable for stemmed beer glasses, where a typical pour of beer is 450 mL or more. Also, the larger stem diameter 120 of many stemmed beer glass designs is able to easily accommodate the larger heat pipe diameter 156.

Still referring to FIG. 2, in some embodiments, at least a portion of heat pipe outer surface 160 is exposed. As used herein and in the claims, an "exposed" surface is one that is not covered by another component of the beverage container. For example, the exposed surface may be available for physical contact with ambient air or an external device (e.g. a heat sink or heat source). Providing heat pipe 152 with an exposed outer surface 160 can help reduce stem diameter 120 in comparison with using a covered heat pipe. In some embodiments, stem 108 may include a stem sleeve 164 that covers at least a portion of heat pipe outer surface 160. Stem sleeve 164 may act as an insulator to reduce conduction of heat between bowl 104 and a user's hand when beverage container 100 is held by stem 108.

Figure 3:
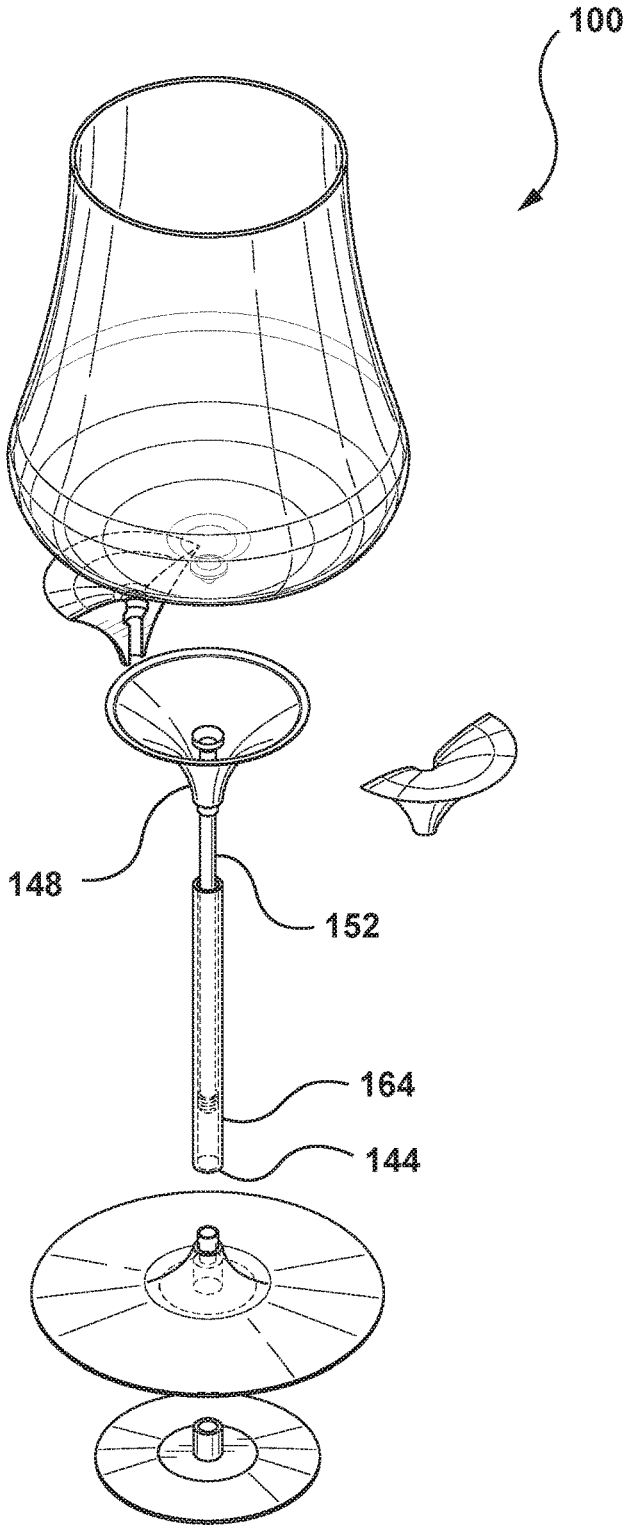
FIG. 3 is an exploded view of the beverage container of FIG. 1.

Stem sleeve 164 can be any element that covers at least a portion of heat pipe outer surface 160 to thermally insulate the heat pipe outer surface 160. In some embodiments, stem sleeve 164 is an insulating coating applied to heat pipe outer surface 160. Referring to FIG. 3, stem sleeve 164 may be formed as a hollow tube that receives heat pipe 152. For example, heat pipe 152 may extend within stem sleeve 164 between stem lower end 144 and stem upper end 148.

Stem sleeve 164 can be made of any material having a thermal conductivity less than heat pipe outer surface 160. For example, stem sleeve 164 may be made of plastic, rubber, wood, ceramic, or glass. In some embodiments, stem sleeve 164 is made of material having sufficient optical transparency to view heat pipe 152 within. This can allow heat pipe 152 to be monitored for any potential defects (e.g. leakage). Preferably, stem sleeve 164 is formed of glass (e.g. silica-glass or lead crystal) to provide the hand-feel of a traditional beverage container (e.g. wine glass or stemmed beer glass). For example, stem sleeve 164 may be blown or extruded glass.

In alternative embodiments, stem sleeve 164 may be made of a conductive material such as metal (e.g. stainless steel, copper, aluminum, or brass). In this case, the majority of stem sleeve 164 may be spaced apart from heat pipe outer surface 160 to limit thermal conduction between them.

Referring to FIG. 1, base 112 can have any configuration that can support beverage container 100 on a horizontal surface (e.g. on a table, bar, or mantle). As shown, base 112 includes a base lower end 168 that defines a horizontal supporting plane 172. For example, at least a portion of base lower end 168 may lie in the horizontal supporting plane 172 so that base 112 is capable of supporting beverage container 100 on a horizontal surface coplanar with the horizontal supporting plane 172.

Figure 4:
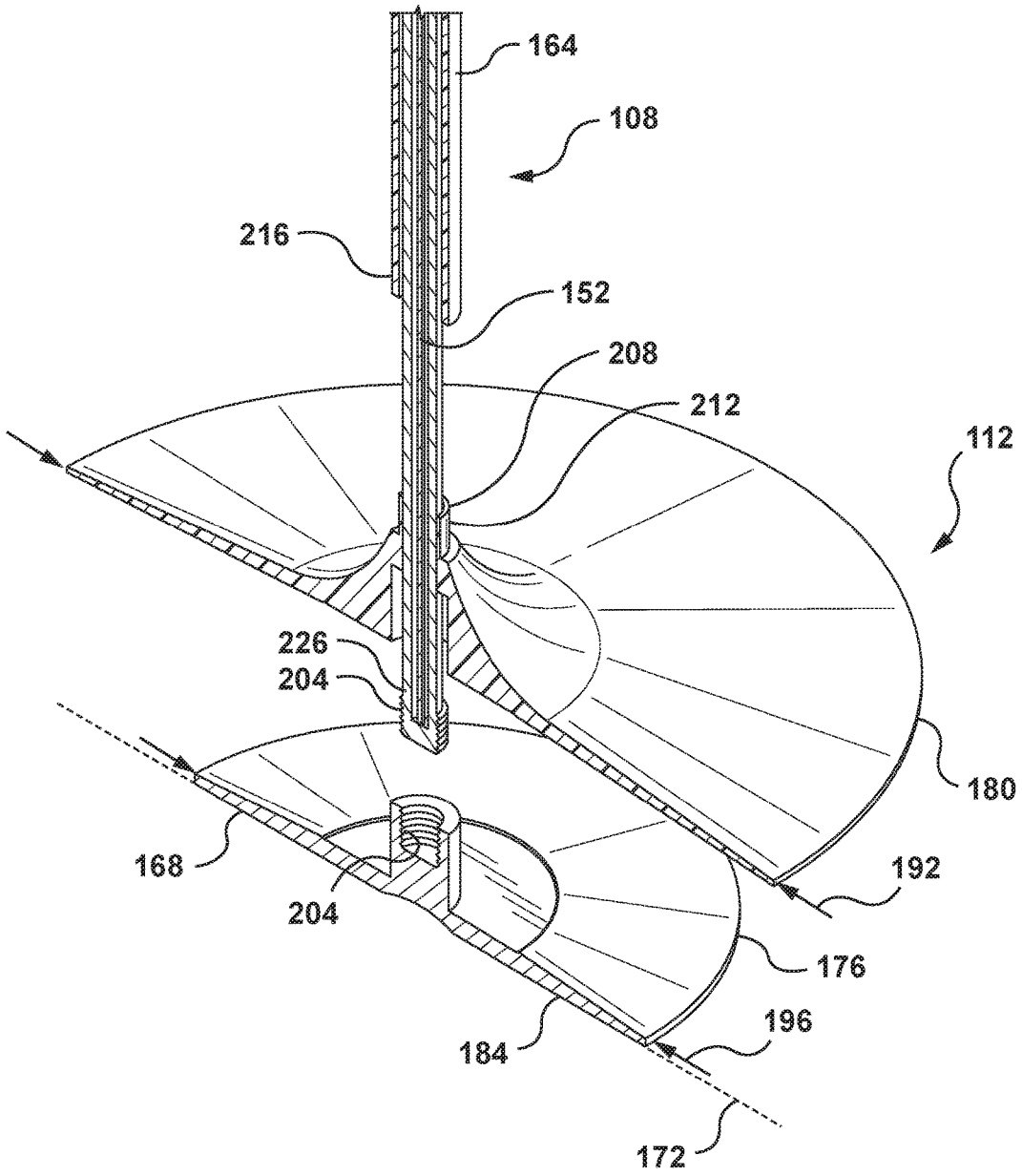
FIG. 4 is a partial enlargement of the exploded view of FIG. 3.

Referring to FIG. 4, base 112 can be made of any base materials. For example, the base material may include one or more (or all) of plastic, rubber, wood, ceramic, glass, or metal. As exemplified, base 112 may include a base conductive element 176 that is thermally coupled to the heat pipe 152. The base conductive element 176 may include base conductor material that has a thermal conductivity similar to or greater than most metals. This can allow base conductive element 176 to efficiently transmit heat between heat sink 128 (FIG. 1) and heat pipe 152. For example, the base conductor material may have a thermal conductivity of at least about 10 W/(m K) at 20° C. This contrasts with the thermal conductivity of most plastic, rubber, wood, ceramics and glass which typically have thermal conductivity values of less than about 3 W/(m K) at 20° C.

In some embodiments, base 112 further includes a base insulative element 180. Base insulative element 180 may overlay at least a portion of base conductive element 176. This may reduce heat transfer between base conductive element 176 and the ambient environment. For example, base insulative element 180 may provide support for the base of a user's hand when beverage container 100 is held by stem 108. In this case, base insulative element 180 may reduce thermal conduction between the user's hand and base conductive element 176, which is thermally coupled to bowl 104 (FIG. 1) by way of heat pipe 152.

Base insulative element 180 may be made of any base insulator material having lower thermal conductivity than base conductor material of base conductive element 176. In some embodiments, base insulator material has a thermal conductivity less than one third of the thermal conductivity of the base conductive element. For example, base insulative element 180 may be made of plastic, rubber, wood, ceramic, or glass, which may have a thermal conductivity of less than about 3 W/(m K) at 20° C. This can allow base insulative element 180 to effectively thermally insulate portions of base conductive element 176. In some embodiments, base insulative element 180 is made of glass (e.g. silica-glass or lead crystal) to provide the hand-feel of a traditional beverage container (e.g. wine glass or stemmed beer glass). For example, base insulative element 180 may be formed by press molding glass. In some embodiments stem sleeve 164 and base insulative element 180 may be integrally formed. For example, stem sleeve 164 and base insulative element 180 may be made in a single piece in a glass pressing operation.

Still referring to FIG. 4, base conductive element 176 may include an exposed base lower contact surface 184 for thermal coupling with heat sink 128. In some embodiments, base lower contact surface 184 is flush with base lower end 168 (e.g. flush with horizontal supporting plane 172). This can allow base lower contact surface 184 to make contact with any cold object below for maximum operational flexibility and compatibility. For example, base lower contact surface 184 may be flush with base insulative element 180, protrude below base insulative element 180, or base 112 may not include a base insulative element 180 at all.

Figure 2B:
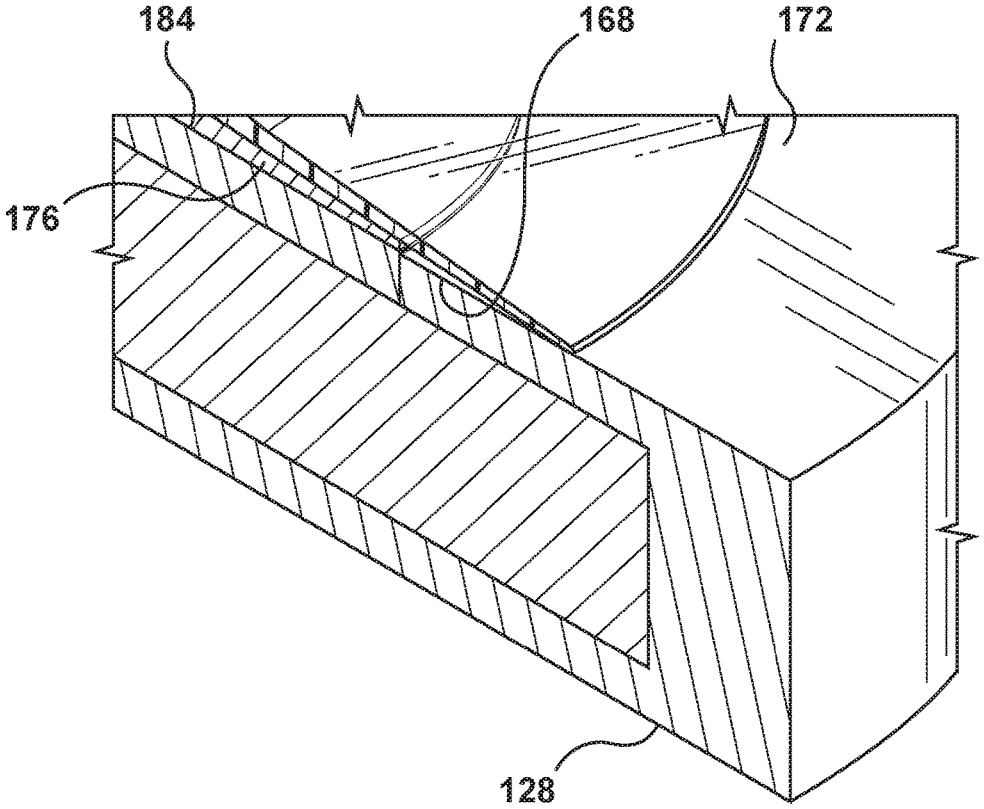
FIG. 2B is a partial enlargement of FIG. 2.

Reference is now made to FIG. 2B. Alternatively, base lower contact surface 184 may be recessed from base lower end 168 (e.g. recessed from horizontal supporting plane 172) as shown. This can help prevent wetting supporting surfaces with condensation. In some cases, base conductive element 176 may be very cold (e.g. around 4° C. or less) due to contact with heat sink 128 or due to thermal coupling between conductive element 176 and the bowl 104 (FIG. 2) containing a cold beverage 132 (FIG. 2). Ambient air that contacts the cold base lower contact surface 184 may produce condensation. A user may place beverage container 100 on a horizontal surface without a heat sink. By recessing base lower contact surface 184, the condensation formed thereon may be held spaced apart from the horizontal surface (e.g. table) below.

Returning to FIG. 4, as shown, base insulative element 180 may extend radially outwardly of base conductive element 176. For example, base insulative element width 192 may be greater than base conductive element width 196. This can provide base 112 with a greater footprint for better stability, without unduly enlarging base conductive element 176, and allow base lower contact surface 184 to be recessed from base lower end 168. Alternatively, base conductive element width 196 may be equal to or greater than base insulative element width 192. This can provide base conductive element 176 with a larger base lower contact surface 184 for more efficient thermal coupling with a heat sink below.

Figure 5:
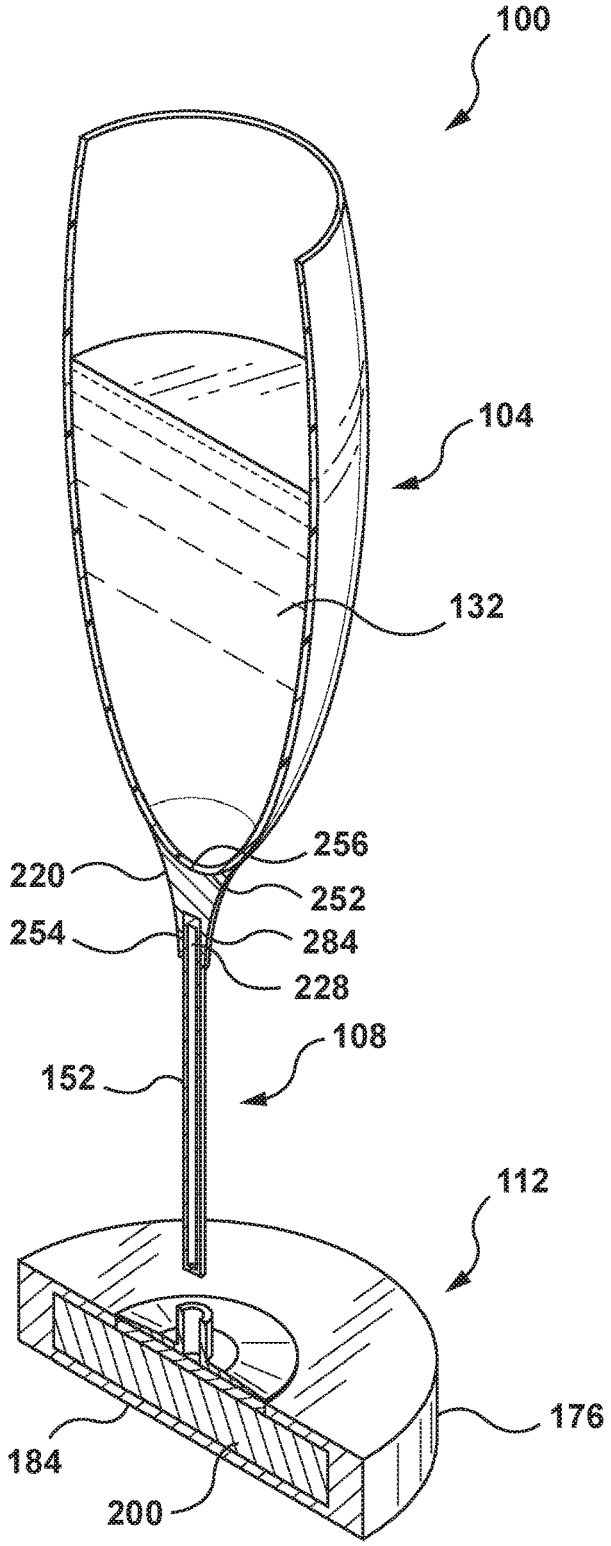
FIG. 5 is a partially exploded view of a beverage container in accordance with another embodiment.

Reference is now made to FIG. 5. In some embodiments, base conductive element 176 includes a volume of phase change material 200. During a change of phase from solid to liquid ("melting"), phase change material 200 is capable of absorbing a large quantum of heat ("latent heat of fusion") while remaining at a substantially constant temperature ("melting temperature"). This contrasts with heating outside of phase changes, in which the receipt of heat imparts a rise in temperature, which leads to a reduction in temperature differential which slows the rate of heat transfer. The constant temperature during a change in phase keeps the temperature differential and rate of heat transfer constant.

Phase change material 200 may be made of any known phase change material. Preferably, phase change material 200 has a melting point of between −30° C. and 15° C. If the melting point of phase change material 200 is too low, then it can be difficult for some users (e.g. home users or restaurants) to achieve freezing using available equipment (e.g. standard freezers), in which case beverage container 100 will not benefit from the latent heat of fusion. For example, commercial freezers may produce temperatures below −30° C., whereas consumer refrigerators typically produce temperatures around −20° C. Similarly, if the melting point of phase change material 200 is too high (e.g. above the temperature of beverage 132), then heat exchange between the phase change material 200 and beverage 132 may be insufficient to melt phase change material 200.

Base 112 can contain any volume of phase change material 200. For example, base 112 may contain between 10 mL and 100 mL of phase change material. A large volume of phase change material 200 will have a greater latent heat of fusion, which can prolong the cooling effect of base 112 on beverage 132 when base 112 is not thermally coupled to an external heat sink. However, phase change material 200 also contributes bulk and weight to beverage container 100.

Base conductive element 176 may include phase change material 200 and an exposed lower contact surface 184. This can allow base conductive element 176 to be thermally coupled to an external heat sink 128 (FIG. 1) in addition to containing phase change material 200. In other embodiments, base conductive element 176 may not include an exposed lower contact surface 184. Instead, beverage container 100 may rely upon phase change material 200 in base 112 to act as a heat sink.

Phase change material 200 may be removably connected to beverage container 100. For example, phase change material 200 may be removably connected to base conductive element 176, base conductive element 176 may be removably connected to base 112, or base 112 may be removably connected to stem 108. In the illustrated example, base 112 is shown removably connected to stem 108. In any of these cases, the disconnectable components of beverage container 100 can be connected in any manner that allows those components to be separated and reconnected. In the example shown in FIG. 4, base conductive element 176 is removably connected to stem 108 by threads, and when removed the base conductive element 176 is separable from base insulative element 180 and base 112 is separable from stem 108. Returning to FIG. 5, removability of phase change material 200 can allow phase change material 200 (by itself or along with base conductive element 176 or the entire base 112) to be separably chilled in an external cooling device (e.g. refrigerator or freezer). This can avoid having to place the entire beverage container 100 into a refrigerator where the beverage container 100 may occupy valuable space and risk damage. This also allows phase change material 200 (by itself or along with base conductive element 176 or the entire base 112) to be swapped out for a pre-chilled phase change material 200 (by itself or along with a base conductive element 176 or an entire base 112) to allow prolonged continuous usage of beverage container 100.

Alternatively, phase change material 200 may be permanently connected to beverage container 100. In this case, phase change material 200 may be chilled by placing the entire beverage container 100 into an external cooling device (e.g. refrigerator or freezer).

Figure 2C:
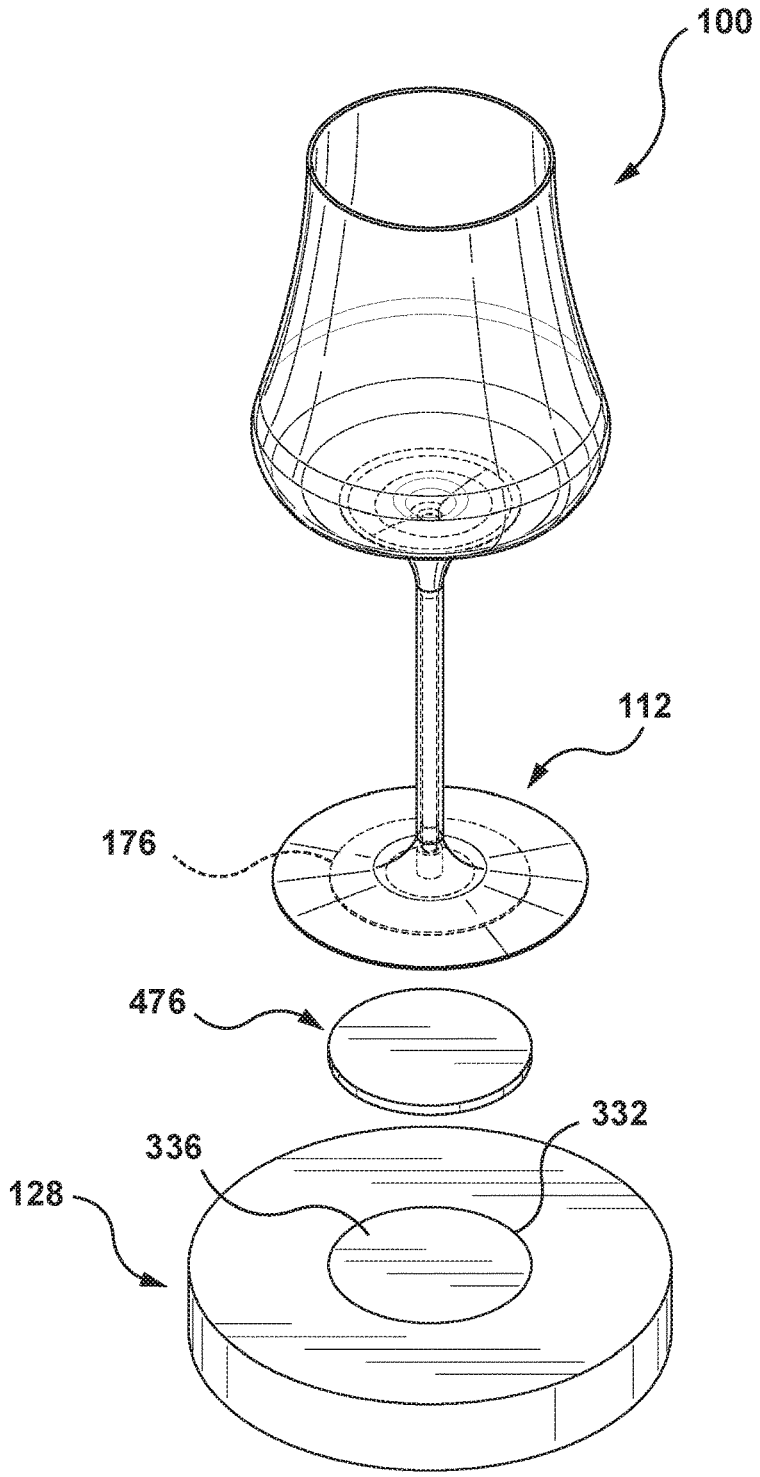
FIG. 2C is a perspective view of the beverage container and heat sink of FIG. 1, and a porous pad, in accordance with an embodiment.

Referring to FIG. 2C, in some embodiments, a porous pad 476 may be positioned between base conductive element 176 and heat sink 128. In use, a liquid may be absorbed into porous pad 476, which may help to improve thermal heat transfer between base lower contact surface 184 (FIG. 3) and heat sink conductive contact surface 336. The porous pad 476 can have any construction that provides porosity and absorptivity sufficient to absorb sufficient liquid to improve thermal heat transfer between base 112 and heat sink 128. For example, porous pad 476 may include one or more of woven or non-woven fabric, which may include natural fibers (e.g. cotton) or synthetic fibers (e.g. polyester), sponge, or foam materials. Porous pad 476 may have a liquid absorptivity of at least 1 mL, such as 1 mL to 50 mL.

In use, porous pad 476 may absorb a liquid having a freezing point below that of water, and preferably below the temperature of heat sink 128 (e.g. below the freezing temperature of phase change material 200 (FIG. 5)). This can help prevent condensation that may form between base lower contact surface 184 (FIG. 3) and heat sink conductive contact surface 336 from freezing base 112 to heat sink 128. For example, porous pad 476 may absorb a liquid having a freezing temperature of less than −5° C., such as −5° C. to −55° C. Consumer freezers typically produce temperatures around −20° C. Therefore, a liquid having a freezing temperature less than −20° C. may be suitable for use with a heat sink that is chilled in a consumer freezer. Commercial freezers may produce temperatures of −30° C. or below. Therefore, a liquid having a freezing temperature less than −30° C. may be suitable for use with a heat sink that is chilled in a commercial freezer. In some examples, porous pad 476 may be saturated with an aqueous salt solution (water and salt solution).

Porous pad 476 may have any size and shape suitable for providing a thermal heat transfer interface between base conductive element 176 and heat sink 128. For example, porous pad 476 may be equal in size or larger than base lower contact surface 184 (FIG. 3). Alternatively, or in addition, porous pad 476 may be equal in size or larger than heat sink conductive contact surface 336. In some embodiments, porous pad 476 is removably positionable (e.g. free of fasteners) on heat sink 128. This can allow porous pad 476 to be easily removed and replaced when dried out or at the end of a meal. For example, porous pad 476 may be a single-use, non-reusable, disposable pad. Alternatively, porous pad 476 may be a launderable, re-usable pad. In other embodiments, porous pad 476 is permanently connected to heat sink 128, or releasably connected to heat sink 128 (e.g. by a releasable fastener). This can help prevent porous pad 476 from moving off of heat sink 128 during use. When porous pad 476 becomes dry due to evaporation, additional liquid may be poured onto porous pad 476 for absorption into the porous pad 476. If porous pad 476 becomes dirty (e.g. wine spilled onto porous pad 476), then porous pad 476 may be cleaned, or replaced (if removable).

Referring to FIG. 4, base conductive element 176 may be thermally coupled to heat pipe 152 in any way that allows heat to efficiently transfer between base conductive element 176 and heat pipe 152. In the illustrated example, base conductive element 176 and heat pipe 152 are joined in physical contact by threads 204. Alternatively or in addition, base conductive element 176 and heat pipe 152 can be thermally coupled by thermal adhesive. Thermal adhesive is a widely available type of adhesive (e.g. glue) specially designed to have high thermal conductivity (e.g. greater than about 1.0 W/m K at 20° C., such as 1.0 W/mK to 6.0 W/mK at 20° C.). Some thermal adhesives have elastic properties that can improve the tolerance for thermal expansion and contraction in the thermal coupling of base conductive element 176 and stem 108.

In some embodiments, base conductive element 176 is connected to heat pipe lower end 226, base insulative element 180 is connected to stem sleeve 164, but base conductive element 176 is not directly connected to base insulative element 180. This can allow base conductive element 176 to move downwardly relative to base insulative element 180 in response to thermal expansion of heat pipe 152, which can avoid tensile stress at the interface of base conductive element 176 and base insulative element 180 which may cause base insulative element 180 to crack. Such expansion may occur during, e.g. dishwashing, and especially machine dishwashing. This feature may have particular application where heat pipe 152 has a relatively high coefficient of thermal expansion (e.g. is made of metal), and base insulative element 180 is relatively fragile (e.g. is made of glass). In alternative embodiments, base conductive element 176 may be directly connected to base insulative element 180. For example, base insulative element 180 may be made of a material that is resistant to damage from the tensile stresses noted above, such as an elastic material (e.g. rubber or flexible plastic).

Still referring to FIG. 4, base 112 may separate stem sleeve 164 from heat pipe 152. This can allow an air gap between stem sleeve 164 and heat pipe 152 to reduce thermal heat transfer between a user's hands and heat pipe 152 when beverage container 100 is held by stem 108. As shown, base upper end 208 may include an upwardly extending base collar 212 that aligns stem sleeve 164 in spaced apart relation to heat pipe 152 inside. For example, base collar 212 may be received in stem sleeve lower end 216 thereby centering stem sleeve 164 around heat pipe 152. In the illustrated example, heat pipe 152 is received in base collar 212 whereby collar 212 acts as a spacer between stem sleeve 164 and heat pipe 152. In alternative embodiments, stem sleeve 164 may be integrally formed with base 112. For example, stem sleeve 164 may be integrally formed with base insulative element 180. In other embodiments, stem sleeve 164 is in flush physical contact with heat pipe 152 instead of being spaced apart therefrom. This can allow heat pipe 152 to provide structural support for stem sleeve 164, which may be fragile depending on the thickness and material of stem sleeve 164.

Figure 6:
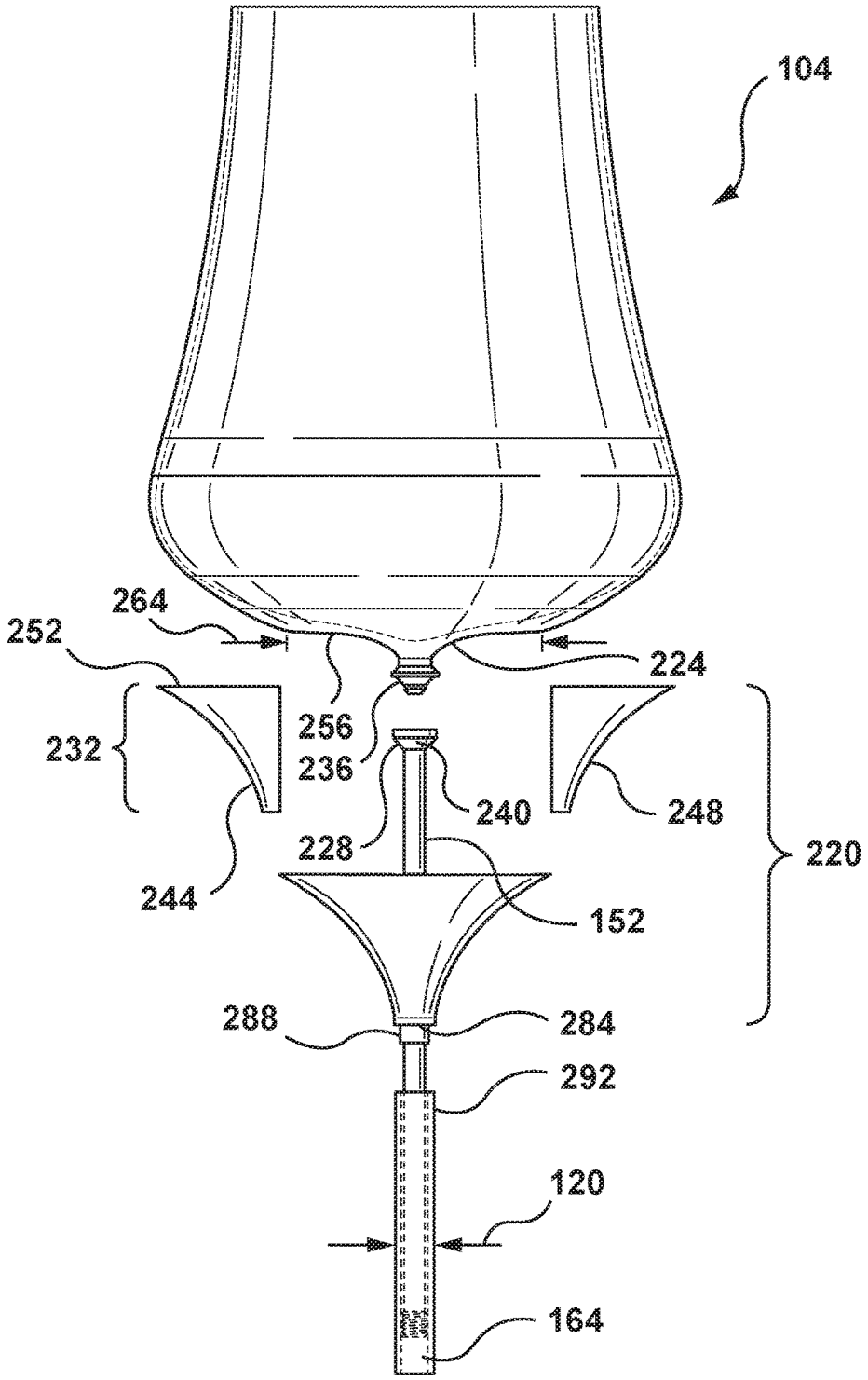
FIG. 6 is a partial enlargement of the exploded view of FIG. 6.

Reference is now made to FIG. 6. Bowl 104 can be thermally coupled to heat pipe 152 in any manner that allows efficient heat transfer between heat pipe 152 and bowl 104. In the illustrated embodiment bowl 104 and heat pipe 152 are connected by a thermally conductive fastener 220, which may be used in combination with thermally conductive adhesive. Fastener 220 connects and thermally couples bowl lower end 224 and heat pipe upper end 228. As shown, fastener 220 may include at least a fastener conductive portion 232 that conducts heat between bowl lower end 224 and heat pipe upper end 228. For this purpose, fastener conductive portion 232 may have a thermal conductivity of 3 W/(m K) or more. For example, fastener conductive portion 232 may be made of alumina or an appropriate metal with thermal coefficient of expansion similar to that of the glass bowl. For example, stainless 420 has a coefficient of thermal expansion (CTE) of approximately $10\times10^{-6}$ m/m° K which matches very closely the glass bowl CTE of approximately $9\times10^{-6}$ m/m° K. Matching the CTE's of the materials makes the assembly more robust in both use and cleaning including dishwasher cleaning where high temperature flux can lead to significant thermal expansion and contraction. As used herein and in the claims, two materials are said to have "matching" CTEs, where the CTE one of the two materials is between 85% and 115% of the CTE of the other of the two materials.

Referring to FIG. 5, fastener 220 can be any device that can connect and thermally couple bowl lower end 224 and heat pipe upper end 228. In the illustrated embodiment, fastener 220 has a fastener upper contact surface 252 shaped to conform to bowl lower contact surface 256 (e.g. fastener upper contact surface 252 may have a surface profile that matches the surface profile of bowl lower contact surface 256). For example, fastener upper contact surface 252 may be concave so as to make flush contact with a convex bowl lower contact surface 256. Thermal adhesive may be applied between fastener upper contact surface 252 and bowl lower contact surface 256 to join the two surfaces. As shown, fastener lower end 284 may include a fastener mounting recess 254 sized to receive heat pipe upper end 228. Thermal adhesive may be applied inside fastener mounting recess 254, between heat pipe upper end 228 and fastener lower end 284, to join heat pipe 152 to fastener 220.

Figure 7:
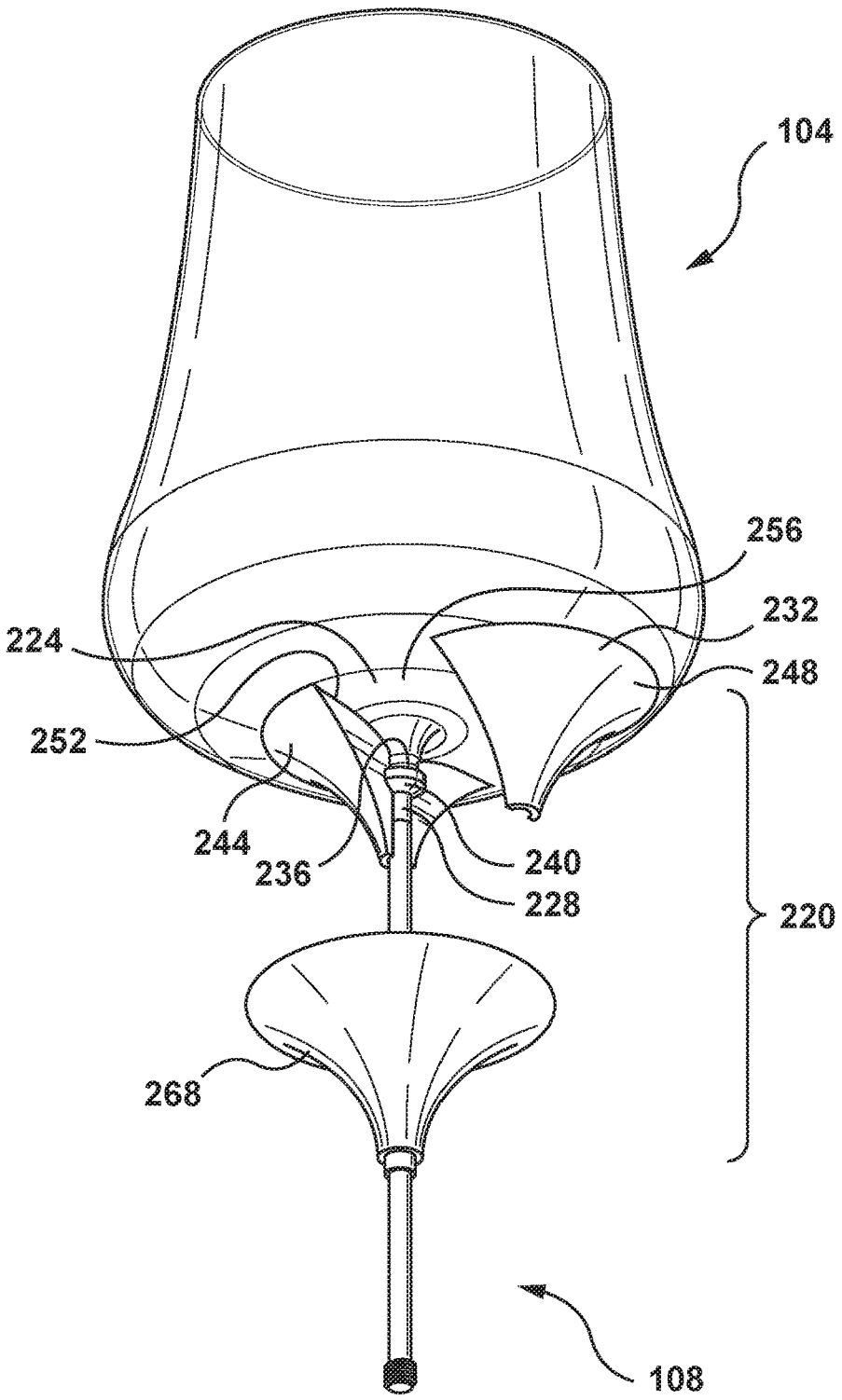
FIG. 7 is a partial exploded view of the beverage container of FIG. 1.

FIG. 7 shows an alternative construction of fastener 220. In the illustrated example, a portion of each of bowl lower end 224 and heat pipe upper end 228 is received in fastener 220. As shown, bowl lower end 224 may include a bowl mounting lug 236, and heat pipe upper end 228 may include a heat pipe mounting lug 240. Mounting lugs 236 and 240 may be received in fastener conductive portion 232, which rigidly connects the mounting lugs 236 and 240. As shown, fastener conductive portion 232 may be formed as a two piece assembly, including first piece 244 and second piece 248, which connect together to enclose mounting lugs 236 and 240. Pieces 244 and 248 can be made of a material having high thermal conductivity and a coefficient of thermal expansion matching that of the glass bowl. For example, pieces 244 and 248 may be made of alumina and stainless steel 420. Alternatively or in addition to mounting lugs 236 and 240, fastener 220 may be connected to each of bowl lower end 224 and heat pipe upper end 228 by adhesive, such as thermal adhesive.

In some embodiments, fastener 220 includes a fastener upper contact surface 252 that is thermally coupled to bowl lower end 224 (e.g. by direct physical contact or by thermal adhesive interposed between upper contact surface 252 and bowl lower end 224). As shown, bowl lower end 224 may include a bowl lower contact surface 256 sized and shaped to mate with fastener upper contact surface 252 for facilitating the thermal coupling. In the illustrated example, bowl mounting lug 236 projects below bowl lower contact surface 256. This can allow bowl mounting lug 236 to provide a secure mount for rigidly connecting bowl 104 to stem 108, while bowl lower contact surface 256 to provide a large area surface for heat conduction into bowl 104. In alternative embodiments, mounting lugs 236 and 240 are not provided, as shown in the embodiment of FIG. 5. Further, fastener 220 may be made as a one piece construction as in FIG. 5.

Bowl lower contact surface 256 and fastener upper contact surface 252 can have any size and shape. In the illustrated embodiment, contact surfaces 252 and 256 are substantially planar. In other embodiment, contact surfaces 252 and 256 may be concave, convex, or have another regular or irregular profile. Contact surfaces 252 and 256 provide a large area surface for heat transfer to occur efficiently. As shown, each of contact surfaces 252 and 256 may have an area that is larger than a cross-sectional profile of stem 108. For example, contact surfaces 252 and 256 may have diameters 260 (FIG. 8) and 264 (FIG. 6) respectively, which are greater than stem diameter 120 (FIG. 6).

Still referring to FIG. 7, fastener 220 may include an outer insulating portion 268. As shown, outer insulating portion 268 may overlie at least a portion of fastener conductive portion 232. Fastener outer insulating portion 268 helps to thermally insulate fastener conductive portion 232, e.g. from user's hands. For this purpose, fastener outer insulating portion 268 may have a thermal conductivity less than that of fastener conductive portion 232 (e.g. less than 3 W/(m K). For example, fastener outer insulating portion 268 may be made of plastic, glass, or a ceramic such as zirconia.

In some embodiments, fastener outer insulating portion 268 is a discrete component connected to fastener conductive portion 232. For example, fastener conductive portion 232 may be received in fastener outer insulating portion 268 to hold first and second pieces 244 and 248 together. Alternatively, fastener outer insulating portion 268 may be integrally formed or preassembled with fastener conductive portion 232. For example, fastener outer insulating portion 268 may be laminated to or applied as a coating to fastener conductive portion 232.

Figure 8:
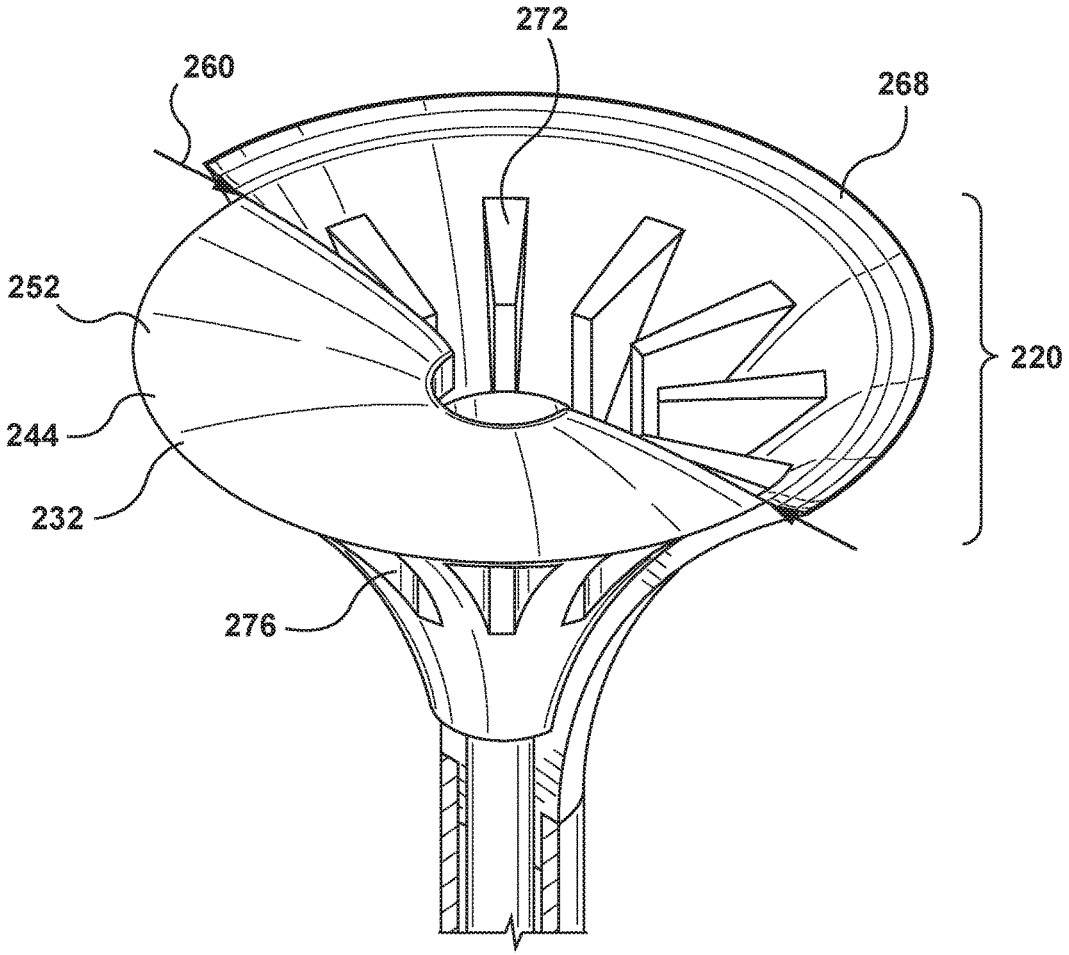
FIG. 8 is a partial view of a fastener connected to the stem of the beverage container of FIG. 1.

Fastener outer insulating portion 268 can be connected to fastener conductive portion 232 in any manner. For example, fastener outer insulating portion 268 can be connected to conductive portion 232 by adhesive. Referring to FIG. 8 (where second piece 248 is omitted for clarity of illustration), in some embodiments, fastener outer insulating portion 268 and fastener conductive portion 232 collectively include projections and recesses that mate when the two portions 268 and 232 are assembled. For example, fastener outer insulating portion 268 is shown including inwardly extending projections 272 and fastener conductive portion 232 is shown including inwardly extending recesses 276. As shown, fastener projections 272 and fastener recesses 276 are sized, shaped, and positioned to mate (i.e. projections 272 are received in recesses 276) when portions 268 and 232 are connected. This can improve the structural integrity and robustness of fastener 220, and prevent relative rotation between fastener portions 232 and 268. Further this can reduce the surface contact area between fastener portions 232 and 268 reducing the thermal transfer between those components.

Figure 9:
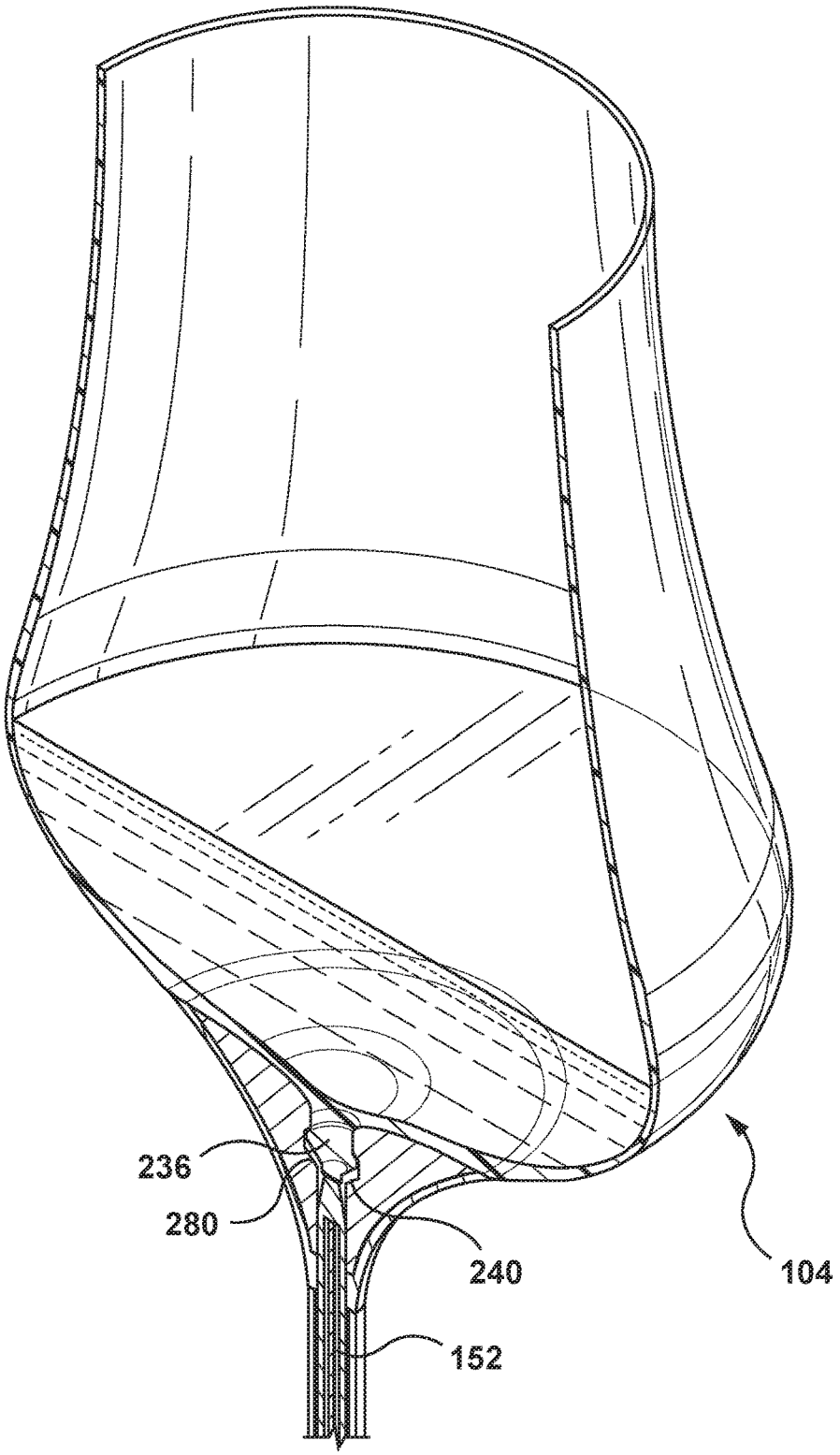
FIG. 9 is a partial enlargement of FIG. 2.

Referring to FIG. 9, at least a portion of bowl mounting lug 236 may be received in heat pipe mounting lug 240 as shown, or vice versa. This can provide a relatively large area of direct contact or close contact (e.g. separated by a layer of thermal adhesive or similar) for enhanced thermal transfer between heat pipe 152 and bowl 104. As shown, heat pipe mounting lug 240 may include a lug recess 280 sized to receive at least a portion of bowl mounting lug 236. In alternative embodiments, neither of bowl mounting lug 236 nor heat pipe mounting lug 240 is received in the other.

Referring to FIG. 6, fastener 220 may separate stem sleeve 164 from heat pipe 152. This can allow an air gap between stem sleeve 164 and heat pipe 152 to reduce thermal heat transfer between a user's hands and heat pipe 152 when beverage container 100 is held by stem 108. As shown, fastener lower end 284 may include a downwardly extending fastener collar 288 that aligns stem sleeve 164 in spaced apart relation to heat pipe 152 inside. For example, fastener collar 288 may be received in stem sleeve upper end 292 thereby centering stem sleeve 164 around heat pipe 152. In the illustrated example, heat pipe 152 is received in fastener collar 288 whereby collar 288 acts as a spacer between stem sleeve 164 and heat pipe 152. Alternately fastener lower end 284 may include a recessed fastener collar that aligns the external surface of stem sleeve 164 in spaced apart relation to heat pipe 152 inside. For example, stem sleeve upper end 292 may be inserted into a recessed portion of fastener 220 thereby centering stem sleeve 164 around heat pipe 152. Alternatively, stem sleeve 164 may be integrally formed with fastener 220.

Referring to FIG. 2, bowl 104 can have any size and shape suitable for holding a beverage 132. As shown, bowl 104 includes a bottom 294 at bowl lower end 168 and a bowl sidewall 296 which extends upwardly from bowl lower end 168 to bowl upper end 298. Bowl bottom 294 and sidewall 296 together define a liquid chamber 300 having a bowl opening 304 at bowl upper end. In use, the contents of bowl 104 are dispensed (e.g. for consumption) through bowl opening 304.

In some embodiments, some or all of bowl 104 is transparent. This can be important for the consumption of some beverages where the user normally assesses the beverage by its appearance. For example, the type, spoilage, and alcohol content, among other attributes of a wine can be assessed by the nuances of its color. In some cases, fastener 220, heat pipe 152 of stem 108, and/or the color of any thermal adhesive applied can alter the appearance of a beverage 132 in bowl 104. For example, light refraction through bowl 104 can cause color components of fastener 220, heat pipe 152, and/or thermal adhesive to be visible through bowl sidewall 296, which can interfere with clear visibility of beverage 132. In the illustrated example, bowl 104 includes a reflective layer 308 that covers at least a portion of bowl bottom 294. Reflective layer 308 can be opaque and oriented to reflect light upwardly to preserve the integrity of the beverage appearance. In some examples, reflective layer 308 may have an average light reflectivity of at least 50% within the visible spectrum of light. Preferably, bowl sidewall 296 is substantially transparent (e.g. substantially free of reflective layer 308).

Reflective layer 308 can be made of any reflective material. For example, reflective layer 308 may be made of silver or aluminum. Reflective layer 308 may be applied to bowl outer surface 312, bowl inner surface 316, or embedded between bowl outer and inner surfaces 312 and 316. In alternative embodiments, bowl 104 is substantially opaque. This can be acceptable for beverages whose appearance is of lesser importance to the consumer.

Bowl 104 may have a bowl diameter 116 greater than its opening diameter 320. For example, bowl sidewall 296 may taper inwardly between bowl lower end 224 and bowl upper end 298 as shown. This can allow bowl 104 to promote the concentration of aromas from beverage 132. Bowl 104 may also include a large bowl diameter 116, which can promote rapid aeration of beverage 132 at liquid-air interface 136.

Bowl 104 can be made of any material. Preferably, bowl 104 is made of glass (e.g. silica-glass, lead crystal, or non-lead crystal including titanium crystal) to provide the hand and mouth feel of a traditional beverage container (e.g. wine glass or stemmed beer glass). Glass also benefits from compatibility with high temperature washing, which is unsuitable for some materials, such as plastic. In some examples, bowl 104 may be blown glass.

Referring to FIG. 2, beverage 132 is exposed to an influx of heat from the environment and an outflux of heat to a heat sink thermally coupled to base 112. The rate of heat influx is positively correlated to the ambient temperature differential (i.e. the difference between the beverage temperature and the ambient temperature). The rate of heat outflux is positively correlated to the heat sink temperature differential (i.e. the difference between the beverage temperature and the heat sink temperature). At an equilibrium beverage temperature, the heat influx is roughly equal to the heat outflux. Ideally, the equilibrium beverage temperature is at or close to the suggested drinking temperature of the beverage 132 for which beverage container 100 is intended.

The equilibrium beverage temperature is affected by many factors, including the heat transfer efficiency between base 112 and bowl 104. Greater heat transfer efficiency between the base 112 and bowl 104 promotes a lower beverage equilibrium temperature, and vice versa. It will be appreciated that in some cases a maximum of heat transfer efficiency between base 112 and bowl 104 is not desirable as this would lead to an equilibrium temperature for beverage 132 that is far below the suggested drinking temperature, and vice versa. Instead, various features of beverage container 100 may be tuned (e.g. sized and selected) to alter the heat transfer efficiency between base 112 and bowl 104 in order to achieve a desired equilibrium temperature. These features include heat pipe diameter 156, material of base conductive element 176, base conductive element width 196, the material of fastener conductive portion 232, and fastener upper contact surface width 260 (FIG. 8), among others. The temperature of the heat sink and the ambient environment also affects the equilibrium temperature. In some embodiments, beverage container 100 is configured to provide a pre-determined equilibrium beverage temperature that is the suggested drinking temperature for a particular beverage based on a nominal ambient temperature of 22° C. and a volume of beverage equal to about 50 percent of the standard serving size for that beverage (e.g. 50% of 150 mL for wine, which is 75 mL). An exemplary list of beverages and suggested drinking temperatures can be found in Table 1, above.

Figure 3D:
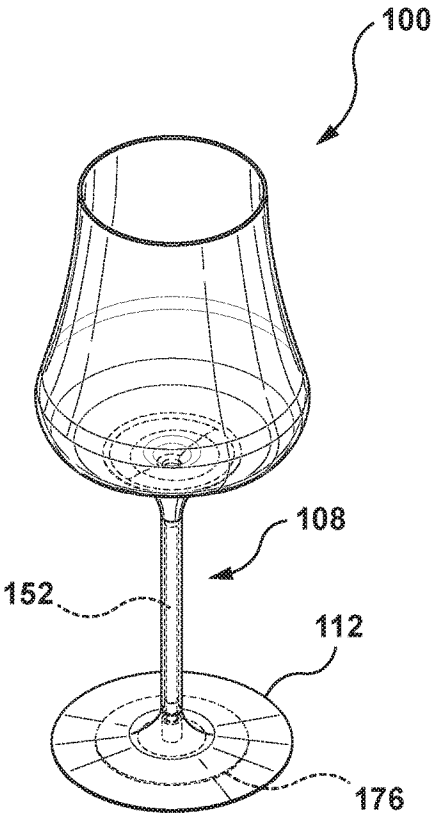
FIGS. 3B-3D illustrate steps in the assembly of the beverage container of FIG. 1.
Figure 3C:
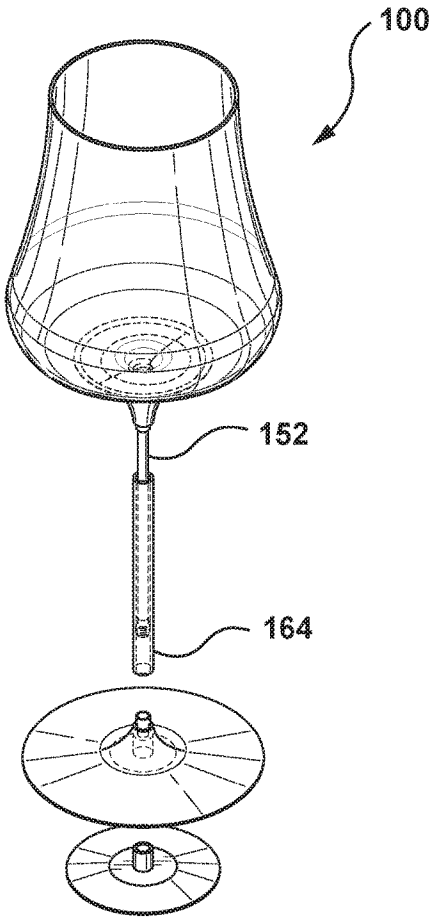
Figure 3B:
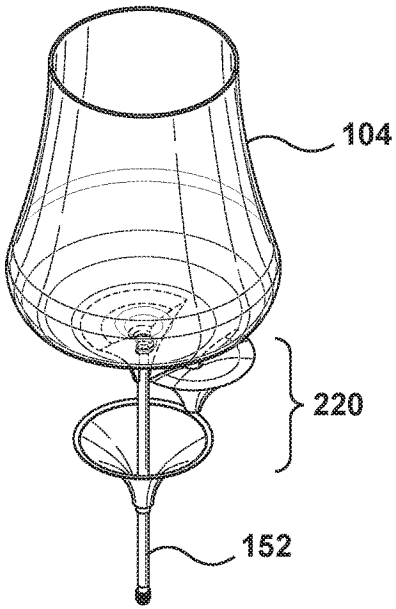

FIGS. 3B, 3C, and 3D illustrate steps in the assembly of beverage container 100, in accordance with an embodiment. In FIG. 3B, heat pipe 152 is connected to bowl 104 by fastener 220. In FIG. 3C, heat pipe 152 is inserted into stem sleeve 164. In FIG. 3D, base 112 is connected to stem 108 by fastening base conductive element 176 to heat pipe 152.

Reference is now made to FIGS. 20-21, which show a beverage container 100 in accordance with another embodiment. As shown, beverage container 100 includes a bowl 104, a fastener 220, a stem 108, a heat pipe 152, and a base 112. Fastener 220, stem 108, heat pipe 152, and base 112 are collectively referred to as a support assembly 904. As shown, support assembly 904 carries bowl 104 which is connected to fastener 220, and provides for efficient heat transfer between bowl 104 and base 112 (e.g. to a heat sink below).

Turning to FIGS. 21, 22A and 22B, support assembly 904 may include an inner subassembly 908 (FIG. 22A) and an outer subassembly 912 (FIG. 22B). Inner subassembly 904 includes heat conductive elements that collectively form a thermal transfer pathway from fastener 220 to base 112. Outer subassembly 912 is sized to surround inner subassembly 904. Between 90-99.9% of inner subassembly outer surface 916 is spaced apart from outer subassembly inner surface 920 by a space 924 (e.g. filled with a gas such as air, or else substantially evacuated of gas). This allows outer subassembly 912 to insulate inner subassembly 904 from external sources of heat (e.g. the environment and user's hands), and also to reduce condensation formation on support assembly outer surface 928 (FIG. 21).

FIG. 22A shows an exemplary inner subassembly 908 including fastener conductive portion 232, heat pipe 152, and base conductive element 176. As shown, heat pipe 152 thermally couples fastener conductive portion 232 to base conductive element 176. FIG. 22B shows an exemplary outer subassembly 912 including fastener outer portion 268, stem sleeve 164, and base outer element 180. Referring to FIG. 21, except for one or more discrete connection points, each of fastener conductive portion 232, heat pipe 152, and base conductive element 176 are spaced apart from each of fastener outer portion 268, stem sleeve 164, and base outer element 180.

Referring to FIG. 22A, fastener conductive portion 232 is thermally coupled to heat pipe upper end 228, and base conductive portion 176 is thermally coupled to heat pipe lower end 226. Heat pipe 152 can be connected to fastener conductive portion 232 and base conductive portion 176 in any manner, such as by one or more of welding, brazing, mating threads, or thermal adhesive for example. Preferably, heat pipe 152, fastener conductive portion 232, and base conductive portion 176 are rigidly connected to form a rigid inner subassembly 908. A rigid inner subassembly 908 may be better able to maintain space 924 (FIG. 21) from outer subassembly 912.

Referring to FIG. 24, in some embodiments, inner subassembly 908 is connected to outer subassembly 912 at support assembly upper end 932. In the illustrated example, fastener conductive portion upper end 936 connected to fastener outer portion upper end 940, whereby the remainder of fastener conductive portion 232 and fastener outer portion 268 are spaced apart. For example, the remainder of fastener conductive portion 232 and fastener outer portion 268 may be spaced apart by space 924. This can help reduce heat transfer between support inner subassembly 908 and support outer subassembly 912, which can lead to enhanced heat transfer efficiency between bowl 104 and base 112 (FIG. 20), and also reduce condensation on support assembly outer surface 928. In some embodiments, an outer spacer (e.g. a gasket) is positioned between fastener conductive portion 232 and fastener outer portion 268 to retain space 924 between the two portions 232 and 268.

Referring to FIG. 21, in some embodiments, the only connection between inner subassembly 908 and outer subassembly 912 is at support assembly upper end 932. This can reduce heat transfer between outer subassembly 912 and inner subassembly 908, and reduce conduction on support assembly outer surface 928 by limiting conductive heat transfer between the subassemblies 912 and 908. This can also reduce stress on outer subassembly 912 that can occur due to thermal expansion or contraction of inner subassembly 908 relative to outer subassembly 912. For example, inner subassembly 908 may be free to thermally expand and contract without interference by outer subassembly 912. Such interference would exert stress upon (and possibly damage) outer subassembly 912. In some embodiments, one or more outer spacers (e.g. gaskets) are positioned between subassemblies 912 and 908 to maintain the space 924 between the subassemblies 912 and 908.

FIGS. 23-27 illustrate a method of making beverage container 100. In FIGS. 23-24, fastener outer portion 268 receives fastener conductive portion 232, and the two portions 232 and 268 are joined at their respective upper ends 940 and 936. As shown, the remainder of fastener conductive portion 232 is spaced apart from fastener outer portion 268 by space 924. Fastener conductive portion 232 can be connected with fastener outer portion 268 in any manner, such as by welds or brazing or adhesive for example.

FIG. 24 shows bowl 104 connected to fastener conductive portion 232. As shown, fastener conductive portion 232 has a fastener upper contact surface 252 shaped to accommodate bowl lower contact surface 256. Optionally, the fit between upper contact surface 252 and bowl lower contact surface 256 may be configured to leave a small gap 944 to accommodate adhesive (e.g. thermal adhesive) at the interface between upper contact 252 and bowl lower contact surface 252. The thermal adhesive bonds bowl 104 to fastener conductive portion 232, and facilitates efficient thermal heat transfer between bowl 104 and fastener conductive portion 232. Optionally, a reflective layer 308 may be applied to bowl lower end 224. For example, reflective layer 308 may be applied to bowl lower contact surface 252 prior to connecting bowl 104 to fastener conductive portion 232.

Still referring to FIG. 24, heat pipe 152 is connected to fastener conductive portion 232. As shown, heat pipe upper end 228 is received in fastener conductive portion 232, whereby fastener conductive portion 232 holds heat pipe 152 in spaced apart relation to fastener outer portion 268. In some embodiments, heat pipe upper end 228 may be positioned to contact bowl lower end 224 whereby heat can directly conduct heat across the interface between heat pipe 152 and bowl 104. Alternatively, heat pipe upper end 228 may be spaced apart from bowl lower end 224 so as to avoid any potential stress upon bowl 104 from thermal expansion or contraction of heat pipe 152.

Heat pipe 152 and fastener conductive portion 232 can be connected in any manner. In some embodiments, heat pipe 152 and fastener conductive portion 232 are adhesively connected. For example, heat pipe 152 and fastener conductive portion 232 may be connected by thermal adhesive, which promotes efficient thermal heat transfer between heat pipe 152 and conductive portion 232. Alternatively or in addition, heat pipe 152 and fastener conductive portion 232 may be connected by welds, and/or a friction fit (e.g. press fit) and/or brazing.

Referring to FIG. 25, stem sleeve 164 is connected to fastener outer portion 268. Stem sleeve 164 can be connected to fastener outer portion 268 in any manner, such as by mating threads, adhesive, brazing or welds for example. When connected to fastener outer portion 268, stem sleeve 164 is spaced apart from heat pipe 152 by space 924. In some embodiments, a spacer (e.g. gasket) is positioned between fastener outer portion 268 and stem sleeve 164 to maintain space 924 between fastener outer portion 268 and stem sleeve 164.

In the illustrated example, stem sleeve upper end 292 is received in fastener outer portion lower end 948. As shown, fastener outer portion lower end 948 includes a fastener collar 288 sized to receive stem sleeve upper end 292, and a stop wall 952 positioned to abut stem sleeve upper end 292 when stem sleeve upper end 292 is received in fastener outer portion lower end 948. Stop wall 952 obstructs stem sleeve upper end 292 to limit the insertion of stem sleeve upper end 292 into outer portion lower end 948 whereby stem sleeve 164 is prevented from making contact with fastener conductive portion 232. As shown, stop wall 952 is positioned below fastener conductive portion 232 and spaced from fastener conductive portion 232 by space 924.

In alternative embodiments, fastener outer portion lower end 948 may be received in stem sleeve upper end 292, or fastener outer portion lower end 948 may abut stem sleeve upper end 292.

Referring to FIG. 26, base outer element 180 is connected to stem sleeve 164. Base outer element 180 can be connected to stem sleeve 164 in any manner, such as by mating threads, adhesive, or welds for example. When connected to fastener outer element 268 (FIG. 25), stem sleeve 164 and base outer element 180 are spaced apart from heat pipe 152 by space 924. In some embodiments, a spacer (e.g. gasket) is positioned between stem sleeve 164 and base outer element 180 to maintain space 924 between stem sleeve 164 and base outer element 180.

In the illustrated example, stem sleeve lower end 216 is received in base outer portion upper end 208. As shown, base outer portion upper end 208 includes a base collar 212 sized to receive stem sleeve lower end 216. Base collar 212 may be a discrete component from the remainder of base outer element 180 as shown, or integrally formed therewith. In the illustrated example, base collar 212 is a discrete component forming base outer portion upper end 208, which is connected to base outer portion lower end 956. This allows base outer portion upper end 208 and base outer portion lower end 956 to be formed of different materials. Preferably, the material of base outer portion upper end 208 and base outer portion lower end 956 have matching coefficients of thermal expansion in order to reduce thermally induced stress or separation at the interface of the two components. For example, base outer portion upper end 208 may be made of metal, such as Kovar™ (a nickel-cobalt ferrous alloy), and outer portion lower end 956 may be made of glass, such as borosilicate glass. The metal base outer portion upper end 208 can provide enhanced strength to the juncture between stem 108 and base 112, which is subject to pronounced mechanical stresses during use.

Base outer portion lower end 956 can be connected to base outer portion upper end 208 in any manner, such as by mating threads, adhesive, or welds for example. In the illustrated embodiment, base collar 212 includes a lower shoulder 960 that abuts base outer portion lower end 956 when the two components are connected.

Referring to FIG. 27, base conductive element 176 is connected to heat pipe lower end 226. Base conductive element 176 can be connected to heat pipe lower end 226 in any manner, such as by adhesive (e.g. thermal adhesive), soldering, brazing or welds. As shown, base conductive element 176 is spaced apart from base outer element 180 by space 924. In some embodiments, a spacer (e.g. gasket) is positioned between base conductive element 176 and base outer element 180 to maintain space 924 between base conductive element 176 and base outer element 180.

Referring to FIG. 20, in some embodiments, support assembly outer surface 928 is hydrophobic. For example, support outer subassembly 912 may include a hydrophobic material defining support assembly outer surface 928, or a hydrophobic coating may be applied to support assembly outer surface 928. This can allow condensation that may form on support assembly outer surface 928 to shed by flowing downwardly to the coaster or table below, instead of transferring to a user's hands when beverage container 100 is grasped by support assembly 904.

FIG. 28 shows another embodiment of beverage container 100, in which at least a portion of space 924 is hermetically sealed. The hermetically sealed portion of space 924 may be substantially evacuated of gas, or filled with a thermally insulating gas (e.g. a monatomic gas such as argon, krypton and xenon). For example, space 924 within stem 108 may be hermetically sealed. This can further reduce heat transfer between support assembly outer surface 928 (e.g. stem sleeve outer surface 964) and heat pipe 152, and thereby further reduce condensation formation on support assembly outer surface 928, and further improve the thermal efficiency of heat transfer between bowl 104 and base 112.

FIGS. 29-33 illustrate steps in a method of making beverage container 100. Referring to FIG. 29, base collar 212, stem sleeve 164, fastener outer portion 268 and fastener conductive portion 232 are connected. These components can be connected in any manner, such as by mating threads, adhesive, welds, or integrally forming two or more of these components. In some embodiments, one or more (or all) of base collar 212, stem sleeve 164, and fastener outer portion 268 are made of metal (e.g. stainless steel 420). This can provide these components with enhanced strength to support a hard vacuum when space 924 (FIG. 28) is evacuated. Metallic components can also be relatively thinner and lighter than the same components formed of glass. In the illustrated example, metallic fastener portion 268 is welded at 976 to metallic fastener portion 232, and metallic fastener portion 268 is welded at 980 to metallic stem sleeve 164. The joint between fastener portions 268 and 232 at support assembly upper end 932 forms a gas tight seal for containing a thermally insulating gas or vacuum in space 924.

As shown in FIG. 30, a heat pipe shell 968 which is sealed at heat pipe upper end 228 and open (i.e. unsealed) at heat pipe lower end 226 is inserted into fastener conductive portion 232. FIG. 31 illustrates joining heat pipe shell upper end 228 to fastener conductive portion 232. For example, heat pipe shell upper end 228 may be brazed to fastener conductive portion 232 using brazing material 972. Alternatively, heat pipe shell upper end 228 may be welded to fastener conductive portion 232. Because heat pipe shell 968 is not sealed with working fluid, the heat pipe is prevented from heat damage (e.g. bursting from high internal pressure) caused by the heat of the welding or brazing operations. The joint between heat pipe shell upper end 228 and fastener conductive portion 232 (e.g. by brazing or welding) forms a gas tight seal for containing a thermally insulating gas or vacuum in space 924.

In alternative embodiments, a complete heat pipe (e.g. sealed with working fluid) is connected to fastener conductive portion 232. For example, the heat pipe may be sufficiently robust to withstand the heat of welding or brazing, or a low temperature joining method (e.g. thermal adhesive) may be employed.

Referring to FIG. 32, lower end 226 of heat pipe shell 968 is joined to stem sleeve lower end 216. The joint between lower end 216 and 226 completes the hermetic seal of space 924. In some embodiments, space 924 is filled with a thermally insulating gas prior to sealing lower ends 216 and 226. In some embodiments, space 924 is substantially evacuated of gas prior to sealing lower ends 216 and 226. For example, lower ends 216 and 226 may be sealed in a hard vacuum environment of a vacuum chamber. In this way, a vacuum insulated stem 108 can be formed.

Lower ends 216 and 226 of stem sleeve 164 and heat pipe shell 968 can be joined in any manner that can form a robust hermetic seal. In the illustrated example, lower ends 216 and 226 are brazed together with brazing material 984. For example, the brazing material 984 may be formed as a ring which slips over heat pipe shell lower end 226 and slides upwardly to between stem sleeve 164 and heat pipe shell 968. Alternatively, heat pipe lower end 226 may be welded to stem sleeve lower end 216. Because heat pipe shell 968 is not sealed with working fluid, the heat pipe is prevented from heat damage (e.g. bursting from high internal pressure) caused by the heat of the welding or brazing operations. In alternative embodiments, a complete heat pipe (e.g. sealed with working fluid) is employed instead of an empty shell 968, as noted above.

In some embodiments, space 924 may be hermetically sealed in a single step. For example, the acts referred to above with reference to FIGS. 31 and 32 may be performed sequentially or simultaneously while the stem is continuously positioned inside a vacuum chamber (e.g. without removing the stem from the vacuum chamber between joining steps). For example, brazing with brazing materials 972 and 984 may occur substantially simultaneously by heating the stem (including both brazing materials 972 and 984 in position as described above) in an oven (e.g. a vacuum oven).

Referring to FIG. 33, heat pipe shell 968 is charged with working fluid, evacuated, and sealed according to known methods of making heat pipes. Referring to FIG. 28, base outer portion lower end 956 is connected to base collar 212, base conductive portion 176 is connected to heat pipe 152, and bowl 104 is mounted atop support assembly 904 (e.g. connected to fastener conductive portion 232).

Referring to FIG. 34, in some embodiments, stem sleeve lower end 216 is hermetically sealed to base outer portion 180, and base outer portion 180 is hermetically sealed to heat pipe lower end 226 to complete the hermetic seal of space 924. The hermetic seals can be formed in any manner, such as by adhesive, welds, soldering, brazing, or integrally forming the two parts for example. As shown, base collar 212 includes an upper shoulder 988 that seats heat pipe lower end 226. Base outer portion 180 is also shown including an inward projection 992 where base outer portion 180 and heat pipe lower end 226 are hermetically sealed. As shown, inward projection 992 helps locate heat pipe 152 and maintain space 924 between heat pipe 152 and the other stem and base components. As shown, heat pipe lower end 226 may not be sealed to stem sleeve lower end 216.

Referring to FIGS. 27 and 34, base lower contact surface 184 can be flush with base lower end 168 as shown (e.g. flush with horizontal supporting plane 172), or protrude below base insulative element 180. Alternatively, as shown in FIG. 35, base lower contact surface 184 may be recessed from base lower end 168 (e.g. recessed from horizontal supporting plane 172). This can help prevent wetting supporting surfaces with condensation. In some cases, base conductive element 176 may be very cold (e.g. around 4° C. or less) due to contact with a heat sink or due to thermal coupling between conductive element 176 and the bowl 104 (FIGS. 21 and 28) containing a cold beverage. Ambient air that contacts the cold base lower contact surface 184 may produce condensation. A user may place beverage container 100 (FIGS. 21 and 28) on a horizontal surface without a heat sink. By recessing base lower contact surface 184, the condensation formed thereon may be held spaced apart from the horizontal surface (e.g. table) below.

Reference is now made to FIGS. 36-37 which show a beverage container 100 in accordance with another embodiment. As shown, beverage container 100 includes a bowl 104, a fastener 220, a stem 108, a heat pipe 152, and a base 112. Fastener 220, stem 108, heat pipe 152, and base 112 are collectively referred to as a support assembly 1004. As shown, support assembly 1004 carries bowl 104 which is connected to fastener 220, and provides for efficient heat transfer between bowl 104 and base 112 (e.g. to a heat sink below).

Figure 38C:
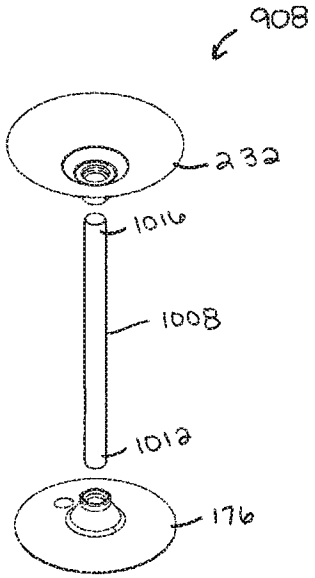

Turning to FIG. 37, support assembly 1004 may include an inner subassembly 908 (FIG. 38C) and an outer subassembly 912 (FIG. 38B). Inner subassembly 904 includes heat conductive elements that collectively form a thermal transfer pathway from fastener 220 to base 112 plus a heat pipe sleeve 1008. Outer subassembly 912 is sized to surround inner subassembly 908. Between 90-99.9% of inner subassembly outer surface 916 may be spaced apart from outer subassembly inner surface 920 by a space 924 (FIG. 36; e.g. filled with a gas such as air or a thermally insulating gas, or else substantially evacuated of gas). This allows outer subassembly 912 to insulate inner subassembly 908 from external sources of heat (e.g. the environment and user's hands), and also to reduce condensation formation on support assembly outer surface 928.

Figure 38E:
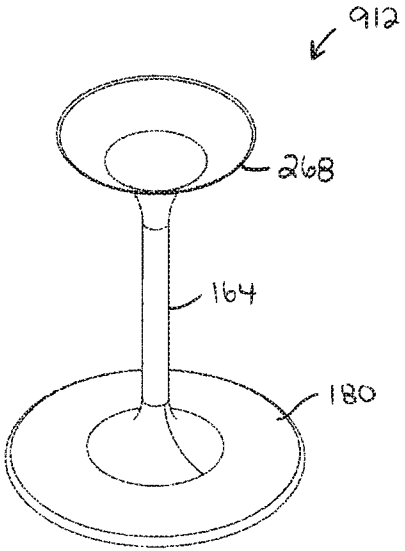

FIG. 38C shows an exemplary inner subassembly 908 (except for heat pipe 152, which is shown added in FIG. 38E). Inner subassembly 908 may include fastener conductive portion 232, heat pipe 152, heat pipe sleeve 1008, and base conductive element 176. Heat pipe 152 (FIG. 38E) thermally couples fastener conductive portion 232 to base conductive element 176. Heat pipe sleeve 1008 may have a lower end 1012 connected to base conductive element 176, and an upper end 1016 connected to fastener conductive portion 232. Heat pipe sleeve 1008 may be connected to base conductive element 176 and fastener conductive portion 232 in any manner, such by welding, brazing, or adhesive for example.

As shown in FIG. 37, heat pipe sleeve 1008 may be formed as a hollow tube that receives heat pipe 152. In some embodiments, heat pipe sleeve 1008 is sized and positioned to be spaced apart from heat pipe 152 so that a gas space separates heat pipe 152 from heat pipe sleeve 1008. The gas space may reduce at least heat conduction between heat pipe sleeve 1008 and heat pipe 152, which can promote better heat transfer efficiency by heat pipe 152 between bowl 104 and base conductive element 176.

In other embodiment heat pipe sleeve 1008 may be positioned in contact with heat pipe 152. This can allow heat pipe sleeve 1008 to provide the inner wall of a hermetically sealed space 924, which in turn can provide insulation for heat pipe 152.

Heat pipe sleeve 1008 may be made of any material, such as plastic, glass, ceramic, or metal. In some embodiments, heat pipe sleeve 1008 is rigid to contribute to the structural integrity of support assembly 1004. For example, heat pipe sleeve 1008 may be a rigid steel (e.g. stainless steel) tube. As shown in FIG. 39, heat pipe sleeve upper end 1016 may be received in fastener conductive portion 232. As shown in FIG. 40, heat pipe sleeve lower end 1012 may be received in base conductive element 176.

Figure 38A:
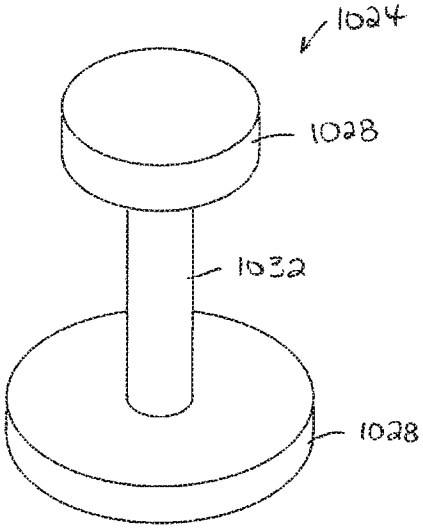
Figure 38E:
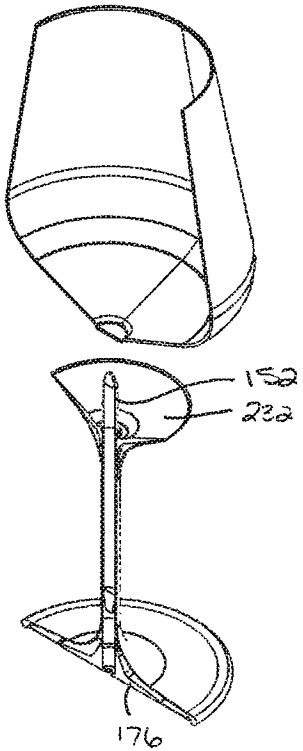
Figure 38D:
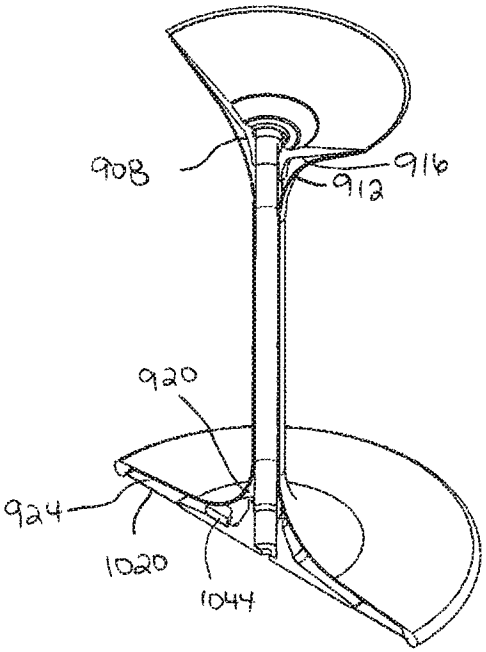

FIG. 38B shows an exemplary outer subassembly 912 including fastener outer portion 268, stem sleeve 164, base outer element 180, and base lower cover 1020 (FIG. 38D). Referring to FIG. 36, except for one or more discrete connection points, each of fastener conductive portion 232, heat pipe 152, heat pipe sleeve 1008, and base conductive element 176 are spaced apart from each of fastener outer portion 268, stem sleeve 164, base outer element 180, and base lower cover 1020.

Outer subassembly 912 may be formed of discrete elements (e.g. separately formed fastener outer portion 268, stem sleeve 164, and base outer element 180) that are connected together. In other embodiments, outer subassembly 912 may be integrally formed (base lower cover 1020), such as by machining or molding. FIGS. 38A-38B illustrate integrally forming outer subassembly 912 by machining a blank 1024. As shown, blank 1024 may be a 'dumbbell' blank that provides a primitive base shape for the machining operation. Dumbbell blank 1024 may include upper and lower pucks 1028 that are friction welded to either ends of a bar 1032. In some embodiments, blank 1024 is a metal blank, such as a steel blank (e.g. stainless steel blank).

FIG. 38D illustrates inner subassembly 908 joined to outer subassembly 912. Referring to FIG. 39, in some embodiments, inner subassembly 908 is connected to outer subassembly 912 at support assembly upper end 932. In the illustrated example, fastener conductive portion upper end 936 is connected to fastener outer portion upper end 940, whereby the remainder of fastener conductive portion 232 and fastener outer portion 268 are spaced apart. For example, the remainder of fastener conductive portion 232 and fastener outer portion 268 may be spaced apart by space 924. This can help reduce heat transfer between support inner subassembly 908 and support outer subassembly 912, which can lead to enhanced heat transfer efficiency between bowl 104 and base 112 (FIG. 36), and also reduce condensation on support assembly outer surface 928.

Turning to FIG. 40, base conductive element 176 may be spaced apart from base outer element 180. Base lower cover 1020 may join base conductive element 176 and base outer element 180 to seal space 924. Prior to sealing, space 924 may be filled with a gas such as air or thermally insulating gas, or else substantially evacuated of gas. Consequently, insulating space 924 may extend from base lower end 168 to fastener upper end 940 (FIG. 39), thereby providing gas or vacuum insulation from end to end of support assembly 1004.

Base lower cover 1020 can have any configuration that can join base conductive element 176 to base outer element 180. As shown, base lower cover 1020 may be formed as an annular disc having a radially inner end 1036 connected to base conductive element 176, and a radially outer end 1040 connected to base outer element 180. Base lower cover 1020 may be formed of any material, such as for example plastic, glass, ceramic, or metal. In some embodiments, base lower cover 1020 may be made of steel (e.g. stainless steel foil) that is welded, braised, or adhesively connected to base elements 176 and 180.

Referring to FIG. 38D, in some embodiments beverage container 100 includes a getter 1044 positioned within space 924. Getter 1044 may be any substance suitable for scavenging unwanted gases from space 924. Where space 924 is substantially evacuated of gas, getter 1044 can help maintain vacuum pressure within space 924. Where space 924 is filled with a particular gas (e.g a thermally insulating gas such as a monatomic gas such as argon, krypton or xenon), getter 1044 may help preserve the gas composition in space 924 against dilution by the unwanted gas.

Some or all of outer subassembly 912 may be made of a material that is permeable to one or more unwanted gases. For example, stainless steel has some permeability to nitrogen gas, such that over time nitrogen gas can pass through a stainless steel outer subassembly 912 into space 924. In some embodiments, getter 1044 is a substance that scavenges at least a gas to which outer subassembly 912 is permeable. For example, outer subassembly 912 may be made of a material (e.g. stainless steel) permeable to nitrogen, and getter 1044 may include a substance that scavenges nitrogen (e.g. titanium, barium, cerium, or lanthanum).

Getter 1044 may be placed within space 924 as a pellet as shown, a foil wrap, or a coating (e.g. applied to one of inner subassembly outer surface 916 and outer subassembly inner surface 920). Getter 1044 may scavenge gas by one or more (or all) of adsorption (i.e. accumulation of unwanted gas molecules on the getter surface), absorption (i.e. diffusion of unwanted gas molecules within the getter), or chemical binding (i.e. reaction of the gas molecules with atoms of the getter).

Reference is now made to FIGS. 41-43, which show a support assembly 1004 in accordance with another embodiment. The embodiment shown is similar to the embodiment of FIGS. 36-40, except for the configuration of inner subassembly 908. As shown, inner subassembly 908 includes fastener conductive portion 232, heat pipe 152, and base conductive element 176. In this embodiment, a heat pipe sleeve does not surround heat pipe 152. This may permit heat pipe 152 to have a relatively greater diameter 1048 and therefore transfer heat more efficiently.

Heat pipe 152 has an upper end 228 is thermally connected to fastener conductive portion 232, and heat pipe lower end 226 is thermally connected to base conductive element 176 so that heat pipe 152 can efficiently transfer heat between fastener conductive portion 232 and base conductive element 176. Heat pipe 152 may be connected to fastener conductive portion 232 and heat pipe lower end 226 in any manner. For example, heat pipe 152 may be brazed to fastener conductive portion 232 and base conductive element 176 with brazing material 972 (FIG. 44), 984 (FIG. 45) respectively.

In some embodiments, heat pipe 152 may include a stainless steel outer wall with a nickel powder wick and methanol (and/or water) working fluid.

Reference is now made to FIGS. 10A and 10B, which shows a glass beverage container 400 in accordance with an embodiment. As shown, glass beverage container 400 is a stemless beverage container (e.g. a pitcher, decanter, or carafe), which includes a glass body 402 having a bottom 404 at lower end 408, and a sidewall 412 which extends from bottom 404 to upper end 416. Glass beverage container 400 is made of glass, such as silica-glass, lead crystal, or non-lead crystal for example, and not plastic. For beverage container 400, the benefits of glass over plastic include better transparency (e.g. for beverage visibility), better scratch resistance (e.g. for prolonged transparency), better heat resistance (e.g. for high temperature cleaning), lower porosity (e.g. for stain resistance), better hand and mouth-feel, and lower toxicity (e.g. release of potentially harmful chemicals).

As shown, bottom 404 and sidewall 412 define a liquid chamber 420 for holding a beverage 424, and an upper opening 428 at upper end 416 for discharging the contained beverage 424 (e.g. for consumption). Similar to stemmed beverage containers, stemless beverage containers also receive heat from the environment and users' hands, which can raise the beverage temperature well above the suggested drinking temperature of the contained beverage, which can lead to a sub-optimal, unpleasant or even offensive taste.

Glass beverage container 400 is configured to efficiently transfer heat away from a contained beverage 424 to a heat sink 128 (FIG. 1) below. The heat transferred away from beverage 424 to the heat sink can help to mitigate the heat gained from users' hands and the environment. This can help maintain beverage 424 at or near the suggested drinking temperature for an extended period. In the illustrated example, glass beverage container 400 includes a conductive slug 436 connected to bottom 404 and thermally coupled to inner surface 440. Conductive slug 436 includes an exposed lower contact surface 444 for thermal coupling to a heat sink. Slug upper surface 446 is in direct or close contact (e.g. connected by thermal adhesive, or similar) with bottom 404 to allow efficient heat transfer between bottom 404 and conductive slug 436.

Conductive slug 436 can be made of any material having a thermal conductivity greater than the glass material of body 402. For example, the slug material of conductive slug 436 may have a thermal conductivity similar to or greater than most common metals. This can allow conductive slug 436 to efficiently transmit heat between a heat sink below and body 402. For example, the slug material of conductive slug 436 may have a thermal conductivity of at least about 10 W/(m K) at 20° C.

Referring to FIG. 10B, container lower end 448 may be defined by one or both of bottom 404 and conductive slug 436. For example, one or both of bottom outer surface 452 and slug lower contact surface 444 may define a horizontal supporting plane 432 for supporting glass beverage container 400 on a horizontal surface (e.g. tabletop). In some embodiments, slug lower contact surface 444 is flush with container lower end 448 (e.g. flush with horizontal supporting plane 432). This can allow slug lower contact surface 444 to make contact with any cold object below for greater heat sink compatibility. For example, slug lower contact surface 444 may be flush with bottom lower surface 452 as shown, or protrude below bottom lower surface 452.

Alternatively, slug lower contact surface 444 may be recessed from bottom outer surface 452 (e.g. recessed from horizontal supporting plane 432) as shown in FIGS. 10C-10E. This can help prevent wetting supporting surfaces with condensation. In some cases, conductive slug 436 may be very cold (e.g. around 4° C. or less, such as −20° C. to 4° C.) due to contact with a heat sink or due to the thermal coupling between conductive slug 436 and body 402 containing a cold beverage 424. Ambient air that contacts the cold slug lower contact surface 444 may produce condensation. After removal from the heat sink a user may place beverage container 400 on a horizontal surface without a heat sink. By recessing slug lower contact surface 444, the condensation formed thereon may be held spaced apart from the horizontal surface (e.g. table) below.

Conductive slug 436 can have any size. As shown, bottom 404 may extend radially outwardly of conductive slug 436. For example, bottom width 456 may be greater than conductive slug width 460. This can provide container lower end 448 with a greater footprint for better stability, without unduly enlarging conductive slug 436, and allow slug lower contact surface 444 to be recessed from bottom outer surface 452 (e.g. allow conductive slug 436 to be embedded into bottom 404). Alternatively, conductive slug width 460 may be equal to or greater than bottom width 456. This can provide conductive slug 436 with a larger slug lower contact surface 444 for more efficient thermal coupling with a heat sink below. FIGS. 10C-10E show examples of conductive slug 436 having a slug lower contact surface 444 of different sizes.

Referring to FIG. 10C, conductive slug 436 can have any shape. In the illustrated example, conductive slug 436 has a convex shape when viewed from inside liquid chamber 420. This can increase the contact area between conductive slug 436 and glass bottom 404. For example, slug upper end 468 may be positioned above a portion of inner surface 440. As shown, glass bottom 404 may have a convex portion 464 that conforms to the convex shape of conductive slug 436. This can promote natural convective mixing to occur whereby cooler volumes of beverage 424 roll down and away from the sloped walls of the convex portion 464. This natural convective mixing may improve heat transfer efficiency and promote faster aeration of beverage 424. In other embodiments, conductive slug may be circular, triangular, rectangular, or another regular or irregular shape.

Body 402 can have any shape. For example, body 402 is shown having a substantially circular horizontal cross-section and a vertical cross-section that tapers upwardly. In other embodiments, body 402 can have a horizontal cross-section that is triangular, rectangular, or another regular or irregular shape. Similarly body 402 can have a vertical cross-section that has substantially constant width throughout, widens upwardly, or includes both tapering and widening portions. Body 402 can be any size suitable for holding a volume of beverage. For example, liquid chamber 420 defined by body 402 may have a volume of between 30 mL (e.g. for a shot glass size) and 3L (e.g. for a carafe).

Reference is now made to FIG. 11, which shows a heat transfer pad 500 in accordance with an embodiment. Heat transfer pad 500 can allow a first beverage container 504 to act as a heat sink (or source) for a second beverage container 508. For example, heat transfer pad 500 can be used with any of the beverage containers disclosed herein (e.g. beverage containers 100, 400, 700, or 800) or another beverage container to help maintain the beverage inside at or near a suggested drinking temperature. This can be convenient in the context of dining (e.g. at home or at a restaurant) where it is customary to serve both a glass of ice water (e.g. having a temperature of less than 10° C.) and a glass of wine, beer, or other flavored beverage. In this case, heat transfer pad 500 can allow the glass of cold water to act as the heat sink for the flavored beverage. In general, the water at the bottom of a glass of ice water will have a temperature near 4° C., water being densest at that temperature. This avoids use of additional equipment to provide a heat sink (e.g. frozen cold pack) which would require chilling (e.g. in a refrigerator or freezer), transportation (e.g. carriage to the table), and storage (e.g. occupying space in the refrigerator or freezer)

of the heat sink or Peltier cooler which would require a source of electricity. Further, in the context of heat transfer pad 500, restoring a depleted (e.g. warmed) heat sink is as simple as refilling the glass of ice water with additional ice, which is already routine behavior in dining contexts. Thus, use of heat transfer pad 500 does not impose significant additional work or change in behavior, which can make heat transfer pad 500 easy for users (e.g. restaurants and homes) to adopt.

Reference is now made to FIG. 12. As shown, a heat transfer pad 500 includes a body 502, which houses a first beverage container support 512 spaced apart from a second beverage container support 516 and a thermal bridge 544 that thermally couples the first and second beverage container supports 512 and 516. First beverage container support includes a first thermally conductive portion 520, and second beverage container support includes a second thermally conductive portion 524. Beverage container supports 512 and 516 include exposed support upper surfaces 528 and 532 respectively, that provide support for a beverage container 504 or 508 (FIG. 11) seated on beverage container supports 512 and 516. Thermally conductive portions 520 and 524 include exposed upper contact surfaces 536 and 540 respectively, which make physical contact with a beverage container seated on beverage container supports 512 and 516.

Upper contact surface 536 and 540 may constitute a portion of support upper surface 528 and 532 respectively. For example, one or both of support upper surfaces 528 and 532 may extend outwardly of upper contact surface 536 and 540 respectively. This can provide an enlarged area for support upper surface 528 and 532 for greater stability without unduly enlarging thermally conductive portion 520 and 524. Alternatively, upper contact surface 536 and 540 may constitute the entirety of their respective support upper surface 528 and 532. This can provide an enlarged upper contact surface 536 and 540 for enhanced thermal transfer efficiency with a supported beverage container.

Still referring to FIG. 12, first thermally conductive portion 520 is spaced apart from and thermally coupled to second thermally conductive portion 524. As shown, insulated body 502 houses a thermal bridge 544 which thermally couples the first and second heat transfer portions 520 and 524. This allows thermal bridge 544 to transfer heat between the first and second thermally conductive portions 520 and 524 so that a first beverage container 504 (FIG. 1) can act as a heat sink to draw heat away from a second beverage container 508 (FIG. 1). In the illustrated example, thermal bridge 544 includes a first bridge end 548 thermally coupled to first thermally conductive portion 520 and a second bridge end 552 thermally coupled to second thermally conductive portion 524. In some embodiments, thermal bridge 544 has no exposed surfaces. For example, all exterior surfaces of thermal bridge 544 may be covered by body 502 and/or beverage container supports 512 and 516. This can help insulate thermal bridge 544 to improve the heat transfer efficiency across thermal bridge 544 between first and second thermally conductive portions 520 and 524. In the illustrated embodiment, thermal bridge 544 is embedded in insulated body 502.

Insulated body 502 houses first and second beverage container supports 512 and 516 in spaced apart relation. This can allow insulated body 502 to thermally insulate first and second beverage container supports 512 from heat transfer with the environment. In turn, this can improve the heat transfer efficiency of first and second beverage container supports 512 and 516 with each other across thermal bridge 544. In the illustrated example, insulated body 502 underlies first and second thermally conductive portions 520 and 524. This can help insulate thermally conductive portions 520 from a horizontal surface (e.g. tabletop) below. In turn, this can help reduce the formation of condensation on pad lower surface 556 which rests on a horizontal surface (e.g. tabletop).

Thermally conductive portions 520 and 524 can be made of any material suitable for efficiently exchanging heat with a beverage container seated on beverage container supports 512 and 516 respectively. In some embodiments, thermally conductive portions 520 and 524 may have a thermal conductivity similar to or greater than most common metals. For example, the material of thermally conductive portions 520 and 524 may have a thermal conductivity of at least about 10 W/(m K) at 20° C. Thermally conductive portions 520 and 524 may be made entirely of rigid materials (e.g. metal, such as aluminum, copper, or steel), may include captive liquid materials (e.g. thermally conductive gel inside a bladder), or may include heat pipes.

Insulated body 502 can be made of any material having a thermal conductivity less than that of thermally conductive portions 520 and 524. For example, insulated body 502 may include plastic, ceramic, glass, wood, cork, rubber, or silicone. In some embodiments, the material of insulated body 502 has a thermal conductivity of less than about 3 W/(m K).

Thermal bridge 544 can be any device that can efficiently exchange heat between first and second thermally conductive portions 520 and 524. In the illustrated embodiment, thermal bridge 544 is a length of thermally conductive material, such as metal or thermal gel for example. Alternatively or in addition, thermal bridge 544 may include a heat pipe 560 as shown in FIG. 13.

Still referring to FIG. 12, support upper surfaces 528 and 532 can have any size large enough to provide stable support for a beverage container (e.g. 30 mL to 3L beverage container) seated thereon in an upright orientation. For example, support upper surfaces 528 and 532 may have support upper surface diameters 564 and 568 respectively, of between 2 cm and 20 cm. Support upper surfaces 528 and 532 may have the same size (e.g. same support upper surface diameters 564 and 568), or different sizes. For example, first support upper surface 528 may be larger than second support upper surface 532. This may allow first support upper surface 528 to support a larger beverage container (e.g. carafe of ice water) than second support upper surface 532, which may be sized for a personal sized beverage container (e.g. 30 mL to 1L). In turn, this can allow for a larger first beverage container having greater thermal capacity, leading to prolonged utility as a heat sink for the second beverage container.

An upper contact surface 536 or 540 may protrude upwardly. This can allow the upper contact surface 536 or 540 to make physical contact with a recessed contact surface of a beverage container (e.g. beverage container 100 or 400) supported thereon. Alternatively, an upper contact surface 536 or 540 may not be upwardly protruding. For example, upper contact surface 536 or 540 may be level with or recessed into insulating body 502. A level or protruding upper contact surface 536 or 540 may have best compatibility to make thermal contact with a wide variety of beverage containers. A recessed upper contact surface 536 or 540 can help contain any condensation that may form on upper contact surface 536 or 540 from spilling off of heat transfer pad 500 (e.g. on to the tabletop).

In some embodiments, one or both of thermally conductive portions 520 and 524 is removably connected to insulated body 502. This can allow thermally conductive portions 520 and 524 to be removed and replaced with a thermally conductive portion 520 or 524 of a different size, shape, or material. In turn, this can affect the heat transfer efficiency between a beverage container thermally coupled to thermally conductive portions 520 or 524. It will be appreciated that a size, shape, and material providing greater heat transfer efficiency may be selected to achieve greater heat transfer between the first and second beverage containers 504 and 508 (FIG. 11), and thereby promote a lower temperature for second beverage 572 (e.g. for white wine), and vice versa (e.g. for red wine). In some embodiments, heat transfer pad 500 is provided with a selection of extra thermally conductive portions 520 and/or 524 having different sizes, shapes, and/or materials. Alternatively, first and second thermally conductive portions 520 and 524 may be permanently connected (i.e. non-removable without destructive force) to insulated body 502.

Referring to FIG. 14, heat transfer pad 500 can include a plurality of second beverage container supports 516. For example, a large beverage container (e.g. carafe of ice water) may be supported on first beverage container support 512 in the center of a table, and a plurality of second beverage containers (e.g. a glass of wine for each guest at the table) may be supported on second beverage container supports 516. In the illustrated example, heat transfer pad 500 includes a plurality of second beverage container supports 516, and each second beverage container support 516 is connected to first beverage container support 512 by insulated body 502. Heat transfer pad 500 also includes a plurality of thermal bridges 544 that collectively thermally couple each of the plurality of second thermally conductive portions 524 to the first thermally conductive portion 520. For example, heat transfer pad 500 may include a thermal bridge 544 for each second thermally conductive portion 524, which thermally couples that second thermally conductive portion 524 to first thermally conductive portion 520.

In some embodiments, second beverage container supports 516 may be arranged surrounding first beverage container support 512, as shown. This can allow heat transfer pad 500 to be placed in the center of a tabletop so that second beverage container supports 516 can support the beverage containers of different users seated or standing around the table. In the illustrated example, second beverage container supports 516 are arranged concentrically around first beverage container support 512. Second beverage container supports 516 may be evenly or unevenly distributed around first beverage container support 512. Further, second beverage container supports 516 may be equally or differently spaced apart from first beverage container support 512 (e.g. to accommodate an oblong or rectangular table). FIG. 15 shows an example of heat transfer pad 500 including a plurality of second beverage container supports 516 arranged substantially linearly with first beverage container support 512. The second thermally conductive portions 524 of the second beverage container supports 516 can all have the same thermal conductivity, or one or more (or all) of the second beverage container supports 516 can have a different thermal conductivity than one or more (or all) of the other second beverage container supports 516. The latter case can allow different second beverage container supports 516 to provide different heat transfer rates to promote different beverage temperatures.

FIG. 15 also exemplifies that a plurality of second beverage container supports 516 can be thermally arranged in series. That is one or more thermal bridges 544 may form a thermal transfer pathway along which the plurality of second beverage container supports 516 is thermally connected. In the illustrated example, heat transfer pad 500 includes a thermal bridge 544 having a first bridge end 548 thermally coupled to first beverage container support 512 and a second bridge end 552 thermally coupled to second beverage container support 516*a*. Another second beverage container support 516*b* is shown thermally coupled to thermal bridge 544 intermediate the first and second bridge ends 548 and 552 (e.g. between the first and second beverage container supports 512 and 516*a*). This can allow for different heat transfer efficiencies between the first beverage container support 512 and each second beverage container support 516*a* and 516*b*. In turn this can allow second beverage container supports 516*a* and 516*b* to seat second beverage containers 508*a* and 508*b* containing second beverages 572*a* and 572*b* having different suggested drinking temperatures (e.g. sparkling water and red wine) to be cooled at different rates.

FIG. 15 also exemplifies that insulated body 502 may have any size. In the illustrated embodiment, insulated body 502 includes a body upper surface 576 sized to function as a dining placemat. For example, upper surface 576 may be sized to support at least a standard dining plate. In some examples, body upper surface 576 may have an area of at least 400 $cm^2$. As shown, first and second beverage container supports 512 and 516 may be positioned proximate body perimeter 580 (i.e. closer to body perimeter 580 than to body centerline 584) so as not to obstruct placement of dishes on body upper surface 576.

FIG. 11 illustrates an embodiment of a beverage heat transfer system 600. The system 600 includes heat transfer pad 500 and at least one beverage container 504 or 508, which may be any beverage container disclosed here (e.g. beverage container 100 or 400 described above, or beverage container 700 described below), or another beverage container.

FIGS. 16-17 show a beverage container 700 in accordance with another embodiment. Beverage container 700 includes double-wall insulated sidewalls and a thermally conductive base. This can allow beverage container 700 to insulate a cold beverage (e.g. ice water) inside from ambient heat, while permitting beverage container 700 to transfer heat efficiently through the conductive base. In turn, this can make beverage container 700 well suited for use as a first beverage container 504 to be thermally coupled to first beverage container support 512 of heat transfer pad 500 (FIG. 11). The double-wall insulation of at least the sidewalls of beverage container 700 can allow prolonged usage as a heat sink for another beverage container.

As shown, beverage container 700 includes a conductive bottom 704 and a double-wall insulated sidewall 708 extending upwardly from bottom 704 to container upper end 712. Conductive bottom 704 and sidewall 708 include an inner surface 716 and 720 respectively. Inner surfaces 716 and 720 together define a liquid chamber 724 having an upper opening 728. In use, beverage 732 inside liquid chamber 724 can be dispensed through chamber opening 728 (e.g. for consumption).

A traditional vacuum insulated beverage container is vacuum insulated on the bottom and all sides to mitigate any heat transfer with the beverage inside, so that the temperature of the beverage inside can be maintained for as long as possible. In contrast, beverage container 700 includes vacuum insulated sidewalls 708 and a conductive bottom 704 so that heat transfer with beverage 732 occurs preferentially through bottom 704. The vacuum insulated sidewalls 708 insulate the beverage 732 against wasteful heat exchange with the environment.

Still referring to FIGS. 16-17, sidewalls 720 include an inside wall 736 and an outside wall 740. Inside wall 736 includes sidewall inner surface 720 that defines a portion of liquid chamber 724. Outside wall 736 includes a sidewall outer surface 748 that may be exposed to the environment. Some or all of inside wall 736 is spaced apart from outside wall 740 to define a space 744 in between. The space 744 may be hermetically sealed to hold a volume of gas, such as air, or a noble gas. In some embodiments, space 744 is partially or substantially evacuated of gas (e.g. having a pressure below atmospheric). Space 744 greatly reduces heat transfer between outside wall 740 and inside wall 736. This helps to mitigate heat transfer between the environment and beverage 732 inside.

Conductive bottom 704 can have any structure that promotes heat transfer between bottom inner surface 716 and exposed bottom outer surface 752. In some embodiments, conductive bottom 704 may include one or more layers of conductive materials which collectively provide direct thermal conduction between bottom inner surface 716 and bottom outer surface 752. For example, conductive bottom 704 may include a single metal layer 756 or a plurality of stacked metal layers in direct contact with each other or a plurality of stacked metal layers diffusion welded with each other. Accordingly, at least a portion of conductive bottom 704 is free of insulation, air spaces, or vacuum spaces. Preferably, conductive bottom 704 defines a thermal path between bottom inner surface 716 and bottom outer surface 752 having a conductivity similar to or greater than most common metals (e.g. about 10 W/(m K) at 20° C. or greater). In the illustrated example, conductive bottom 704 includes a single metal layer 756 that includes bottom inner surface 716 and exposed bottom outer surface 752.

FIGS. 18-19 show a beverage container 800 in accordance with another embodiment. Beverage container 800 is similar to beverage container 700, except for example that the sidewalls of beverage container 800 are not double-wall insulated. Instead, beverage container sidewalls may be made of a single layer of glass, which can provide a simpler construction (compared with a double-wall insulated sidewall), adequate thermal insulation, and a hand and mouth feel that users are accustomed to. Other benefits of glass over, e.g. plastic, are described above.

Referring to FIG. 19, beverage container 800 includes a conductive bottom 804 and a single-wall insulated sidewall 808 extending upwardly from bottom 804 to container upper end 812. Conductive bottom 804 and sidewall 808 include an inner surface 816 and 820 respectively. Inner surfaces 816 and 820 together define a liquid chamber 824 having an upper opening 828. In use, beverage 832 (FIG. 18) inside liquid chamber 824 can be dispensed through chamber opening 828 (e.g. for consumption).

In the illustrated example, sidewall 808 is made of glass. For example, sidewall 808 may be made of transparent borosilicate glass walls. The borosilicate glass can have any composition. In some examples, the composition of the borosilicate glass, in percent by weight on the basis of oxide content, may be about 19% $B_2O_3$; 8% $Al_2O_3$; 2% $Na_2O$; 3% $K_2O_2$; K 3% BaO; 1% LiF; and the balance $SiO_2$. As shown, sidewall 808 may be rigidly connected to conductive bottom 804.

Conductive bottom 804 can have any structure that promotes heat transfer between bottom inner surface 816 and exposed bottom outer surface 852. In some embodiments, conductive bottom 804 may include one or more layers of conductive materials which collectively provide direct thermal conduction between bottom inner surface 816 and bottom outer surface 852. For example, conductive bottom 804 may include a single metal layer 856 or a plurality of stacked metal layers in direct contact with each other or a plurality of stacked metal layers diffusion welded with each other. Accordingly, at least a portion of conductive bottom 804 is free of insulation, air spaces, or vacuum spaces. Preferably, conductive bottom 804 defines a thermal path between bottom inner surface 816 and bottom outer surface 852 having a conductivity similar to or greater than most common metals (e.g. about 10 W/(m K) at 20° C. or greater). In the illustrated example, conductive bottom 804 includes a single metal layer 856 that includes bottom inner surface 816 and exposed bottom outer surface 852. In some embodiments, conductive bottom 804 is made of material number 1.3981 of DIN 17745. In some embodiments, conductive bottom 804 may be plated for cosmetic appearance, enhanced durability, and/or health standards compatibility.

Glass insulated sidewalls 808 help insulate a cold beverage (e.g. ice water) inside from ambient heat through the walls, while conductive bottom 804 permit efficient heat transfer (e.g. to a heat sink below). This can make beverage container 800 well suited for use as a first or second beverage container 504 or 508 to be thermally coupled to first or second beverage container support 512 or 516 of heat transfer pad 500 (FIG. 11). In some embodiments, the coefficient of thermal expansion of sidewalls 808 matches the coefficient of thermal expansion of conductive bottom 804, which can help improve robustness, reliability, and longevity of the seal (e.g. glass to metal seal). The matching coefficients of thermal expansion may also allow beverage container 800 to withstand large temperature swings, such as may be experienced in a dishwasher.

The all-glass construction of a traditional glass beverage container insulates the bottom and all sides of the container to mitigate heat transfer with the beverage inside, so that the temperature of the beverage inside can be maintained for as long as possible. In contrast, beverage container 800 includes a conductive bottom 804 so that heat transfer with beverage 832 (FIG. 18) occurs preferentially through bottom 804. The glass sidewalls 808 insulate the beverage 832 against wasteful heat exchange with the environment.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Items

Item 1. A beverage container comprising:

a base having a base lateral dimension;

a stem extending upwardly from a stem lower end coupled to the base to a stem upper end, the stem having a heat pipe extending between the stem lower end and the stem upper end, and the stem having a stem lateral dimension smaller than the base lateral dimension; and a bowl coupled to the stem upper end and extending upwardly of the stem, the bowl defining a liquid chamber having an upper opening.

Item 2. The beverage container of item 1, wherein:
the base includes a base conductive element thermally coupled to the heat pipe.

Item 3. The beverage container of item 2, wherein:
the base conductive element is made of a base conductor material having a thermal conductivity of at least 10 W/(m K) at 20° C.

Item 4. The beverage container of any one of items 2-3, wherein:
the base conductor material comprises metal.

Item 5. The beverage container of any one of items 2-4, wherein:
the base conductor material comprises ceramic.

Item 6. The beverage container of any one of items 2-5, wherein:
the base includes:
a base insulative element made of a base insulator material; and
a base conductive element thermally coupled to the heat pipe, and
the thermal conductivity of the base conductive material is at least 3 times a thermal conductivity of the base insulative element.

Item 7. The beverage container of any one of items 2-5, wherein:
the base includes a base insulative element made of a base insulator material different from the base conductor material, and the base insulator material has a thermal conductivity of less than 3 W/(m K) at 20° C.

Item 8. The beverage container of any one of items 6 or 7, wherein:
the base insulator material comprises glass.

Item 9. The beverage container of any one of items 6-8, wherein:
the base insulator material comprises ceramic.

Item 10. The beverage container of any one of items 6-9, wherein:
the base conductive element has a base conductive element lower end and a base conductive element upper end,
the base insulative element overlays at least a portion of the base conductive element upper end, and
the base conductive element lower end includes an exposed base conductive element contact surface.

Item 11. The beverage container of item 10 wherein:
the base has a base lower end defining a lower horizontal supporting plane;
the base insulative element has a base insulative lower surface; and
the base conductive element contact surface and the base insulative lower surface are on the supporting plane.

Item 12. The beverage container of item 10 wherein:
the base has a base lower end, and
the base conductive element contact surface is recessed from the base lower end.

Item 13. The beverage container of any one of items 6-12 wherein:
the base insulative element extends laterally outwardly of the base conductive element.

Item 14. The beverage container of any one of items 1-13 wherein:
the stem includes a stem sleeve, and the heat pipe is at least partially positioned within the stem sleeve.

Item 15. The beverage container of item 14 wherein:
the stem sleeve is spaced apart from the heat pipe between the stem upper end and the stem lower end.

Item 16. The beverage container of item 15 wherein:
the heat pipe has a heat pipe outer surface facing the stem sleeve, and
a majority of the stem sleeve is spaced apart from the heat pipe outer surface.

Item 17. The beverage container of any one of items 14-16 wherein:
the stem sleeve is made of a stem sleeve material having a thermal conductivity of less than 50 W/(m K) at 20° C.

Item 18. The beverage container of any one of items 14-16 wherein:
the stem sleeve is made of a stem sleeve material having a thermal conductivity of less than 3 W/(m K) at 20° C.

Item 19. The beverage container of any one of items 14-16 wherein:
the stem sleeve is made of a stem sleeve material comprising glass.

Item 20. The beverage container of any one of items 14-16 wherein:
the stem sleeve is made of a stem sleeve material comprising ceramic.

Item 21. The beverage container of any one of items 14-16 wherein:
the stem sleeve is made of a stem sleeve material comprising metal.

Item 22. The beverage container of any one of items 15-16 wherein:
the stem sleeve is spaced apart from the heat pipe by a hermetically sealed space.

Item 23. The beverage container of any one of items 22 wherein:
the sealed space contains a gas.

Item 24. The beverage container of any one of items 22 wherein:
the sealed space is substantially evacuated of gas.

Item 25. The beverage container of any one of items 1-21 wherein:
the bowl includes a substantially transparent portion.

Item 26. The beverage container of item 25 wherein:
the bowl includes a reflective layer that defines a reflective portion of the bowl.

Item 27. The beverage container of item 25 wherein:
the bowl includes a bowl bottom, and the bowl bottom includes the reflective portion.

Item 28. The beverage container of any one of items 1-26 wherein:
the bowl includes a bowl bottom, and the bowl bottom is thermally coupled to the heat pipe.

Item 29. The beverage container of item 28 wherein:
the bowl bottom is thermally coupled to the heat pipe by thermal adhesive.

Item 30. The beverage container of any one of items item 1-26 wherein:
the bowl includes a bowl bottom,
the bowl bottom includes a mounting lug, and
the stem upper end is coupled to the mounting lug.

Item 31. The beverage container of item 30 wherein:
the stem upper end is coupled to the mounting lug by a fastener having a fastener conductive inner portion and a fastener insulative outer portion;
the fastener conductive inner portion is made of a fastener conductor material, the fastener insulative outer portion is made of a fastener insulator material, a thermal conductivity of the fastener conductor material is greater than a thermal conductivity of the fastener insulator material, and the fastener conductive inner portion thermally couples the heat pipe to the bowl bottom.

Item 32. The beverage container of item 30 wherein:

the stem upper end is coupled to the mounting lug by a fastener, the fastener has a fastener upper end having a fastener upper lateral dimension, and a fastener lower end having a fastener lower lateral dimension, the fastener upper lateral dimension is greater than the fastener lower lateral dimension, and the fastener upper end is thermally coupled to the bowl bottom and the heat pipe.

Item 33. The beverage container of any one of items 1-32 wherein:

the base includes a volume of phase change material having a melting temperature of between −30° C. and 15° C. thermally coupled to the heat pipe.

Item 34. The beverage container of item 1 wherein:

the stem upper end is coupled to the bowl by a fastener, the base, the stem, and the fastener define a support assembling comprising an inner subassembly received in an outer subassembly, the inner subassembly includes the heat pipe, and the inner subassembly is spaced apart from the outer subassembly by a contiguous space which extends within at least the fastener and the stem.

Item 35. The beverage container of item 34 wherein:

the space is sealed except at the base.

Item 36. The beverage container of item 34 wherein:

the space is hermetically sealed.

Item 37. The beverage container of item 36 wherein:

the sealed space is substantially evacuated of gas.

Item 38. The beverage container of item 36 wherein:

the sealed space is filled with thermally insulating gas.

Item 39. The beverage container of any one of items 34-35 wherein:

the inner subassembly is coupled to the outer subassembly only at an upper end of the fastener.

Item 40. The beverage container of item 36 wherein:

the heat pipe has a heat pipe upper end sealed to the fastener, and a heat pipe lower end sealed to the stem sleeve.

Item 41. A method of making a beverage container, the method comprising:

providing a base defining a lower horizontal supporting plane;

providing a stem extending from a stem lower end to a stem upper end, the stem having a heat pipe extending between the stem lower end and the stem upper end;

providing a bowl defining a liquid chamber having an upper opening;

coupling the stem lower end to the base; and coupling the stem upper end to the bowl.

Item 42. The method of item 41, wherein:

providing the base comprises joining a base insulative element to a base conductive element, wherein the base conductive element has an exposed base conductive element lower surface.

Item 43. The method of item 42, wherein:

the base has a base lower end, and providing the base further comprises recessing the base conductive element lower surface from the base lower end.

Item 44. The method of any one of items 42-43, wherein:

coupling the stem lower end to the base comprises thermally coupling the base conductive element to the heat pipe.

Item 45. The method of item 41, wherein:

providing the base comprises joining a base insulative element to a base conductive element, and the base conductive element comprises a volume of phase change material having a melting temperature of between −30° C. and 15° C.

Item 46. The method of any one of items 41-45, wherein:

coupling the stem upper end to the bowl comprises thermally coupling the base upper end to the bowl.

Item 47. The method of any one of items 41-46, wherein:

providing the bowl comprises forming a bowl with a bowl bottom having a mounting lug.

Item 48. The method of item 47, wherein:

coupling the stem upper end to the bowl comprises coupling the stem upper end to the mounting lug with a fastener.

Item 49. The method of item 48, wherein:

coupling the stem upper end to the mounting lug with a fastener comprises thermally coupling the fastener to the heat pipe and the bowl bottom.

Item 50. The method of any one of items 41-49, wherein:

coupling stem upper end to the bowl comprises thermally coupling the stem upper end and the bowl using thermal adhesive.

Item 51. The method of any one of items 41-50, wherein:

the bowl has a bowl bottom including a transparent bowl material, and providing the bowl comprises applying a reflective layer to the bowl bottom.

Item 52. The method of any one of items 41-51, wherein:

providing the bowl comprises blow molding at least a portion of the bowl from transparent material including glass.

Item 53. The method of any one of items 41-52, wherein:

providing the base comprises press molding at least a portion of the base from transparent material including glass.

Item 54. The method of any one of items 41-53, wherein:

providing the stem comprises at least partially receiving the heat pipe within a stem sleeve.

Item 55. A method of making a beverage container comprising:

forming a stem comprising positioning a heat pipe shell in a stem sleeve to define a space between the heat pipe shell and the stem sleeve;

hermetically sealing the space; and coupling a bowl to the stem.

Item 56. The method of item 55, further comprising:

after hermetically sealing the space, sealing working fluid inside the heat pipe shell.

Item 57. The method of any one of items 55-56, wherein:

said hermetically sealing the space comprises applying heat.

Item 58. The method of any one of items 55-57, wherein:

said hermetically sealing the space comprises at least one of soldering, brazing and welding.

Item 59. The method of any one of items 55-58, wherein:

after hermetically sealing the space, sealing working fluid inside the heat pipe shell.

Item 60. The method of any one of items 55-58, wherein:

said forming the stem comprises positioning a heat pipe in the stem sleeve, and the heat pipe comprises the heat pipe shell.

Item 61. The method of any one of items 55-58, wherein:
a fastener is coupled to an upper end of the stem,
the space extends within the fastener;
said hermetically sealing comprises sealing the space at an upper end of the fastener; and
said coupling a bowl to the stem comprises mounting the bowl to the fastener.

Item 62. The method of any item 61, wherein:
the fastener comprises a fastener inner portion coupled to the heat pipe, and a fastener outer portion coupled to the stem sleeve, and
said hermetically sealing comprises sealing the fastener inner portion to the fastener outer portion at the upper end of the fastener.

Item 63. The method of any one of items 55-61, wherein:
said hermetically sealing the space is performed in a vacuum environment.

Item 64. A glass beverage container comprising:
a transparent glass body having a bottom and a sidewall extending upwardly from the bottom, the glass body having a body inner surface defining a liquid chamber with an upper opening, and the bottom having a bottom lower surface defining a lower horizontal supporting plane; and
a conductive slug coupled to the bottom and thermally coupled to the body inner surface, the conductive slug including an exposed slug lower contact surface, and the conductive slug being made of a slug material having a thermal conductivity of at least 10 W/(m K) at 20° C.

Item 65. The glass beverage container of item 64, wherein:
the slug lower end is recessed from the bottom lower surface.

Item 66. The glass beverage container of any one of items 64-65, wherein:
the conductive slug is at least partially embedded in the bottom.

Item 67. The glass beverage container of any one of items 64-66, wherein:
the slug material comprises metal.

Item 68. A beverage heat transfer pad comprising:
a first beverage container support including a first thermally conductive portion having an exposed upper contact surface, the first thermally conductive portion including a first conductive material having a thermal conductivity of at least 10 W/(m K);
one or more second beverage container supports, each second beverage container support including a second thermally conductive portion having an exposed upper contact surface, each second thermally conductive portion including a second conductive material having a thermal conductivity of at least 10 W/(m K);
an insulated body coupling the first beverage container support to each of the second beverage container supports, the insulated body spacing the first beverage container support from each of the second beverage container supports, and the insulated body including an insulative material having a thermal conductivity of less than 3 W/(m K); and
one or more thermal bridges collectively thermally coupling the first thermally conductive contact surface to each of the second thermally conductive contact surfaces.

Item 69. The beverage heat transfer pad of item 68, wherein:
the one or more second beverage container supports includes at least two second beverage container supports.

Item 70. The beverage heat transfer pad of item 69, wherein:
the thermal conductivities of the second thermally conductive portions of the two second beverage container supports is different.

Item 71. The beverage heat transfer pad of any one of items 69-70, wherein:
the first and second beverage container supports are distributed along a linear path.

Item 72. The beverage heat transfer pad of any one of items 68-71, wherein:
the one or more second beverage container supports includes at least three second beverage container supports, and
the second beverage container supports are distributed around the first beverage container support.

Item 73. The beverage heat transfer pad of any one of items 68-72, wherein:
the first beverage container support is larger than each of the second beverage container supports.

Item 74. The beverage heat transfer pad of any one of items 68-73, wherein:
at least one upper contact surface of the upper contact surfaces of the first and second thermally conductive portions protrudes upwardly.

Item 75. The beverage heat transfer pad of any one of items 68-74, wherein:
the insulated body underlies one or more of the first and second beverage container supports.

Item 76. The beverage heat transfer pad of any one of items 68-75, wherein:
at least one of the thermal bridges includes a heat pipe.

Item 77. A beverage heat transfer system, the system comprising:
the beverage heat transfer pad of any one of items 68-76, and
a first beverage container removably supportable on the first beverage container support whereby the first beverage container is thermally coupled to the upper contact surface of the first beverage container support and whereby the first beverage container is thermally coupled to each of the second beverage container supports by the one or more thermal bridges.

Item 78. The beverage heat transfer system of item 77, further comprising:
a second beverage container removably supportable on one of the second beverage container supports whereby the second beverage container is thermally coupled to the upper contact surface of that second beverage container support and whereby the second beverage container is thermally coupled to the upper contact surface of the first beverage container support by the one or more thermal bridges.

Item 79. The beverage heat transfer system of item 77, wherein:
the first beverage container has a first beverage volume capacity,
the second beverage container has a second beverage volume capacity, and
the first beverage volume capacity is greater than the second beverage volume capacity.

Item 80. The beverage heat transfer system of any one of items 77-79, wherein:
the first beverage container includes a container bottom end;
the container bottom end includes a recessed container contact surface; and the upper contact surface of the first beverage container support makes contact with the recessed container contact surface when the first beverage container is supported on the first beverage container support.

Item 81. A method of transferring heat between beverage containers, the method comprising:

placing a first beverage container on a first beverage container support thereby thermally coupling the first beverage container to the first beverage container support;

placing a second beverage container on a second beverage container support thereby thermally coupling the second beverage container to the second beverage container support, wherein the first beverage container support is spaced apart from the second beverage container support by insulating material, and transmitting heat between the first beverage container and the second beverage container across a thermal bridge that thermally couples the first beverage container support to the second beverage container support.

Item 82. The method of item 81, wherein:

the first beverage container is a container of cold water having a first temperature, the second beverage container is a container of alcoholic beverage having a second temperature greater than the first temperature, and said transmitting comprises transmitting heat from the alcoholic beverage to the cold water.

Item 83. The method of item 82, wherein:

the cold water has a temperature of less than 10° C.

Item 84. A beverage container comprising:

a conductive bottom having a bottom inside surface and a bottom outside surface, and a thermal conductivity between the bottom inside surface and bottom outside surface of at least 10 W/(m K);

a sidewall extending upwardly from the conductive bottom, the sidewall having a sidewall inside surface spaced apart from a sidewall outside surface by a gas space;

and a liquid chamber defined by the bottom inside surface and the sidewall inside surface.

Item 85. The beverage container of item 84, wherein:

the gas space is substantially evacuated of gas.

Item 86. The beverage container of any one of items 84-85, wherein:

the conductive bottom comprises one or more layers of metal that collectively provide direct thermal conduction between the bottom inside surface and the bottom outside surface.

Item 87. The beverage container of any one of items 84-85, wherein:

the conductive bottom comprises one layer of metal, the one layer of metal including at least a portion of the bottom inside surface and at least a portion of the bottom outside surface.

Item 88. A beverage container comprising:

a conductive bottom having a bottom inside surface and a bottom outside surface, and a thermal conductivity between the bottom inside surface and bottom outside surface of at least 10 W/(m K);

a glass sidewall extending upwardly from the conductive bottom, the glass sidewall having a sidewall inside surface; and a liquid chamber defined by the bottom inside surface and the sidewall inside surface.

Item 89. The beverage container of item 88, wherein the glass sidewall is made of borosilicate glass.

The invention claimed is:

1. A beverage container comprising:

a base having a base lateral dimension;

a stem extending upwardly from a stem lower end coupled to the base to a stem upper end, the stem having a heat pipe extending between the stem lower end and the stem upper end, and the stem having a stem lateral dimension smaller than the base lateral dimension; and a bowl coupled to the stem upper end and extending upwardly of the stem, the bowl defining a liquid chamber having an upper opening.

2. The beverage container of claim 1, wherein:

the base includes a base conductive element thermally coupled to the heat pipe.

3. The beverage container of claim 2, wherein:

the base conductive element is made of a base conductor material having a thermal conductivity of at least 10 W/(m K) at 20° C.

4. The beverage container of claim 2, wherein:

the base conductor material comprises metal.

5. The beverage container of claim 2, wherein:

the base includes:

a base outer element; and a base conductive element thermally coupled to the heat pipe, the base conductive element has a base conductive element lower end and a base conductive element upper end, the base outer element overlays at least a portion of the base conductive element upper end, and the base conductive element lower end includes an exposed base conductive element contact surface.

6. The beverage container of claim 5 wherein:

the base has a base lower end, and the base conductive element contact surface is recessed from the base lower end.

7. The beverage container of claim 5 wherein:

the base outer element extends laterally outwardly of the base conductive element.

8. The beverage container of claim 1 wherein:

the stem includes a stem sleeve, and the heat pipe is at least partially positioned within the stem sleeve.

9. The beverage container of claim 8 wherein:

the stem sleeve is spaced apart from the heat pipe between the stem upper end and the stem lower end.

10. The beverage container of claim 9 wherein:

the heat pipe has a heat pipe outer surface facing the stem sleeve, and a majority of the stem sleeve is spaced apart from the heat pipe outer surface.

11. The beverage container of claim 8 wherein:

the stem sleeve is made of a stem sleeve material comprising metal.

12. The beverage container of claim 9 wherein:

the stem sleeve is spaced apart from the heat pipe by a hermetically sealed space.

13. The beverage container of claim 12 wherein:

the sealed space contains a gas.

14. The beverage container of claim 12 wherein:

the sealed space is substantially evacuated of gas.

15. The beverage container of claim 1 wherein:

the bowl includes a substantially transparent portion.

16. The beverage container of claim 15 wherein:

the bowl includes a bowl bottom, and the bowl bottom includes the reflective portion.

17. The beverage container of claim 1 wherein:

the bowl includes a bowl bottom, and the bowl bottom is thermally coupled to the heat pipe.

18. The beverage container of claim 17 wherein:

the bowl bottom is thermally coupled to the heat pipe by thermal adhesive.

19. The beverage container of claim 1 wherein:

the stem upper end is coupled to the bowl by a fastener, the base, the stem, and the fastener collectively define a support assembling comprising an inner subassembly received in an outer subassembly, the inner subassembly includes the heat pipe, and the inner subassembly is spaced apart from the outer subassembly by a contiguous space which extends within at least the fastener and the stem.

20. The beverage container of claim 19 wherein:

the space is hermetically sealed.

21. The beverage container of claim 20 wherein:

the sealed space is substantially evacuated of gas.

22. A method of making a beverage container, the method comprising:

providing a base defining a lower horizontal supporting plane;

providing a stem extending from a stem lower end to a stem upper end, the stem having a heat pipe extending between the stem lower end and the stem upper end;

providing a bowl defining a liquid chamber having an upper opening;

coupling the stem lower end to the base; and coupling the stem upper end to the bowl.

* * * * *